US008538749B2

(12) United States Patent
Visser et al.

(10) Patent No.: US 8,538,749 B2
(45) Date of Patent: Sep. 17, 2013

(54) SYSTEMS, METHODS, APPARATUS, AND COMPUTER PROGRAM PRODUCTS FOR ENHANCED INTELLIGIBILITY

(75) Inventors: Erik Visser, San Diego, CA (US); Jeremy Toman, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1118 days.

(21) Appl. No.: 12/277,283

(22) Filed: Nov. 24, 2008

(65) Prior Publication Data

US 2010/0017205 A1 Jan. 21, 2010

Related U.S. Application Data

(60) Provisional application No. 61/081,987, filed on Jul. 18, 2008, provisional application No. 61/093,969, filed on Sep. 3, 2008.

(51) Int. Cl.
*G10L 21/02* (2013.01)

(52) U.S. Cl.
USPC ..... 704/228; 704/226; 704/200

(58) Field of Classification Search
USPC ..... 704/200–201, 226–228, 500–504
See application file for complete search history.

(56) References Cited

U.S. PATENT DOCUMENTS

| | | | | |
|---|---|---|---|---|
| 4,641,344 | A | 2/1987 | Kasai et al. | |
| 5,105,377 | A | 4/1992 | Ziegler, Jr. | |
| 5,388,185 | A | 2/1995 | Terry | |
| 5,485,515 | A | 1/1996 | Allen | |
| 5,524,148 | A | 6/1996 | Allen | |
| 5,526,419 | A | 6/1996 | Allen | |
| 5,553,134 | A | 9/1996 | Allen | |
| 5,646,961 | A | 7/1997 | Shoham | |
| 5,699,382 | A | 12/1997 | Shoham | |
| 5,764,698 | A * | 6/1998 | Sudharsanan et al. | 375/241 |
| 5,794,187 | A * | 8/1998 | Franklin et al. | 704/225 |
| 6,002,776 | A | 12/1999 | Bhadkamkar et al. | |
| 6,064,962 | A | 5/2000 | Oshikiri et al. | |
| 6,240,192 | B1 | 5/2001 | Brennan | |
| 6,411,927 | B1 | 6/2002 | Morin et al. | |
| 6,415,253 | B1 | 7/2002 | Johnson | |
| 6,618,481 | B1 | 9/2003 | Schmidt | |
| 6,678,651 | B2 | 1/2004 | Gao | |
| 6,704,428 | B1 | 3/2004 | Wurtz | |
| 6,732,073 | B1 * | 5/2004 | Kluender et al. | 704/233 |

(Continued)

FOREIGN PATENT DOCUMENTS

| | | | |
|---|---|---|---|
| CN | 85105410 | A | 1/1987 |
| CN | 1684143 | A | 10/2005 |

(Continued)

OTHER PUBLICATIONS

Aichner R et al :"Post-Processing for convolutive blind source separation" Acoustics, speech and signal processing, 2006. ICASSP 2006 proceedings. 2006 IEEE International Conference on Toulouse, France May 14-19, 2006.

(Continued)

*Primary Examiner* — Douglas Godbold
(74) *Attorney, Agent, or Firm* — Espartaco Diaz Hidalgo

(57) ABSTRACT

Techniques described herein include the use of equalization techniques to improve intelligibility of a reproduced audio signal (e.g., a far-end speech signal).

50 Claims, 68 Drawing Sheets

(56) References Cited

U.S. PATENT DOCUMENTS

| | | | | |
|---|---|---|---|---|
| 6,757,395 | B1 * | 6/2004 | Fang et al. | 381/94.3 |
| 6,834,108 | B1 | 12/2004 | Schmidt | |
| 6,885,752 | B1 | 4/2005 | Chabries | |
| 6,937,738 | B2 | 8/2005 | Armstrong | |
| 6,968,171 | B2 | 11/2005 | Vanderhelm et al. | |
| 6,970,558 | B1 | 11/2005 | Schmidt | |
| 6,980,665 | B2 | 12/2005 | Kates | |
| 6,993,480 | B1 | 1/2006 | Klayman | |
| 7,010,133 | B2 | 3/2006 | Chalupper et al. | |
| 7,010,480 | B2 | 3/2006 | Gao et al. | |
| 7,020,288 | B1 | 3/2006 | Ohashi | |
| 7,031,460 | B1 | 4/2006 | Zheng et al. | |
| 7,050,966 | B2 | 5/2006 | Schneider | |
| 7,099,821 | B2 | 8/2006 | Visser et al. | |
| 7,103,188 | B1 | 9/2006 | Jones | |
| 7,120,579 | B1 | 10/2006 | Licht | |
| 7,181,034 | B2 | 2/2007 | Armstrong | |
| 7,242,763 | B2 | 7/2007 | Etter | |
| 7,277,554 | B2 | 10/2007 | Kates | |
| 7,336,662 | B2 | 2/2008 | Hassan-Ali et al. | |
| 7,382,886 | B2 | 6/2008 | Henn | |
| 7,433,481 | B2 | 10/2008 | Armstrong | |
| 7,444,280 | B2 | 10/2008 | Vandali et al. | |
| 7,492,889 | B2 | 2/2009 | Ebenezer | |
| 7,516,065 | B2 * | 4/2009 | Marumoto | 704/215 |
| 7,564,978 | B2 * | 7/2009 | Engdegard et al. | 381/23 |
| 7,676,374 | B2 * | 3/2010 | Tammi | 704/500 |
| 7,711,552 | B2 * | 5/2010 | Villemoes | 704/200 |
| 7,729,775 | B1 | 6/2010 | Saoji et al. | |
| 8,095,360 | B2 | 1/2012 | Gao | |
| 8,160,273 | B2 | 4/2012 | Visser et al. | |
| 2001/0001853 | A1 | 5/2001 | Mauro et al. | |
| 2002/0076072 | A1 | 6/2002 | Cornelisse | |
| 2002/0193130 | A1 * | 12/2002 | Yang et al. | 455/501 |
| 2003/0023433 | A1 | 1/2003 | Erell et al. | |
| 2003/0093268 | A1 | 5/2003 | Zinser, Jr. et al. | |
| 2003/0152244 | A1 | 8/2003 | Taenzer | |
| 2003/0158726 | A1 | 8/2003 | Philippe et al. | |
| 2004/0125973 | A1 | 7/2004 | Fang | |
| 2004/0136545 | A1 | 7/2004 | Sarpeshkar et al. | |
| 2004/0161121 | A1 * | 8/2004 | Chol et al. | 381/92 |
| 2004/0196994 | A1 | 10/2004 | Kates | |
| 2004/0252846 | A1 | 12/2004 | Nonaka et al. | |
| 2004/0252850 | A1 * | 12/2004 | Turicchia et al. | 381/94.2 |
| 2005/0141737 | A1 | 6/2005 | Hansen | |
| 2005/0165603 | A1 | 7/2005 | Bessette et al. | |
| 2005/0165608 | A1 | 7/2005 | Suzuki et al. | |
| 2005/0207585 | A1 | 9/2005 | Christoph | |
| 2006/0008101 | A1 | 1/2006 | Kates | |
| 2006/0069556 | A1 | 3/2006 | Nadjar et al. | |
| 2006/0149532 | A1 | 7/2006 | Boillot et al. | |
| 2006/0222184 | A1 | 10/2006 | Buck et al. | |
| 2006/0262938 | A1 | 11/2006 | Gauger et al. | |
| 2006/0262939 | A1 | 11/2006 | Buchner et al. | |
| 2006/0270467 | A1 | 11/2006 | Song et al. | |
| 2006/0293882 | A1 | 12/2006 | Giesbrecht et al. | |
| 2007/0053528 | A1 | 3/2007 | Kim | |
| 2007/0092089 | A1 | 4/2007 | Seefeldt et al. | |
| 2007/0100605 | A1 * | 5/2007 | Renevey et al. | 704/201 |
| 2007/0110042 | A1 | 5/2007 | Li et al. | |
| 2007/0233466 | A1 * | 10/2007 | Tammi | 704/200.1 |
| 2008/0039162 | A1 | 2/2008 | Anderton | |
| 2008/0130929 | A1 | 6/2008 | Arndt et al. | |
| 2008/0175422 | A1 | 7/2008 | Kates | |
| 2008/0186218 | A1 | 8/2008 | Ohkuri et al. | |
| 2008/0215332 | A1 * | 9/2008 | Zeng et al. | 704/271 |
| 2008/0243496 | A1 * | 10/2008 | Wang | 704/226 |
| 2008/0269926 | A1 | 10/2008 | Xiang | |
| 2009/0024185 | A1 | 1/2009 | Kulkarni et al. | |
| 2009/0034748 | A1 | 2/2009 | Sibbald | |
| 2009/0111507 | A1 | 4/2009 | Chen | |
| 2009/0170550 | A1 | 7/2009 | Foley | |
| 2009/0192803 | A1 | 7/2009 | Nagaraja et al. | |
| 2009/0254340 | A1 * | 10/2009 | Sun et al. | 704/226 |
| 2009/0271187 | A1 * | 10/2009 | Yen et al. | 704/226 |
| 2009/0299742 | A1 | 12/2009 | Toman et al. | |
| 2010/0131269 | A1 | 5/2010 | Park et al. | |
| 2010/0296668 | A1 | 11/2010 | Lee et al. | |
| 2011/0007907 | A1 | 1/2011 | Park et al. | |
| 2011/0137646 | A1 * | 6/2011 | Ahgren et al. | 704/226 |
| 2011/0293103 | A1 | 12/2011 | Park et al. | |
| 2012/0263317 | A1 | 10/2012 | Shin et al. | |

FOREIGN PATENT DOCUMENTS

| | | | |
|---|---|---|---|
| EP | 0643881 | A1 | 3/1995 |
| EP | 0742548 | | 11/1996 |
| EP | 1081685 | | 3/2001 |
| EP | 1232494 | A1 | 8/2002 |
| EP | 1522206 | A1 | 4/2005 |
| JP | 03266899 | | 11/1991 |
| JP | 6175691 | A | 6/1994 |
| JP | 9006391 | A | 1/1997 |
| JP | 11298990 | A | 10/1999 |
| JP | 2000082999 | A | 3/2000 |
| JP | 2001292491 | A | 10/2001 |
| JP | 2002369281 | | 12/2002 |
| JP | 2003218745 | A | 7/2003 |
| JP | 2003271191 | A | 9/2003 |
| JP | 2004289614 | A | 10/2004 |
| JP | 2005168736 | | 6/2005 |
| JP | 2006340391 | A | 12/2006 |
| JP | 2009031793 | A | 2/2009 |
| KR | 19970707648 | | 12/1997 |
| TW | 200623023 | | 7/2006 |
| TW | 200632869 | | 9/2006 |
| WO | WO9326085 | A1 | 12/1993 |
| WO | WO9711533 | A1 | 3/1997 |
| WO | WO2005069275 | A1 | 7/2005 |
| WO | WO2006012578 | | 2/2006 |
| WO | WO2008138349 | A2 | 11/2008 |
| WO | 2009092522 | A1 | 7/2009 |

OTHER PUBLICATIONS

Piscataway, NJ, USA,May 14, 2006, Piscataway, NJ, USA,IEEE Piscataway, NJ, USA,May 14, 2006, p. V XP031387071, p. 37, left-hand col., line 1—p. 39, left-hand col., line 39.

Araki S et al: "Subband based blind source separation for convolutive mixtures of speech"Proceedings of International Conference on Acoustics, Speech and Signal Processing (ICASSP'OS) April 6-10, 2003 Hong Kong, China; [IEEE International Conference on Acoustics, Speech, and Signal Processing (ICASSP)], 2003 IEEE International Conference, vol. 5, Apr. 6, 2003, pp. V 509-V 512, XP010639320ISBN: 9780780376632.

Hasegawa et al, "Environmental Acoustic Noise Cancelling based on For rant Enhancement," Studia'Phonologic, 1984, 59-68.

Hermansen K. , "ASPI-project proposal(9-10 sem.)," Speech Enhancement. Aalborg University, 2009, 4.

International Search Report and Written Opinion—PCT/US2009/051020, International Search Authority—European Patent Office—Oct. 30, 2009.

J.B. Laflen et al. A Flexible Analytical Framework for Applying and Testing Alternative Spectral Enhancement Algorithms (poster). International Hearing Aid Convention (IHCON) 2002. (original document is a poster, submitted here as 3 pp.) Last accessed Mar. 16, 2009 at.

Laflen J.B., et al., "A Flexible, Analytical Framework for Applying and Testing Alternative Spectral Enhancement Algorithms," International Hearing Aid Convention , 2002, 200-211.

T. Baer et al. Spectral contrast enhancement of speech in noise for listeners with sensonneural hearing impairment: effects on intelligibility, quality, and response times. J. Rehab. Research and Dev., vol. 20, No. 1, 1993. pp. 49-72.

Turicchia L., et al., "A Bio-Inspired Companding Strategy for, Spectral Enhancement," IEEE Transactions on Speech and Audio Processing, 2005, vol. 13 (2), 243-253.

Valin J-M et al: "Microphone array post-filter for separation of simultaneous non-stationary sources"Acoustics, Speech, and Signal Processing, 2004. Proceedings. (ICASSP '04). IEEE International Conference on Montreal, Quebec, Canada May 17-21, 2004, Piscataway, NJ, USA.IEEE, vol. 1, May 17, 2004, pp. 221-224, XP010717605ISBN: 9780780384842.

Visser, et al.: "Blind source separation in mobile environments using a priori knowledge" Acoustics, speech, and signal processing, 2004 Proceedings ICASSP 2004, IEEE Intl Conference, Montreal, Quebec, Canada, May 17-21, 2004, Piscataway, NJ, US, IEEE vol. 3 May 17, 2004, pp. 893-896, ISBN: 978-0-7803-8484-2.

Yang J., et al., "Spectral contrast enhancement," Algorithms and comparisons. Speech Communication, 2003, vol. 39, 33-46.

Shin, "Perceptual Reinforcement of Speech Signal Based on Partial Specific Loudness," IEEE Signal Processing Letters, Nov. 2007, pp. 887-890, vol. 14, No. 11.

Brian C. J. Moore, et al., "A Model for the Prediction of Thresholds, Loudness, and Partial Loudness", J. Audio Eng. Soc., pp. 224-240, vol. 45, No. 4, Apr. 1997.

De Diego, M., et al., An adaptive algorithms comparison for real multichannel active noise control. EUSIPCO (European Signal Processing Conference) 2004, Sep. 6-10, 2004, Vienna, AT, vol. II, pp. 925-928.

Esben Skovenborg, et al., "Evaluation of Different Loudness Models with Music and Speech Material", Oct. 28-31, 2004.

Jiang, F., et al., New Robust Adaptive Algorithm for Multichannel Adaptive Active Noise Control. Proc. 1997 IEEE Int'l Conf. Control Appl., Oct. 5-7, 1997, pp. 528-533.

Payan, R. Parametric Equalization on TMS320C6000 DSP. Application Report SPRA867, Dec. 2002, Texas Instruments, Dallas, TX. 29 pp.

Streeter, A. et al. Hybrid Feedforward-Fedback Active Noise Control. Proc. 2004 Amer. Control Conf., Jun. 30-Jul. 2, 2004, Amer. Auto. Control Council, pp. 2876-2881, Boston, MA.

* cited by examiner

FIG. 16A
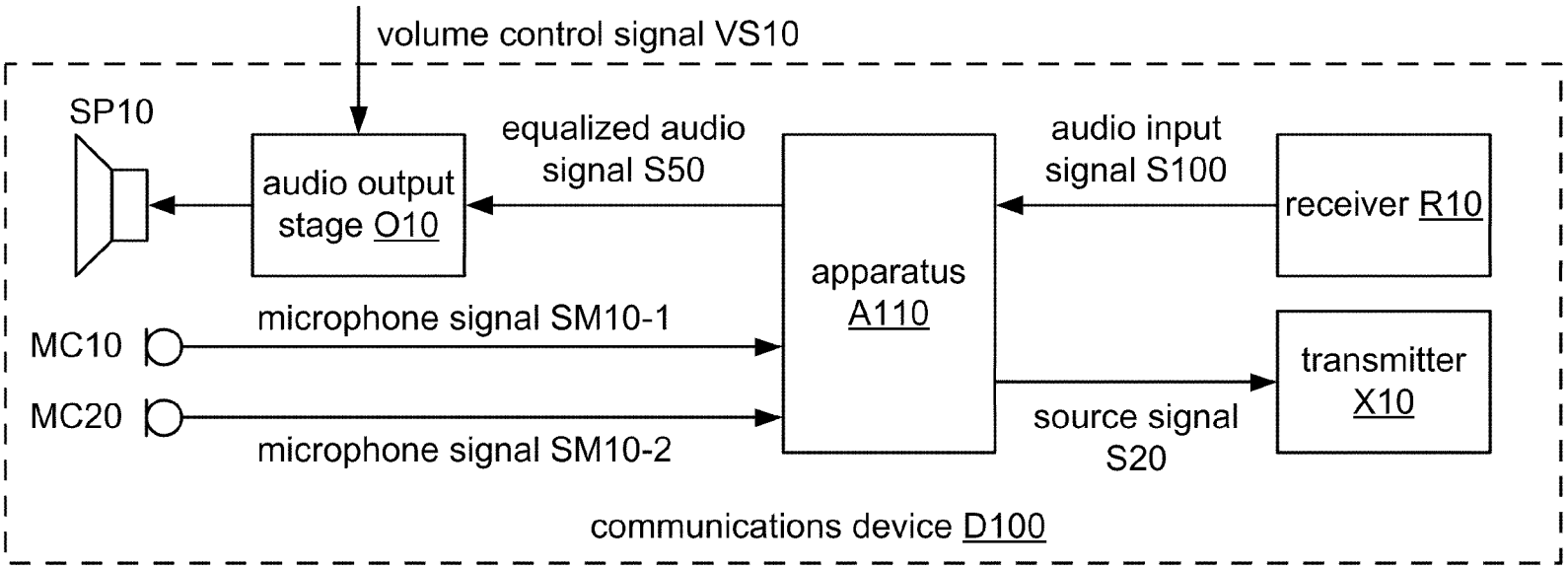
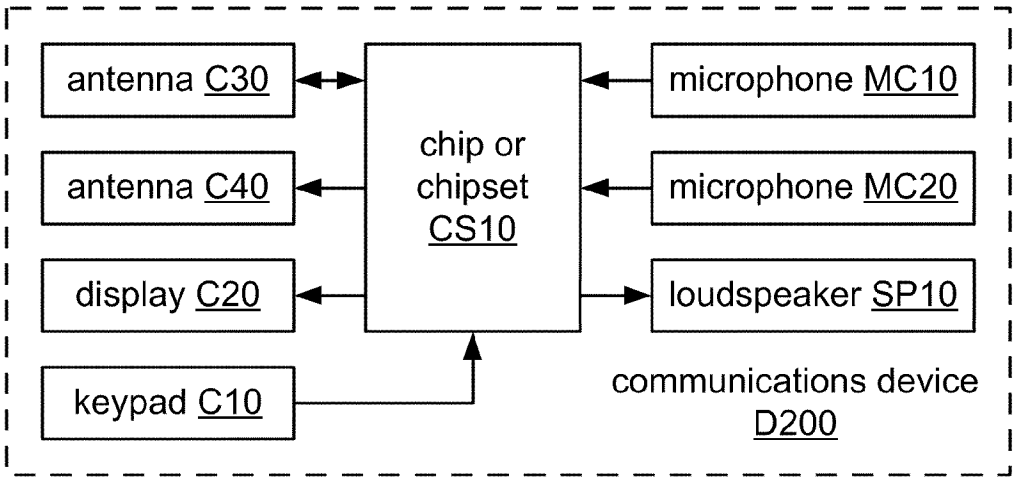
FIG. 16B

FIG. 25A

```
G(i,k) = EN(i,k) / (EA(i,k) + eps);
if (G(i,k) <= G(i,k-1)) { G(i,k) = beta_dec * G(i,k-1); }
else { G(i,k) = (beta_att * G(i,k-1)) + ((1 - beta_att) * G(i,k)); }
```

FIG. 25B

```
G(i,k) = EN(i,k) / (EA(i,k) + eps);
if (G(i,k) <= G(i,k-1)) {
   if (hangover(i) > 0) { hangover(i)--; }
   if (hangover(i) == 0) { G(i,k) = beta_dec * G(i,k-1); }
   else { G(i,k) = G(i,k-1); }
}
else {
  hangover(i) = hangover_max(i);
  G(i,k) = (beta_att * G(i,k-1)) + ((1 - beta_att) * G(i,k));
}
```

```
G(i,k) = EN(i,k) / (EA(i,k) + eps);
if (G(i,k) <= G(i,k-1)) {
  G(i,k) = beta_dec * G(i,k-1);
  if (G(i,k) < LB) { G(i,k) = LB; }
}
else {
  if (G(i,k) > UB) { G(i,k) = UB; }
  G(i,k) = (beta_att * G(i,k-1)) + ((1 - beta_att) * G(i,k));
}
```

FIG. 26A

```
G(i,k) = EN(i,k) / (EA(i,k) + eps);
if (G(i,k) <= G(i,k-1)) {
   if (hangover(i) > 0) { hangover(i)--; }
   if (hangover(i) == 0) {
     G(i,k) = beta_dec * G(i,k-1);
     if (G(i,k) < LB) { G(i,k) = LB; }
   }
   else { G(i,k) = G(i,k-1); }
}
else {
  hangover(i) = hangover_max(i);
  if (G(i,k) > UB) { G(i,k) = UB; }
  G(i,k) = (beta_att * G(i,k-1)) + ((1 - beta_att) * G(i,k));
}
```

FIG. 26B

```
if VAD == 1 {
  ratio(i,k) = EN(i,k) / (EA(i,k) + eps);
  if (ratio(i,k) > UB) { ratio(i,k) = UB; }
  if (ratio(i,k) <= G(i,k)) { G(i,k) = beta_dec * G(i,k-1); }
  else {
    if (ratio(i,k) < LB) { ratio(i,k) = LB; }
    G(i,k) = (beta_att * G(i,k-1)) + ((1 - beta_att) * ratio(i,k));
  }
  if (G(i,k) < LB) { G(i,k) = LB; }
  if (G(i,k) > UB) { G(i,k) = UB; }
}
```

FIG. 30A

```
if VAD == 1 {
  ratio(i,k) = EN(i,k) / (EA(i,k) + eps);
  if (ratio(i,k) > UB) { ratio(i,k) = UB; }
  if (ratio(i,k) <= G(i,k)) {
    if (hangover(i) > 0) { hangover(i)--; }
    if (hangover(i) == 0) { G(i,k) = beta_dec * G(i,k-1); }
  }
  else {
    hangover(i) = hangover_max(i);
    if (ratio(i,k) < LB) { ratio(i,k) = LB; }
    G(i,k) = (beta_att * G(i,k-1)) + ((1 - beta_att) * ratio(i,k));
  }
  if (G(i,k) < LB) { G(i,k) = LB; }
  if (G(i,k) > UB) { G(i,k) = UB; }
}
```

FIG. 30B

```
if ( VAD == 1 ) || ( ( G(i,k) = EN(i,k) / (EA(i,k) + eps) ) <= G(i,k-1) ) {
    G(i,k) = beta_dec * G(i,k-1);
    if (G(i,k) < LB) { G(i,k) = LB; }
}
else {
  if (G(i,k) > UB) { G(i,k) = UB; }
  G(i,k) = (beta_att * G(i,k-1)) + ((1 - beta_att) * G(i,k));
}
```

FIG. 31A

```
if VAD == 0 {
  G(i,k) = beta_dec * G(i,k-1);
  if (G(i,k) < LB) { G(i,k) = LB; }
}
else {
  G(i,k) = EN(i,k) / (EA(i,k) + eps);
  if (G(i,k) <= G(i,k-1)) {
     if (hangover(i) > 0) { hangover(i)--; }
     if (hangover(i) == 0) {
       G(i,k) = beta_dec * G(i,k-1);
       if (G(i,k) < LB) { G(i,k) = LB; }
     }
     else { G(i,k) = G(i,k-1); }
  }
  else {
    hangover(i) = hangover_max(i);
    if (G(i,k) > UB) { G(i,k) = UB; }
    G(i,k) = (beta_att * G(i,k-1)) + ((1 - beta_att) * G(i,k));
  }
}
```

FIG. 31B

```
pkdiff = peak_lim - abs(sig(k));

if (pkdiff < 0) { diffgain = 1 + (pkdiff/peak_lim); }
else { diffgain = 1; }

if (diffgain > g_pk) { g_pk = (gamma_att * g_pk) + ((1 - gamma_att) * diffgain); }
else { g_pk = (gamma_dec * g_pk) + ((1 - gamma_dec) * diffgain); }

sig(k) = sig(k) * g_pk;
```

FIG. 35A

```
if (abs(sig(k)) > peak_lim) { diffgain = 2 - ( abs(sig(k))/peak_lim ); }
else { diffgain = 1; }

if (diffgain > g_pk) { g_pk = (gamma_att * g_pk) + ((1 - gamma_att) * diffgain); }
else { g_pk = (gamma_dec * g_pk) + ((1 - gamma_dec) * diffgain); }

sig(k) = sig(k) * g_pk;
```

FIG. 35B

SYSTEMS, METHODS, APPARATUS, AND COMPUTER PROGRAM PRODUCTS FOR ENHANCED INTELLIGIBILITY

CLAIM OF PRIORITY UNDER 35 U.S.C. §119

The present Application for Patent claims priority to Provisional Application No. 61/081,987, entitled "SYSTEMS, METHODS, APPARATUS, AND COMPUTER PROGRAM PRODUCTS FOR ENHANCED INTELLIGIBILITY," filed Jul. 18, 2008, and to Provisional Application No. 61/093,969, entitled "SYSTEMS, METHODS, APPARATUS, AND COMPUTER PROGRAM PRODUCTS FOR ENHANCED INTELLIGIBILITY," filed Sep. 3, 2008, which are assigned to the assignee hereof and are hereby expressly incorporated by reference herein.

BACKGROUND

1. Field

This disclosure relates to speech processing.

2. Background

An acoustic environment is often noisy, making it difficult to hear a desired informational signal. Noise may be defined as the combination of all signals interfering with or degrading a signal of interest. Such noise tends to mask a desired reproduced audio signal, such as the far-end signal in a phone conversation. For example, a person may desire to communicate with another person using a voice communication channel. The channel may be provided, for example, by a mobile wireless handset or headset, a walkie-talkie, a two-way radio, a car-kit, or another communications device. The acoustic environment may have many uncontrollable noise sources that compete with the far-end signal being reproduced by the communications device. Such noise may cause an unsatisfactory communication experience. Unless the far-end signal may be distinguished from background noise, it may be difficult to make reliable and efficient use of it.

SUMMARY

A method of processing a reproduced audio signal according to a general configuration includes filtering the reproduced audio signal to obtain a first plurality of time-domain subband signals, and calculating a plurality of first subband power estimates based on information from the first plurality of time-domain subband signals. This method includes performing a spatially selective processing operation on a multichannel sensed audio signal to produce a source signal and a noise reference, filtering the noise reference to obtain a second plurality of time-domain subband signals, and calculating a plurality of second subband power estimates based on information from the second plurality of time-domain subband signals. This method includes boosting at least one frequency subband of the reproduced audio signal relative to at least one other frequency subband of the reproduced audio signal, based on information from the plurality of first subband power estimates and on information from the plurality of second subband power estimates.

A method of processing a reproduced audio signal according to a general configuration includes performing a spatially selective processing operation on a multichannel sensed audio signal to produce a source signal and a noise reference, and calculating a first subband power estimate for each of a plurality of subbands of the reproduced audio signal. This method includes calculating a first noise subband power estimate for each of a plurality of subbands of the noise reference, and calculating a second noise subband power estimate for each of a plurality of subbands of a second noise reference that is based on information from the multichannel sensed audio signal. This method includes calculating, for each of the plurality of subbands of the reproduced audio signal, a second subband power estimate that is based on a maximum of the corresponding first and second noise subband power estimates. This method includes boosting at least one frequency subband of the reproduced audio signal relative to at least one other frequency subband of the reproduced audio signal, based on information from the plurality of first subband power estimates and on information from the plurality of second subband power estimates.

An apparatus for processing a reproduced audio signal according to a general configuration includes a first subband signal generator configured to filter the reproduced audio signal to obtain a first plurality of time-domain subband signals, and a first subband power estimate calculator configured to calculate a plurality of first subband power estimates based on information from the first plurality of time-domain subband signals. This apparatus includes a spatially selective processing filter configured to perform a spatially selective processing operation on a multichannel sensed audio signal to produce a source signal and a noise reference, and a second subband signal generator configured to filter the noise reference to obtain a second plurality of time-domain subband signals. This apparatus includes a second subband power estimate calculator configured to calculate a plurality of second subband power estimates based on information from the second plurality of time-domain subband signals, and a subband filter array configured to boost at least one frequency subband of the reproduced audio signal relative to at least one other frequency subband of the reproduced audio signal, based on information from the plurality of first subband power estimates and on information from the plurality of second subband power estimates.

A computer-readable medium according to a general configuration includes instructions which when executed by a processor cause the processor to perform a method of processing a reproduced audio signal. These instructions include instructions which when executed by a processor cause the processor to filter the reproduced audio signal to obtain a first plurality of time-domain subband signals and to calculate a plurality of first subband power estimates based on information from the first plurality of time-domain subband signals. The instructions also include instructions which when executed by a processor cause the processor to perform a spatially selective processing operation on a multichannel sensed audio signal to produce a source signal and a noise reference, and to filter the noise reference to obtain a second plurality of time-domain subband signals. The instructions also include instructions which when executed by a processor cause the processor to calculate a plurality of second subband power estimates based on information from the second plurality of time-domain subband signals, and to boost at least one frequency subband of the reproduced audio signal relative to at least one other frequency subband of the reproduced audio signal, based on information from the plurality of first subband power estimates and on information from the plurality of second subband power estimates.

An apparatus for processing a reproduced audio signal according to a general configuration includes means for performing a directional processing operation on a multichannel sensed audio signal to produce a source signal and a noise reference. This apparatus also includes means for equalizing the reproduced audio signal to produce an equalized audio signal. In this apparatus, the means for equalizing is configured to boost at least one frequency subband of the reproduced audio signal relative to at least one other frequency subband of the reproduced audio signal, based on information from the noise reference.

BRIEF DESCRIPTION OF THE DRAWINGS

FIG. 16A shows a block diagram of a communications device D100 that includes an instance of apparatus A110.

FIG. 16B shows a block diagram of an implementation D200 of communications device D100.

FIG. 25A shows a pseudocode listing.

FIG. 25B shows a modification of the pseudocode listing of FIG. 25A.

FIGS. 26A and 26B show modifications of the pseudocode listings of FIGS. 25A and 25B, respectively.

FIGS. 30A and 30B show modifications of the pseudocode listings of FIGS. 26A and 26B, respectively.

FIGS. 31A and 31B show other modifications of the pseudocode listings of FIGS. 26A and 26B, respectively.

FIG. 35A shows a pseudocode listing that describes one example of a peak limiting operation.

FIG. 35B shows another version of the pseudocode listing of FIG. 35A.

Figure 1:
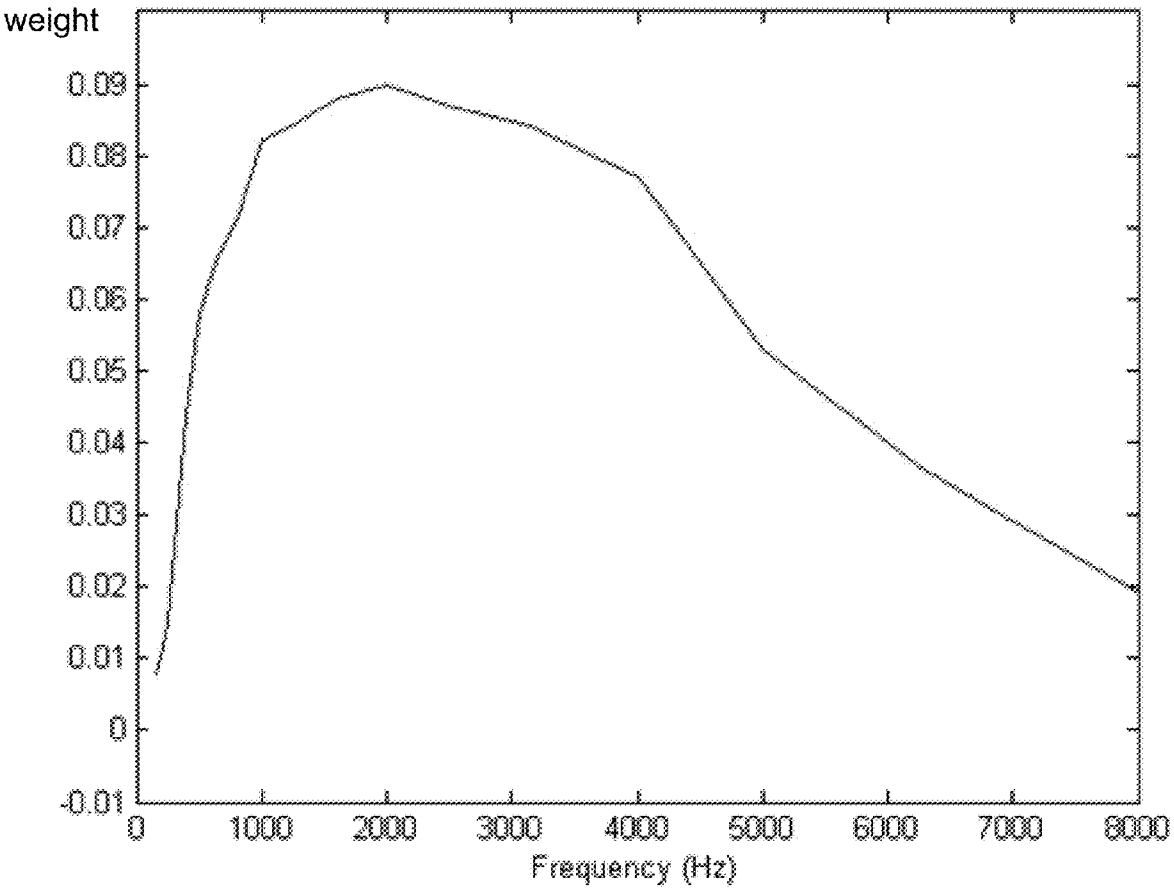
FIG. 1 shows an articulation index plot.

In these drawings, uses of the same label indicate instances of the same structure, unless context dictates otherwise.

DETAILED DESCRIPTION

Handsets like PDAs and cellphones are rapidly emerging as the mobile speech communications devices of choice, serving as platforms for mobile access to cellular and internet networks. More and more functions that were previously performed on desktop computers, laptop computers, and office phones in quiet office or home environments are being performed in everyday situations like a car, the street, a café, or an airport. This trend means that a substantial amount of voice communication is taking place in environments where users are surrounded by other people, with the kind of noise content that is typically encountered where people tend to gather. Other devices that may be used for voice communications and/or audio reproduction in such environments include wired and/or wireless headsets, audio or audiovisual media playback devices (e.g., MP3 or MP4 players), and similar portable or mobile appliances.

Systems, methods, and apparatus as described herein may be used to support increased intelligibility of a received or otherwise reproduced audio signal, especially in a noisy environment. Such techniques may be applied generally in any transceiving and/or audio reproduction application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). Similarly, the term "in response to" is used to indicate any of its ordinary meanings, including "in response to at least."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to produce decoded representations of the frames. Such an encoder and decoder are typically deployed at opposite terminals of a communications link. In order to support a full-duplex communication, instances of both of the encoder and the decoder are typically deployed at each end of such a link.

In this description, the term "sensed audio signal" denotes a signal that is received via one or more microphones, and the term "reproduced audio signal" denotes a signal that is reproduced from information that is retrieved from storage and/or received via a wired or wireless connection to another device. An audio reproduction device, such as a communications or playback device, may be configured to output the reproduced audio signal to one or more loudspeakers of the device. Alternatively, such a device may be configured to output the reproduced audio signal to an earpiece, other headset, or external loudspeaker that is coupled to the device via a wire or wirelessly. With reference to transceiver applications for voice communications, such as telephony, the sensed audio signal is the near-end signal to be transmitted by the transceiver, and the reproduced audio signal is the far-end signal received by the transceiver (e.g., via a wireless communications link). With reference to mobile audio reproduction applications, such as playback of recorded music or speech (e.g., MP3s, audiobooks, podcasts) or streaming of such content, the reproduced audio signal is the audio signal being played back or streamed.

The intelligibility of a reproduced speech signal may vary in relation to the spectral characteristics of the signal. For example, the articulation index plot of FIG. 1 shows how the relative contribution to speech intelligibility varies with audio frequency. This plot illustrates that frequency components between 1 and 4 kHz are especially important to intelligibility, with the relative importance peaking around 2 kHz.

Figure 2:
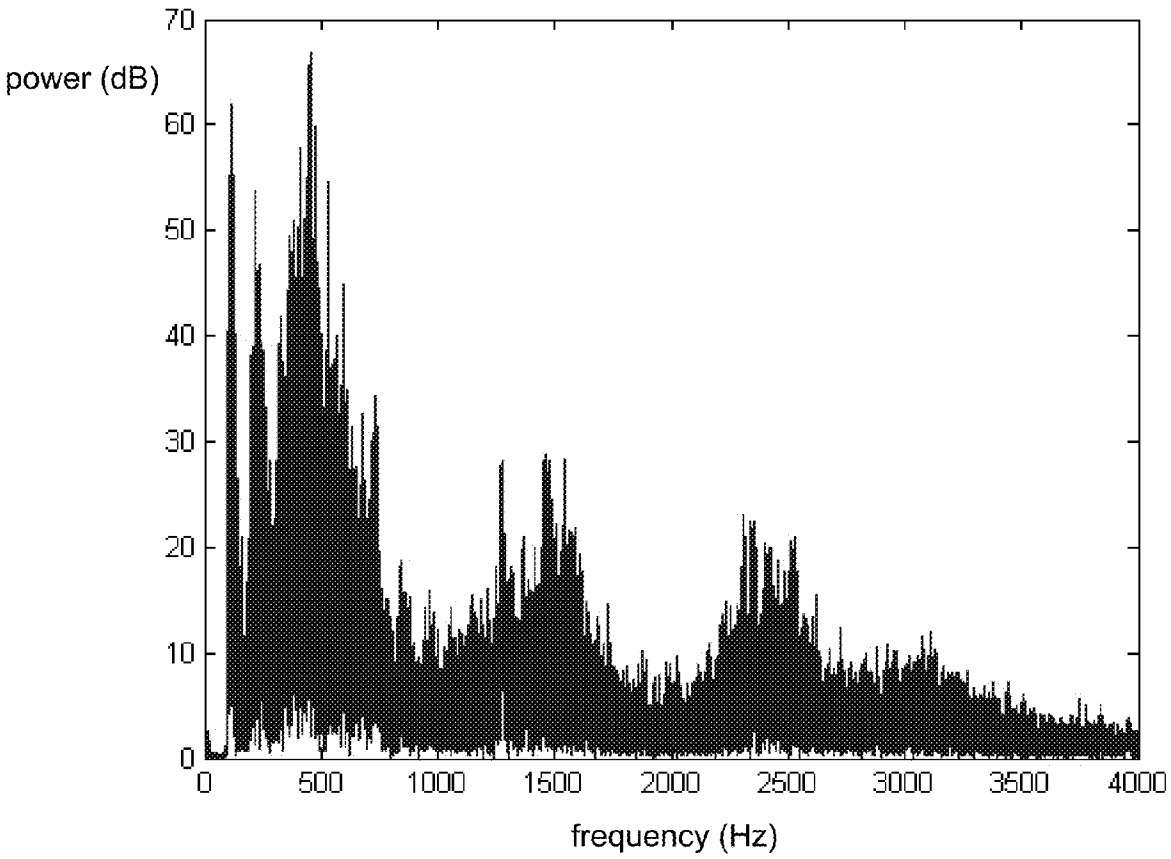
FIG. 2 shows a power spectrum for a reproduced speech signal in a typical narrowband telephony application.

FIG. 2 shows a power spectrum for a reproduced speech signal in a typical narrowband telephony application. This diagram illustrates that the energy of such a signal decreases rapidly as frequency increases above 500 Hz. As shown in FIG. 1, however, frequencies up to 4 kHz may be very important to speech intelligibility. Therefore, artificially boosting energies in frequency bands between 500 and 4000 Hz may be expected to improve intelligibility of a reproduced speech signal in such a telephony application.

As audio frequencies above 4 kHz are not generally as important to intelligibility as the 1 kHz to 4 kHz band, transmitting a narrowband signal over a typical band-limited communications channel is usually sufficient to have an intelligible conversation. However, increased clarity and better communication of personal speech traits may be expected for cases in which the communications channel supports transmission of a wideband signal. In a voice telephony context, the term "narrowband" refers to a frequency range from about 0-500 Hz (e.g., 0, 50, 100, or 200 Hz) to about 3-5 kHz (e.g., 3500, 4000, or 4500 Hz), and the term "wideband" refers to a frequency range from about 0-500 Hz (e.g., 0, 50, 100, or 200 Hz) to about 7-8 kHz (e.g., 7000, 7500, or 8000 Hz).

It may be desirable to increase speech intelligibility by boosting selected portions of a speech signal. In hearing aid applications, for example, dynamic range compression techniques may be used to compensate for a known hearing loss in particular frequency subbands by boosting those subbands in the reproduced audio signal.

The real world abounds from multiple noise sources, including single point noise sources, which often transgress into multiple sounds resulting in reverberation. Background acoustic noise may include numerous noise signals generated by the general environment and interfering signals generated by background conversations of other people, as well as reflections and reverberation generated from each of the signals.

Environmental noise may affect the intelligibility of a reproduced audio signal, such as a far-end speech signal. For applications in which communication occurs in noisy environments, it may be desirable to use a speech processing method to distinguish a speech signal from background noise and enhance its intelligibility. Such processing may be important in many areas of everyday communication, as noise is almost always present in real-world conditions.

Figure 3:
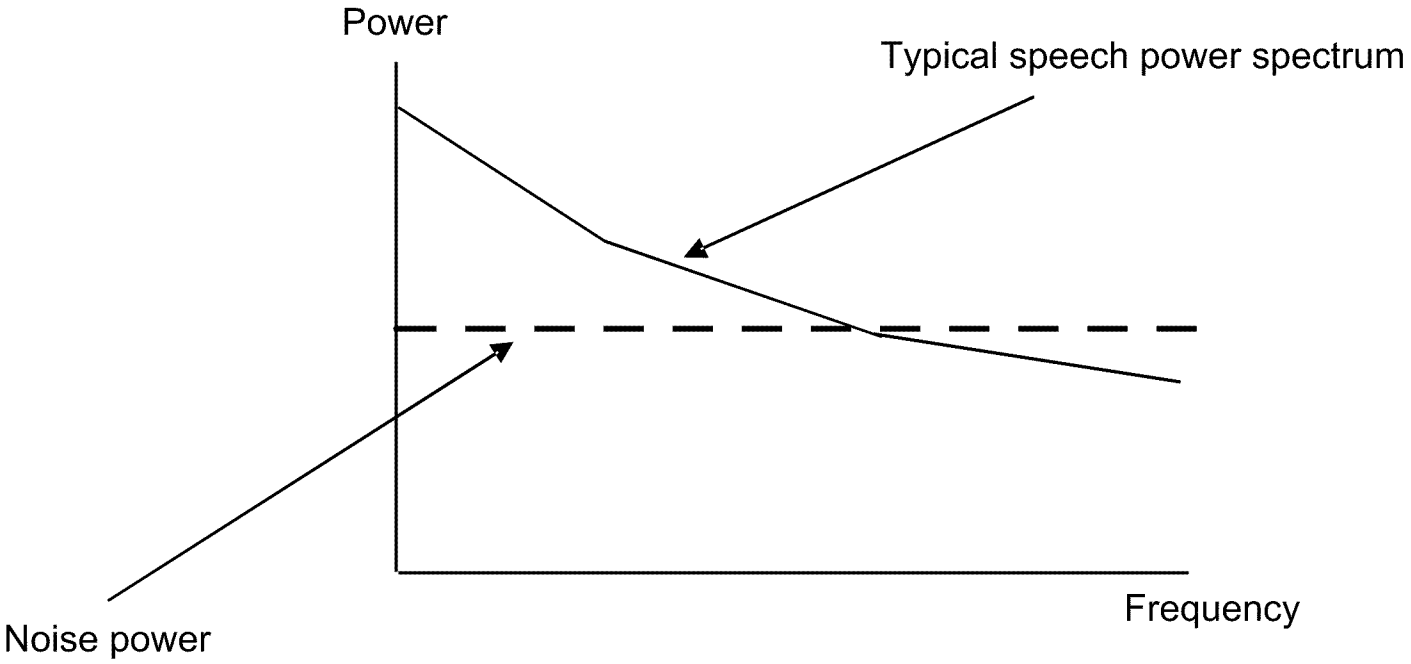
FIG. 3 shows an example of a typical speech power spectrum and a typical noise power spectrum.
Figure 4B:
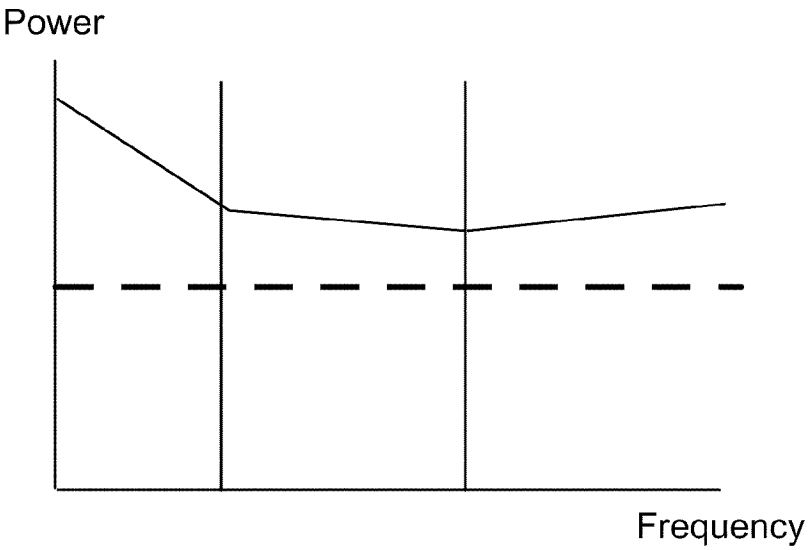
FIG. 4B illustrates an application of subband equalization to the example of FIG. 3.
Figure 4A:
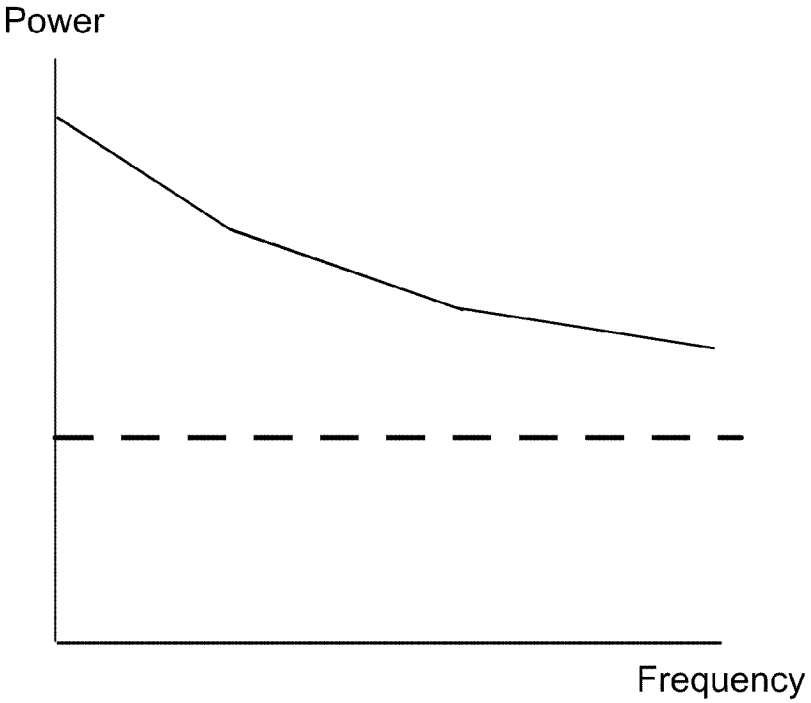
FIG. 4A illustrates an application of automatic volume control to the example of FIG. 3.

Automatic gain control (AGC, also called automatic volume control or AVC) is a processing method that may be used to increase intelligibility of an audio signal being reproduced in a noisy environment. An automatic gain control technique may be used to compress the dynamic range of the signal into a limited amplitude band, thereby boosting segments of the signal that have low power and decreasing energy in segments that have high power. FIG. 3 shows an example of a typical speech power spectrum, in which a natural speech power roll-off causes power to decrease with frequency, and a typical noise power spectrum, in which power is generally constant over at least the range of speech frequencies. In such case, high-frequency components of the speech signal may have less energy than corresponding components of the noise signal, resulting in a masking of the high-frequency speech bands. FIG. 4A illustrates an application of AVC to such an example. An AVC module is typically implemented to boost all frequency bands of the speech signal indiscriminately, as shown in this figure. Such an approach may require a large dynamic range of the amplified signal for a modest boost in high-frequency power.

Background noise typically drowns high frequency speech content much more quickly than low frequency content, since speech power in high frequency bands is usually much smaller than in low frequency bands. Therefore simply boosting the overall volume of the signal will unnecessarily boost low frequency content below 1 kHz which may not significantly contribute to intelligibility. It may be desirable instead to adjust audio frequency subband power to compensate for noise masking effects on a reproduced audio signal. For example, it may be desirable to boost speech power in inverse proportion to the ratio of noise-to-speech subband power, and disproportionally so in high frequency subbands, to compensate for the inherent roll-off of speech power towards high frequencies.

It may be desirable to compensate for low voice power in frequency subbands that are dominated by environmental noise. As shown in FIG. 4B, for example, it may be desirable to act on selected subbands to boost intelligibility by applying different gain boosts to different subbands of the speech signal (e.g., according to speech-to-noise ratio). In contrast to the AVC example shown in FIG. 4A, such equalization may be expected to provide a clearer and more intelligible signal, while avoiding an unnecessary boost of low-frequency components.

In order to selectively boost speech power in such manner, it may be desirable to obtain a reliable and contemporaneous estimate of the environmental noise level. In practical applications, however, it may be difficult to model the environmental noise from a sensed audio signal using traditional single microphone or fixed beamforming type methods. Although FIG. 3 suggests a noise level that is constant with frequency, the environmental noise level in a practical application of a communications device or a media playback device typically varies significantly and rapidly over both time and frequency.

The acoustic noise in a typical environment may include babble noise, airport noise, street noise, voices of competing talkers, and/or sounds from interfering sources (e.g., a TV set or radio). Consequently, such noise is typically nonstationary and may have an average spectrum is close to that of the user's own voice. A noise power reference signal as computed from a single microphone signal is usually only an approximate stationary noise estimate. Moreover, such computation generally entails a noise power estimation delay, such that corresponding adjustments of subband gains can only be performed after a significant delay. It may be desirable to obtain a reliable and contemporaneous estimate of the environmental noise.

Figure 5:
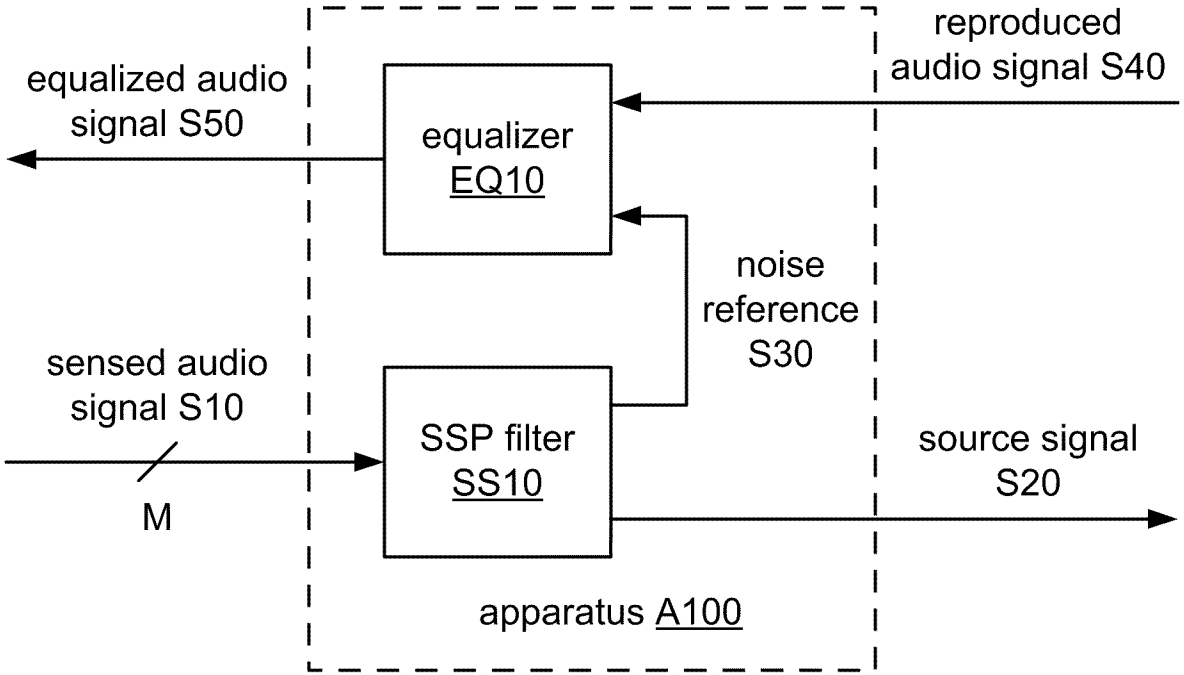
FIG. 5 shows a block diagram of an apparatus A100 according to a general configuration.

FIG. 5 shows a block diagram of an apparatus configured to process audio signals A100 according to a general configuration that includes a spatially selective processing filter SS10 and an equalizer EQ10. Spatially selective processing (SSP) filter SS10 is configured to perform a spatially selective processing operation on an M-channel sensed audio signal S10 (where M is an integer greater than one) to produce a source signal S20 and a noise reference S30. Equalizer EQ10 is configured to dynamically alter the spectral characteristics of a reproduced audio signal S40 based on information from noise reference S30 to produce an equalized audio signal S50. For example, equalizer EQ10 may be configured to use information from noise reference S30 to boost at least one frequency subband of reproduced audio signal S40 relative to at least one other frequency subband of reproduced audio signal S40 to produce equalized audio signal S50.

In a typical application of apparatus A100, each channel of sensed audio signal S10 is based on a signal from a corresponding one of an array of M microphones. Examples of audio reproduction devices that may be implemented to include an implementation of apparatus A100 with such an array of microphones include communications devices and audio or audiovisual playback devices. Examples of such communications devices include, without limitation, telephone handsets (e.g., cellular telephone handsets), wired and/or wireless headsets (e.g., Bluetooth headsets), and hands-free car kits. Examples of such audio or audiovisual playback devices include, without limitation, media players configured to reproduce streaming or prerecorded audio or audiovisual content.

The array of M microphones may be implemented to have two microphones MC10 and MC20 (e.g., a stereo array) or more than two microphones. Each microphone of the array may have a response that is omnidirectional, bidirectional, or unidirectional (e.g., cardioid). The various types of microphones that may be used include (without limitation) piezoelectric microphones, dynamic microphones, and electret microphones.

Figure 6A:
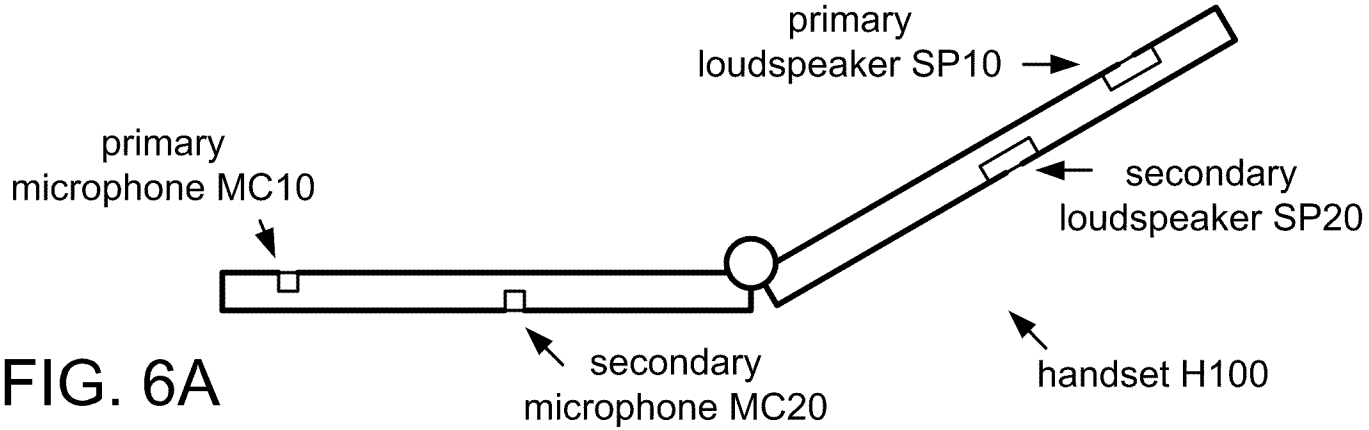
FIG. 6A shows a diagram of a two-microphone handset H100 in a first operating configuration.

Some examples of an audio reproduction device that may be constructed to include an implementation of apparatus A100 are illustrated in FIGS. 6A-10C. FIG. 6A shows a diagram of a two-microphone handset H100 (e.g., a clamshell-type cellular telephone handset) in a first operating configuration. Handset H100 includes a primary microphone MC10 and a secondary microphone MC20. In this example, handset H100 also includes a primary loudspeaker SP10 and a secondary loudspeaker SP20. When handset H100 is in the first operating configuration, primary loudspeaker SP10 is active and secondary loudspeaker SP20 may be disabled or otherwise muted. It may be desirable for primary microphone MC10 and secondary microphone MC20 to both remain active in this configuration to support spatially selective processing techniques for speech enhancement and/or noise reduction.

Figure 6B:
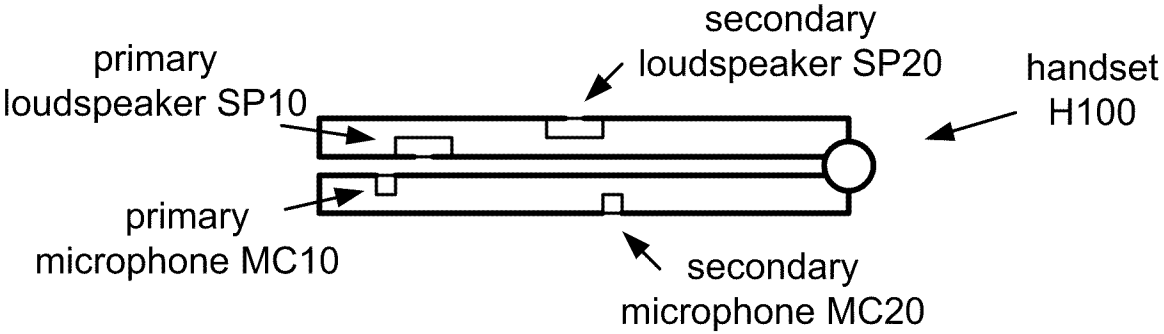
FIG. 6B shows a second operating configuration for handset H100.

FIG. 6B shows a second operating configuration for handset H100. In this configuration, primary microphone MC10 is occluded, secondary loudspeaker SP20 is active, and primary loudspeaker SP10 may be disabled or otherwise muted. Again, it may be desirable for both of primary microphone MC10 and secondary microphone MC20 to remain active in this configuration (e.g., to support spatially selective processing techniques). Handset H100 may include one or more switches or similar actuators whose state (or states) indicate the current operating configuration of the device.

Figure 7A:
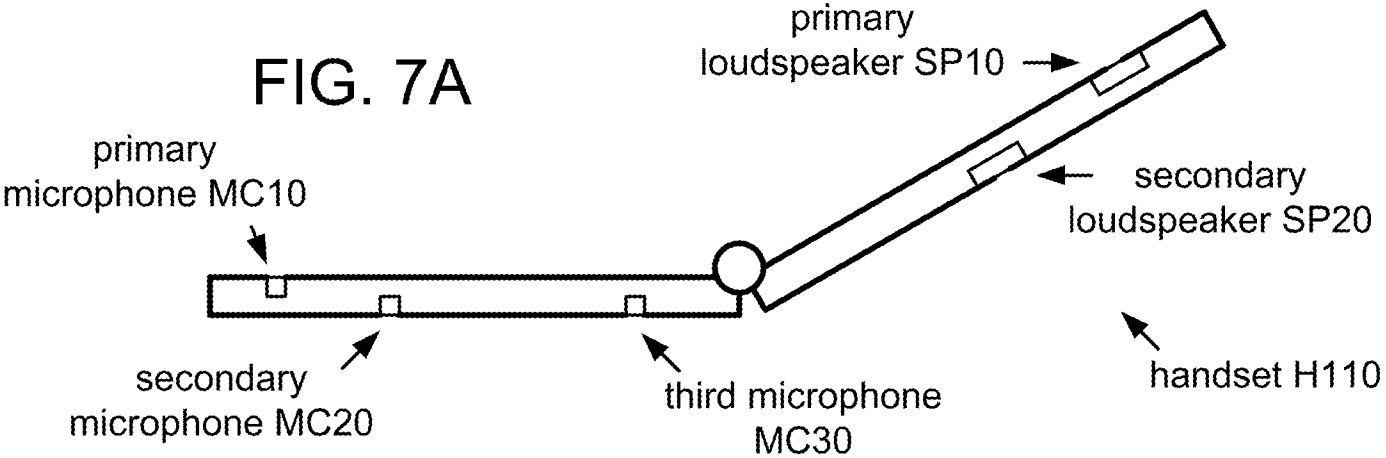
FIG. 7A shows a diagram of an implementation H100 of handset H100 that includes three microphones.
Figure 7B:
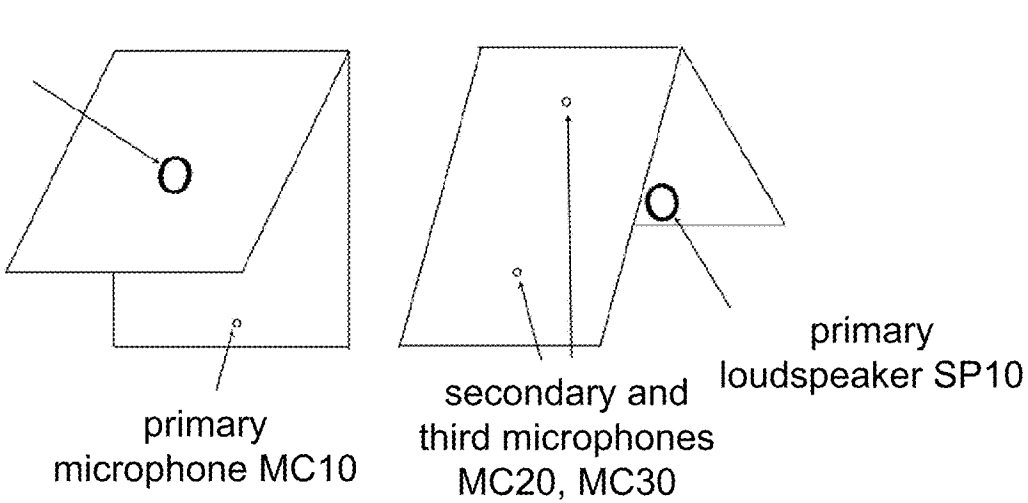
FIG. 7B shows two other views of handset H100.

Apparatus A100 may be configured to receive an instance of sensed audio signal S10 that has more than two channels. For example, FIG. 7A shows a diagram of an implementation H110 of handset H100 that includes a third microphone MC30. FIG. 7B shows two other views of handset H110 that show a placement of the various transducers along an axis of the device.

Figure 8:
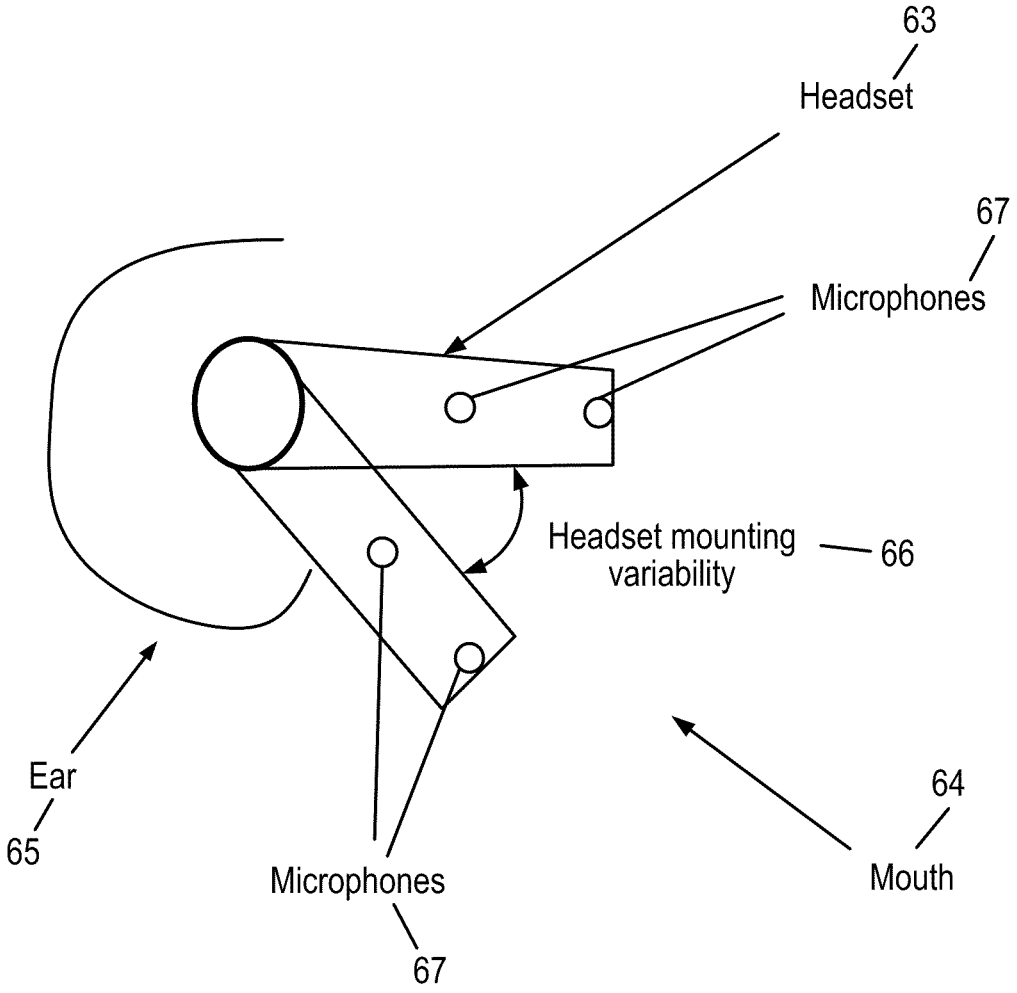
FIG. 8 shows a diagram of a range of different operating configurations of a headset.

An earpiece or other headset having M microphones is another kind of portable communications device that may include an implementation of apparatus A100. Such a headset may be wired or wireless. For example, a wireless headset may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). FIG. 8 shows a diagram of a range 66 of different operating configurations of such a headset 63 as mounted for use on a user's ear 65. Headset 63 includes an array 67 of primary (e.g., endfire) and secondary (e.g., broadside) microphones that may be oriented differently during use with respect to the user's mouth 64. Such a headset also typically includes a loudspeaker (not shown), which may be disposed at an earplug of the headset, for reproducing the far-end signal. In a further example, a handset that includes an implementation of apparatus A100 is configured to receive sensed audio signal S10 from a headset having M microphones, and to output equalized audio signal S50 to the headset, over a wired and/or wireless communications link (e.g., using a version of the Bluetooth™ protocol).

Figure 9:
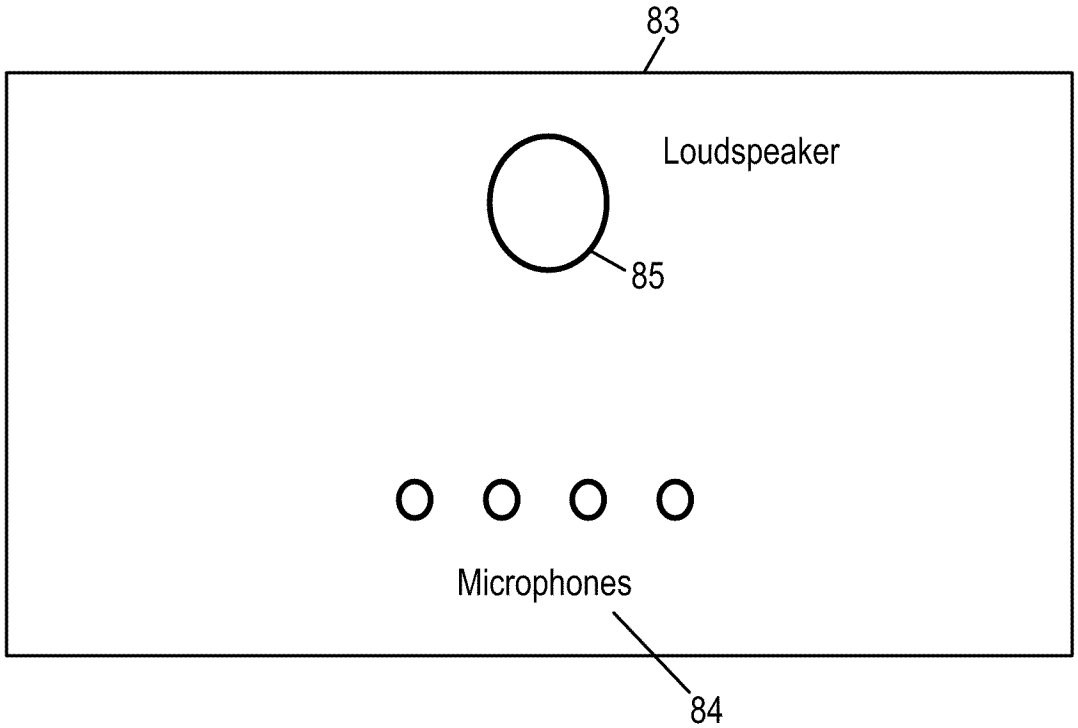
FIG. 9 shows a diagram of a hands-free car kit.

A hands-free car kit having M microphones is another kind of mobile communications device that may include an implementation of apparatus A100. FIG. 9 shows a diagram of an example of such a device 83 in which the M microphones 84 are arranged in a linear array (in this particular example, M is equal to four). The acoustic environment of such a device may include wind noise, rolling noise, and/or engine noise. Other examples of communications devices that may include an implementation of apparatus A100 include communications devices for audio or audiovisual conferencing. A typical use of such a conferencing device may involve multiple desired sound sources (e.g., the mouths of the various participants). In such case, it may be desirable for the array of microphones to include more than two microphones.

Figure 10C:
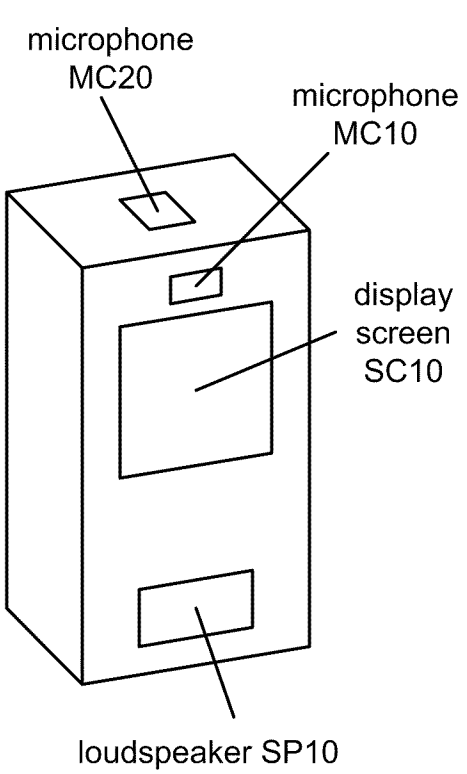
FIGS. 10A-C show examples of media playback devices.
Figure 10B:
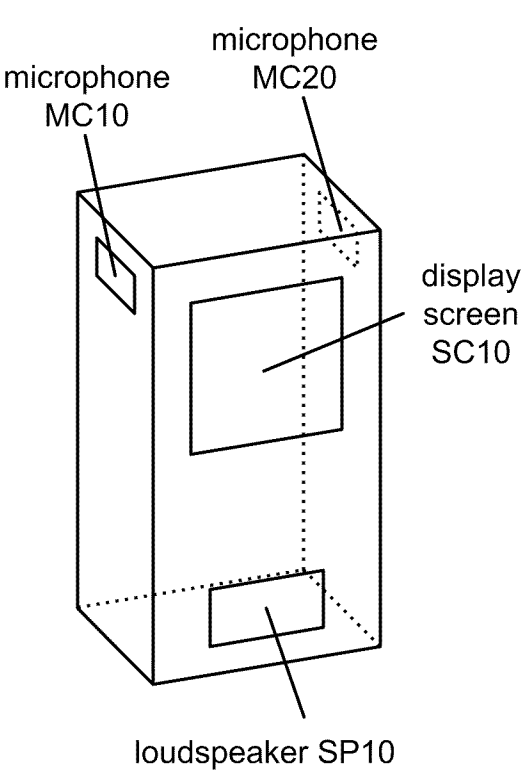
Figure 10A:
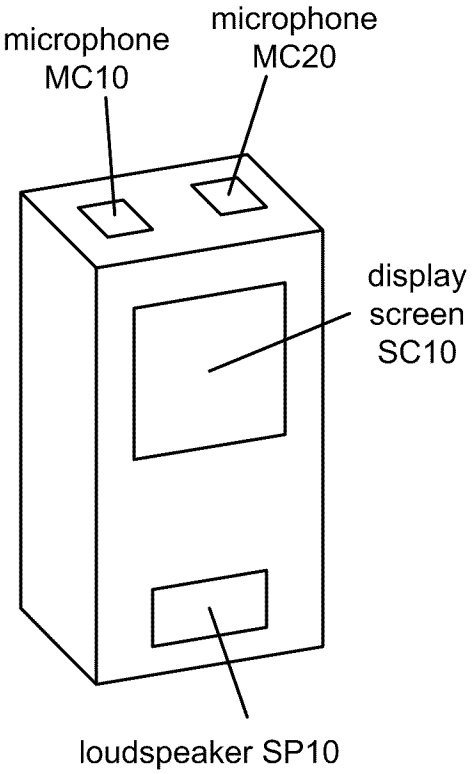

A media playback device having M microphones is a kind of audio or audiovisual playback device that may include an implementation of apparatus A100. Such a device may be configured for playback of compressed audio or audiovisual information, such as a file or stream encoded according to a standard compression format (e.g., Moving Pictures Experts Group (MPEG)-1 Audio Layer 3 (MP3), MPEG-4 Part 14 (MP4), a version of Windows Media Audio/Video (WMA/WMV) (Microsoft Corp., Redmond, Wash.), Advanced Audio Coding (AAC), International Telecommunication Union (ITU)-T H.264, or the like). FIG. 10A shows an example of such a device that includes a display screen SC10 and a loudspeaker SP10 disposed at the front face of the device. In this example, the microphones MC10 and MC20 are disposed at the same face (e.g., on opposite sides of the top face) of the device. FIG. 10B shows an example of such a device in which the microphones are disposed at opposite faces of the device. FIG. 10C shows an example of such a device in which the microphones are disposed at adjacent faces of the device. A media playback device as shown in FIGS. 10A-C may also be designed such that the longer axis is horizontal during an intended use.

Figure 11:
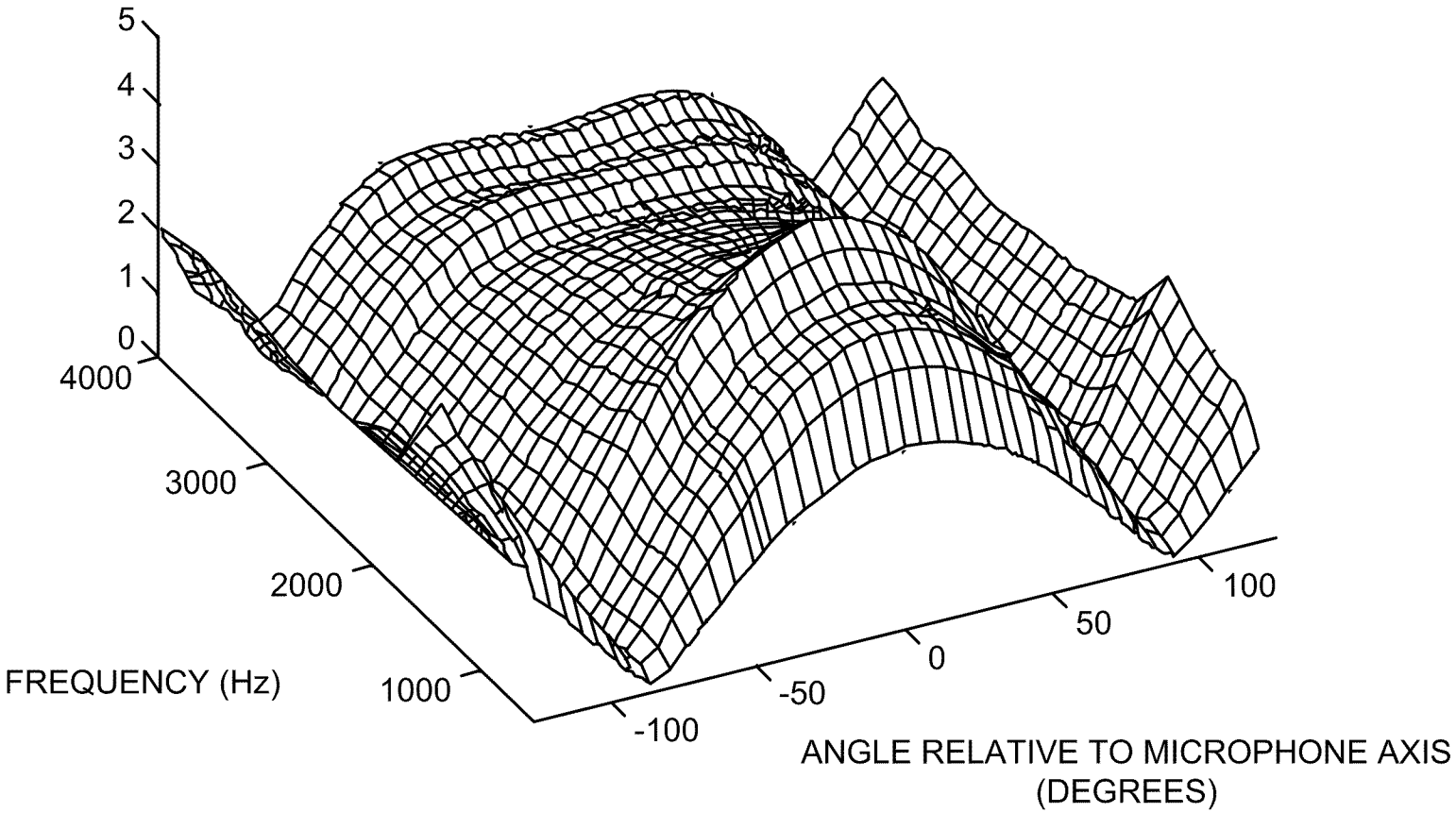
FIG. 11 shows a beam pattern for one example of spatially selective processing (SSP) filter SS10.

Spatially selective processsing filter SS10 is configured to perform a spatially selective processing operation on sensed audio signal S10 to produce a source signal S20 and a noise reference S30. For example, SSP filter SS10 may be configured to separate a directional desired component of sensed audio signal S10 (e.g., the user's voice) from one or more other components of the signal, such as a directional interfering component and/or a diffuse noise component. In such case, SSP filter SS10 may be configured to concentrate energy of the directional desired component so that source signal S20 includes more of the energy of the directional desired component than each channel of sensed audio channel S10 does (that is to say, so that source signal S20 includes more of the energy of the directional desired component than any individual channel of sensed audio channel S10 does). FIG. 11 shows a beam pattern for such an example of SSP filter SS10 that demonstrates the directionality of the filter response with respect to the axis of the microphone array. Spatially selective processing filter SS10 may be used to provide a reliable and contemporaneous estimate of the environmental noise (also called an "instantaneous" noise estimate, due to the reduced delay as compared to a single-microphone noise reduction system).

Figure 12A:
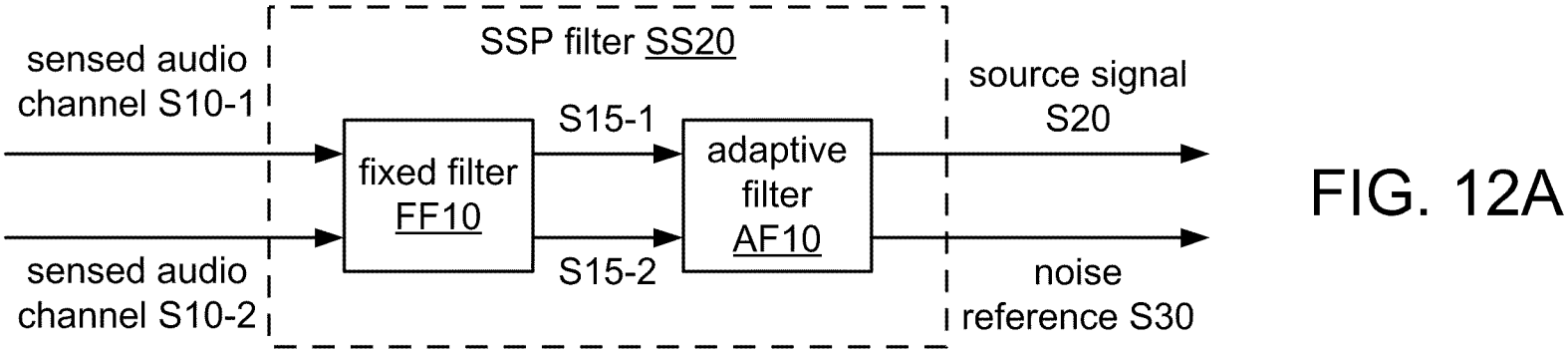
FIG. 12A shows a block diagram of an implementation SS20 of SSP filter SS10.

Spatially selective processing filter SS10 is typically implemented to include a fixed filter FF10 that is characterized by one or more matrices of filter coefficient values. These filter coefficient values may be obtained using a beamforming, blind source separation (BSS), or combined BSS/beamforming method as described in more detail below. Spatially selective processing filter SS10 may also be implemented to include more than one stage. FIG. 12A shows a block diagram of such an implementation SS20 of SSP filter SS10 that includes a fixed filter stage FF10 and an adaptive filter stage AF10. In this example, fixed filter stage FF10 is arranged to filter channels S10-1 and S10-2 of sensed audio signal S10 to produce filtered channels S15-1 and S15-2, and adaptive filter stage AF10 is arranged to filter the channels S15-1 and S15-2 to produce source signal S20 and noise reference S30. In such case, it may be desirable to use fixed filter stage FF10 to generate initial conditions for adaptive filter stage AF10, as described in more detail below. It may also be desirable to perform adaptive scaling of the inputs to SSP filter SS10 (e.g., to ensure stability of an IIR fixed or adaptive filter bank).

It may be desirable to implement SSP filter SS10 to include multiple fixed filter stages, arranged such that an appropriate one of the fixed filter stages may be selected during operation (e.g., according to the relative separation performance of the various fixed filter stages). Such a structure is disclosed in, for example, U.S. patent application Ser. No. 12/334,246, filed Dec. 12, 2008, entitled "SYSTEMS, METHODS, AND APPARATUS FOR MULTI-MICROPHONE BASED SPEECH ENHANCEMENT."

Figure 12B:
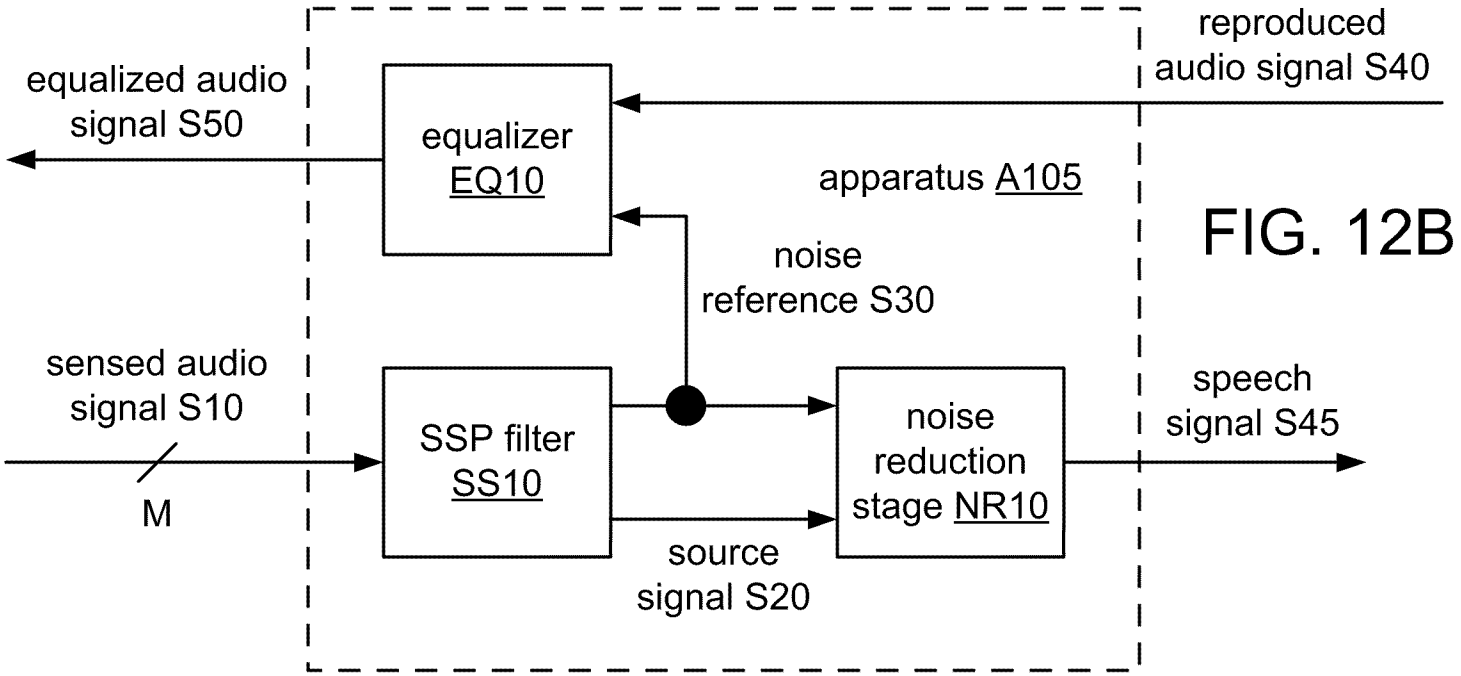
FIG. 12B shows a block diagram of an implementation A105 of apparatus A100.

It may be desirable to follow SSP filter SS10 or SS20 with a noise reduction stage that is configured to apply noise reference S30 to further reduce noise in source signal S20. FIG. 12B shows a block diagram of an implementation A105 of apparatus A100 that includes such a noise reduction stage NR10. Noise reduction stage NR10 may be implemented as a Wiener filter whose filter coefficient values are based on signal and noise power information from source signal S20 and noise reference S30. In such case, noise reduction stage NR10 may be configured to estimate the noise spectrum based on information from noise reference S30. Alternatively, noise reduction stage NR10 may be implemented to perform a spectral subtraction operation on source signal S20, based on a spectrum from noise reference S30. Alternatively, noise reduction stage NR10 may be implemented as a Kalman filter, with noise covariance being based on information from noise reference S30.

Figure 12C:
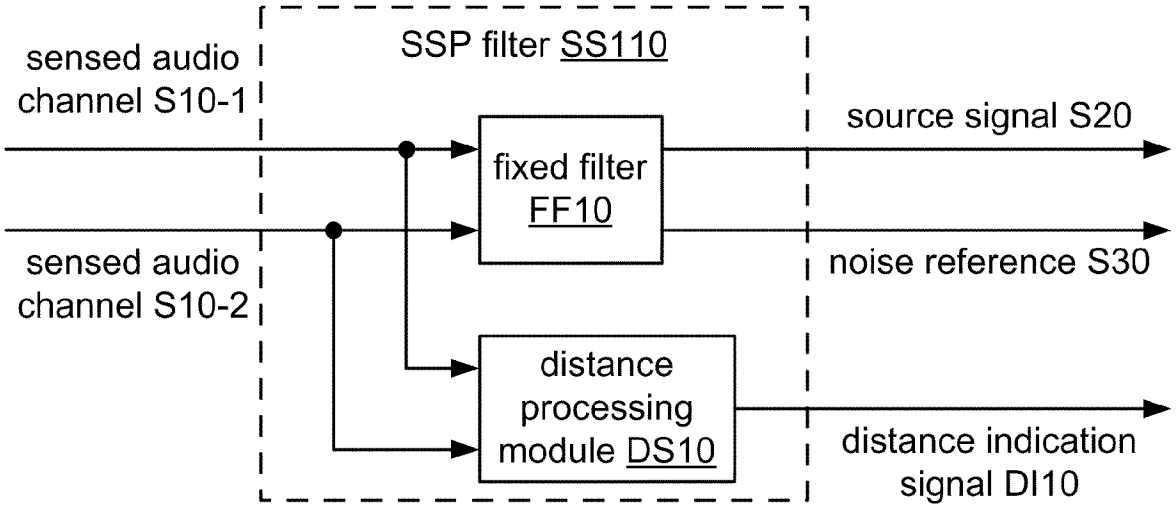
FIG. 12C shows a block diagram of an implementation SS110 of SSP filter SS10.
Figure 12D:
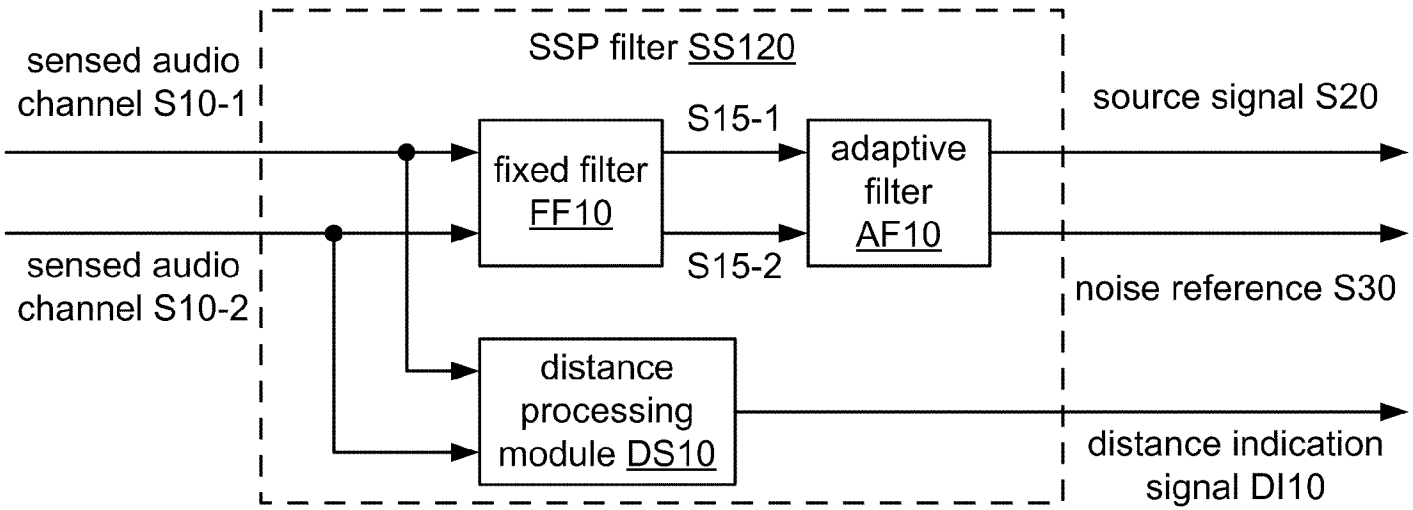
FIG. 12D shows a block diagram of an implementation SS120 of SSP filter SS20 and SS110.

In the alternative to being configured to perform a directional processing operation, or in addition to being configured to perform a directional processing operation, SSP filter SS10 may be configured to perform a distance processing operation. FIGS. 12C and 12D show block diagrams of implementations SS110 and SS120 of SSP filter SS10, respectively, that include a distance processing module DS10 configured to perform such an operation. Distance processing module DS10 is configured to produce, as a result of the distance processing operation, a distance indication signal DI10 that indicates the distance of the source of a component of multichannel sensed audio signal S10 relative to the microphone array. Distance processing module DS10 is typically configured to produce distance indication signal DI10 as a binary-valued indication signal whose two states indicate a near-field source and a far-field source, respectively, but configurations that produce a continuous and/or multi-valued signal are also possible.

In one example, distance processing module DS10 is configured such that the state of distance indication signal DI10 is based on a degree of similarity between the power gradients of the microphone signals. Such an implementation of distance processing module DS10 may be configured to produce distance indication signal DI10 according to a relation between (A) a difference between the power gradients of the microphone signals and (B) a threshold value. One such relation may be expressed as $$\theta = \begin{cases} 0, & \nabla_p - \nabla_s > T_d \\ 1, & \text{otherwise} \end{cases},$$

where θ denotes the current state of distance indication signal DI10, $\nabla_p$ denotes a current value of a power gradient of a primary microphone signal (e.g., microphone signal DM10-1), $\nabla_s$ denotes a current value of a power gradient of a secondary microphone signal (e.g., microphone signal DM10-

2), and $T_d$ denotes a threshold value, which may be fixed or adaptive (e.g., based on a current level of one or more of the microphone signals). In this particular example, state 1 of distance indication signal DI10 indicates a far-field source and state 0 indicates a near-field source, although of course a converse implementation (i.e., such that state 1 indicates a near-field source and state 0 indicates a far-field source) may be used if desired.

It may be desirable to implement distance processing module DS10 to calculate the value of a power gradient as a difference between the energies of the corresponding microphone signal over successive frames. In one such example, distance processing module DS10 is configured to calculate the current values for each of the power gradients $\nabla_p$ and $\nabla_s$ as a difference between a sum of the squares of the values of the current frame of the corresponding microphone signal and a sum of the squares of the values of the previous frame of the microphone signal. In another such example, distance processing module DS10 is configured to calculate the current values for each of the power gradients $\nabla_p$ and $\nabla_s$ as a difference between a sum of the magnitudes of the values of the current frame of the corresponding microphone signal and a sum of the magnitudes of the values of the previous frame of the microphone signal.

Additionally or in the alternative, distance processing module DS10 may be configured such that the state of distance indication signal DI10 is based on a degree of correlation, over a range of frequencies, between the phase for a primary microphone signal and the phase for a secondary microphone signal. Such an implementation of distance processing module DS10 may be configured to produce distance indication signal DI10 according to a relation between (A) a correlation between phase vectors of the microphone signals and (B) a threshold value. One such relation may be expressed as $$\mu = \begin{cases} 0, & corr(\varphi_p, \varphi_s) > T_c \\ 1, & \text{otherwise} \end{cases},$$

where μ denotes the current state of distance indication signal DI10, $\phi_p$ denotes a current phase vector for a primary microphone signal (e.g., microphone signal DM10-1), $\phi_s$ denotes a current phase vector for a secondary microphone signal (e.g., microphone signal DM10-2), and $T_c$ denotes a threshold value, which may be fixed or adaptive (e.g., based on a current level of one or more of the microphone signals). It may be desirable to implement distance processing module DS10 to calculate the phase vectors such that each element of a phase vector represents a current phase of the corresponding microphone signal at a corresponding frequency or over a corresponding frequency subband. In this particular example, state 1 of distance indication signal DI10 indicates a far-field source and state 0 indicates a near-field source, although of course a converse implementation may be used if desired.

It may be desirable to configure distance processing module DS10 such that the state of distance indication signal DI10 is based on both of the power gradient and phase correlation criteria as disclosed above. In such case, distance processing module DS10 may be configured to calculate the state of distance indication signal DI10 as a combination of the current values of θ and μ (e.g., logical OR or logical AND). Alternatively, distance processing module DS10 may be configured to calculate the state of distance indication signal DI10 according to one of these criteria (i.e., power gradient similarity or phase correlation), such that the value of the corresponding threshold is based on the current value of the other criterion.

As noted above, it may be desirable to obtain sensed audio signal S10 by performing one or more preprocessing operations on two or more microphone signals. The microphone signals are typically sampled, may be pre-processed (e.g., filtered for echo cancellation, noise reduction, spectrum shaping, etc.), and may even be pre-separated (e.g., by another SSP filter or adaptive filter as described herein) to obtain sensed audio signal S10. For acoustic applications such as speech, typical sampling rates range from 8 kHz to 16 kHz.

Figure 13:
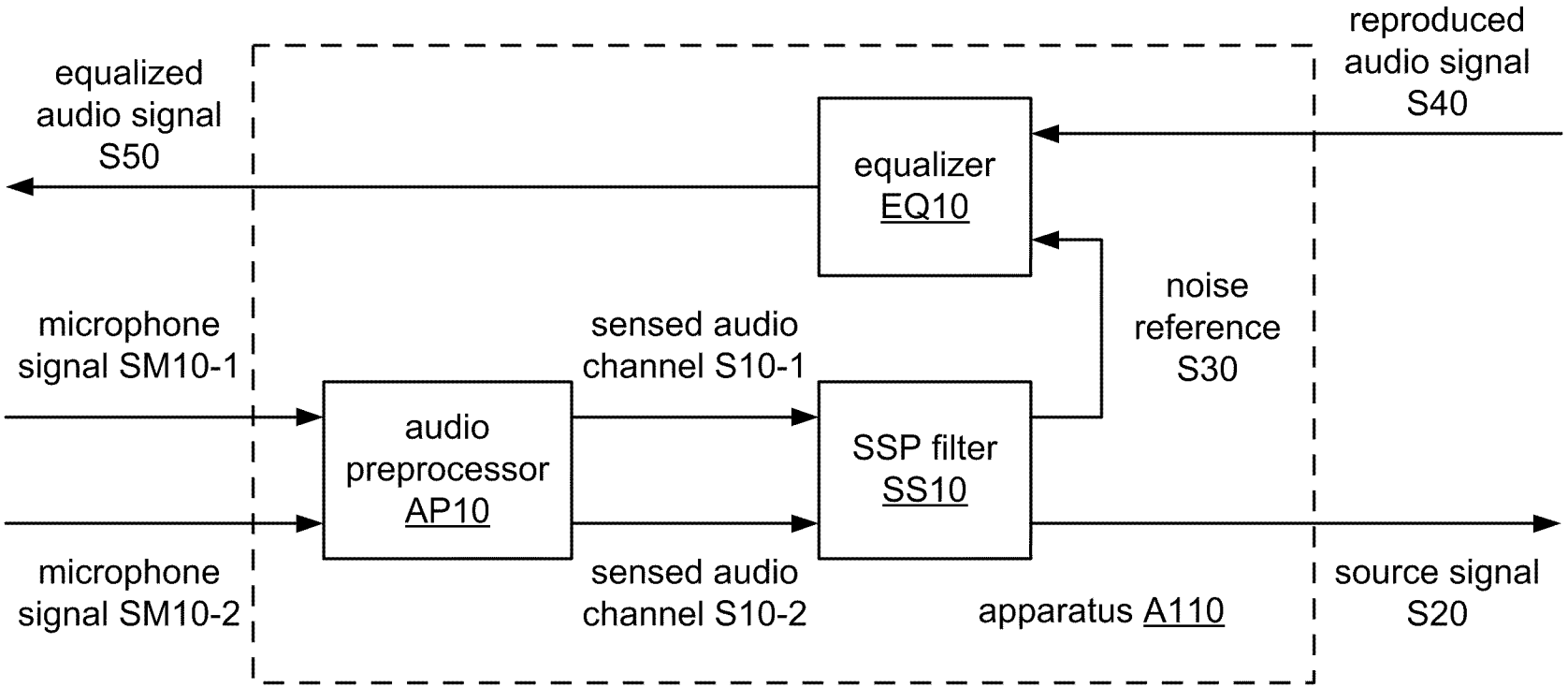
FIG. 13 shows a block diagram of an implementation A110 of apparatus A100.

FIG. 13 shows a block diagram of an implementation A110 of apparatus A100 that includes an audio preprocessor AP10 configured to digitize M analog microphone signals SM10-1 to SM10-M to produce M channels S10-1 to S10-M of sensed audio signal S10. In this particular example, audio preprocessor AP10 is configured to digitize a pair of analog microphone signals SM10-1, SM10-2 to produce a pair of channels S10-1, S10-2 of sensed audio signal S10. Audio preprocessor AP10 may also be configured to perform other preprocessing operations on the microphone signals in the analog and/or digital domains, such as spectral shaping and/or echo cancellation. For example, audio preprocessor AP10 may be configured to apply one or more gain factors to each of one or more of the microphone signals, in either of the analog and digital domains. The values of these gain factors may be selected or otherwise calculated such that the microphones are matched to one another in terms of frequency response and/or gain. Calibration procedures that may be performed to evaluate these gain factors are described in more detail below.

Figure 14:
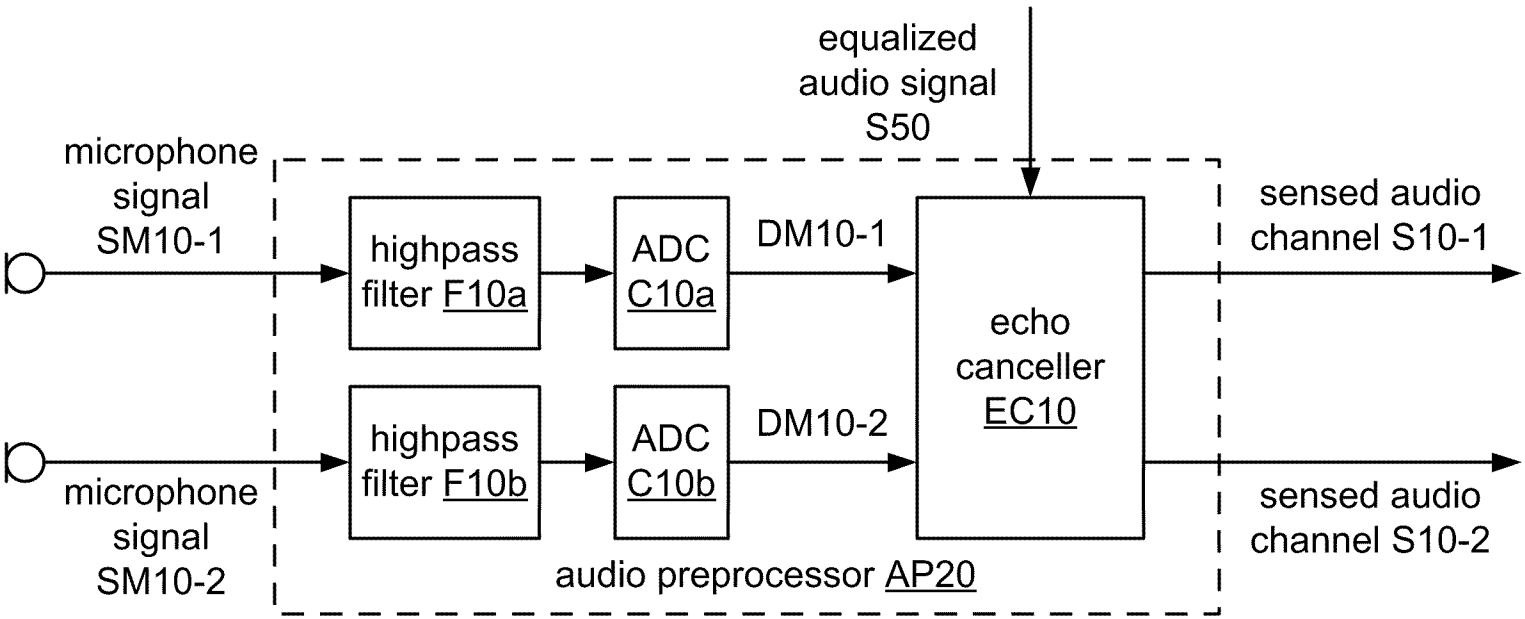
FIG. 14 shows a block diagram of an implementation AP20 of audio preprocessor AP10.

FIG. 14 shows a block diagram of an implementation AP20 of audio preprocessor AP10 that includes first and second analog-to-digital converters (ADCs) C10*a* and C10*b*. First ADC C10*a* is configured to digitize microphone signal SM10-1 to obtain microphone signal DM10-1, and second ADC C10*b* is configured to digitize microphone signal SM10-2 to obtain microphone signal DM10-2. Typical sampling rates that may be applied by ADCs C10*a* and C10*b* include 8 kHz and 16 kHz. In this example, audio preprocessor AP20 also includes a pair of highpass filters F10*a* and F10*b* that are configured to perform analog spectral shaping operations on microphone signals SM10-1 and SM10-2, respectively.

Audio preprocessor AP20 also includes an echo canceller EC10 that is configured to cancel echoes from the microphone signals, based on information from equalized audio signal S50. Echo canceller EC10 may be arranged to receive equalized audio signal S50 from a time-domain buffer. In one such example, the time-domain buffer has a length of ten milliseconds (e.g., eighty samples at a sampling rate of eight kHz, or 160 samples at a sampling rate of sixteen kHz). During operation of a communications device that includes apparatus A110 in certain modes, such as a speakerphone mode and/or a push-to-talk (PTT) mode, it may be desirable to suspend the echo cancellation operation (e.g., to configure echo canceller EC10 to pass the microphone signals unchanged).

Figure 15A:
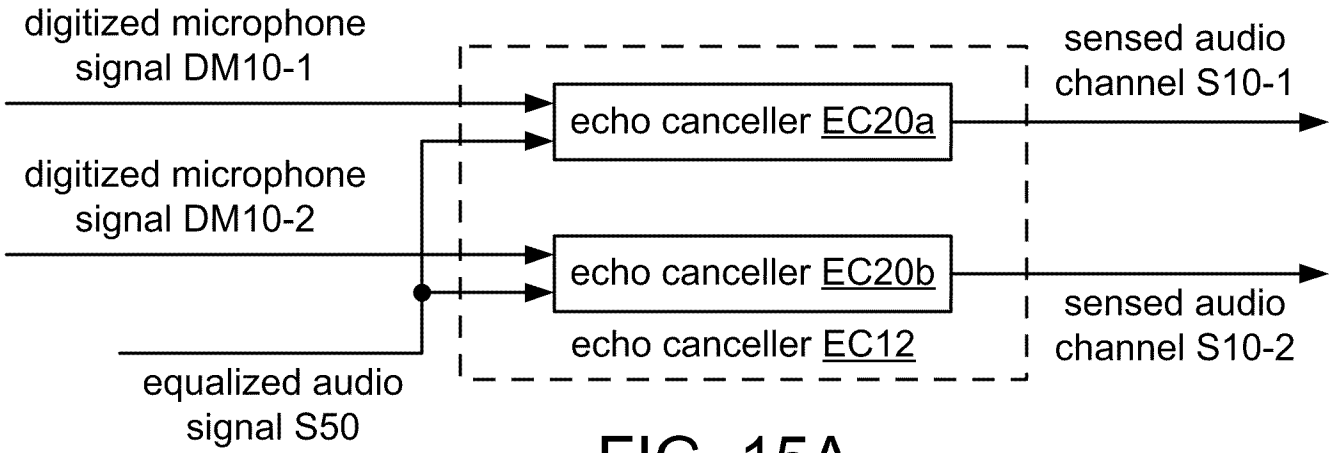
FIG. 15A shows a block diagram of an implementation EC12 of echo canceller EC10.

FIG. 15A shows a block diagram of an implementation EC12 of echo canceller EC10 that includes two instances EC20*a* and EC20*b* of a single-channel echo canceller. In this example, each instance of the single-channel echo canceller is configured to process a corresponding one of microphone signals DM10-1, DM10-2 to produce a corresponding channel S10-1, S10-2 of sensed audio signal S10. The various instances of the single-channel echo canceller may each be configured according to any technique of echo cancellation (for example, a least mean squares technique and/or an adaptive correlation technique) that is currently known or is yet to be developed. For example, echo cancellation is discussed at paragraphs [00139]-[00141] of U.S. patent application Ser. No. 12/197,924 referenced above (beginning with "An apparatus" and ending with "B500"), which paragraphs are hereby incorporated by reference for purposes limited to disclosure of echo cancellation issues, including but not limited to design, implementation, and/or integration with other elements of an apparatus.

Figure 15B:
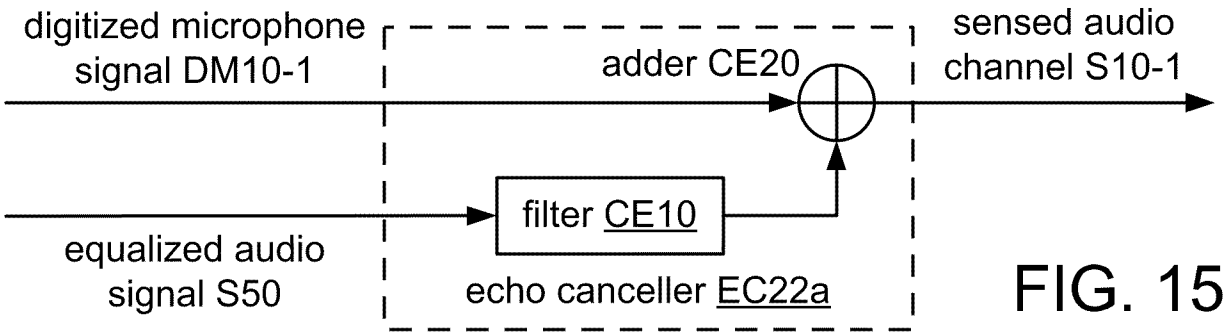
FIG. 15B shows a block diagram of an implementation EC22*a* of echo canceller EC20*a*.

FIG. 15B shows a block diagram of an implementation EC22*a* of echo canceller EC20*a* that includes a filter CE10 arranged to filter equalized audio signal S50 and an adder CE20 arranged to combine the filtered signal with the microphone signal being processed. The filter coefficient values of filter CE10 may be fixed. Alternatively, at least one (and possibly all) of the filter coefficient values of filter CE10 may be adapted during operation of apparatus A110. As described in more detail below, it may be desirable to train a reference instance of filter CE10 using a set of multichannel signals that are recorded by a reference instance of a communications device as it reproduces an audio signal.

Echo canceller EC20*b* may be implemented as another instance of echo canceller EC22*a* that is configured to process microphone signal DM10-2 to produce sensed audio channel S40-2. Alternatively, echo cancellers EC20*a* and EC20*b* may be implemented as the same instance of a single-channel echo canceller (e.g., echo canceller EC22*a*) that is configured to process each of the respective microphone signals at different times.

An implementation of apparatus A100 may be included within a transceiver (e.g., a cellular telephone or wireless headset). FIG. 16A shows a block diagram of such a communications device D100 that includes an instance of apparatus A110. Device D100 includes a receiver R10 coupled to apparatus A110 that is configured to receive a radio-frequency (RF) communications signal and to decode and reproduce an audio signal encoded within the RF signal as audio input signal S100, which is received by apparatus A110 in this example as reproduced audio signal S40. Device D100 also includes a transmitter X10 coupled to apparatus A110 that is configured to encode source signal S20 and to transmit an RF communications signal that describes the encoded audio signal. Device D110 also includes an audio output stage O10 that is configured to process equalized audio signal S50 (e.g., to convert equalized audio signal S50 to an analog signal) and to output the processed audio signal to loudspeaker SP10. In this example, audio output stage O10 is configured to control the volume of the processed audio signal according to a level of volume control signal VS10, which level may vary under user control.

It may be desirable for an implementation of apparatus A110 to reside within a communications device such that other elements of the device (e.g., a baseband portion of a mobile station modem (MSM) chip or chipset) are arranged to perform further audio processing operations on sensed audio signal S10. In designing an echo canceller to be included in an implementation of apparatus A110 (e.g., echo canceller EC10), it may be desirable to take into account possible synergistic effects between this echo canceller and any other echo canceller of the communications device (e.g., an echo cancellation module of the MSM chip or chipset).

FIG. 16B shows a block diagram of an implementation D200 of communications device D100. Device D200 includes a chip or chipset CS10 (e.g., an MSM chipset) that includes elements of receiver R10 and transmitter X10 and may include one or more processors. Device D200 is configured to receive and transmit the RF communications signals via an antenna C30. Device D200 may also include a diplexer and one or more power amplifiers in the path to antenna C30. Chip/chipset CS10 is also configured to receive user input via keypad C10 and to display information via display C20. In this example, device D200 also includes one or more antennas C40 to support Global Positioning System (GPS) location services and/or short-range communications with an external device such as a wireless (e.g., Bluetooth™) headset. In another example, such a communications device is itself a Bluetooth headset and lacks keypad C10, display C20, and antenna C30.

Equalizer EQ10 may be arranged to receive noise reference S30 from a time-domain buffer. Alternatively or additionally, equalizer EQ10 may be arranged to receive reproduced audio signal S40 from a time-domain buffer. In one example, each time-domain buffer has a length of ten milliseconds (e.g., eighty samples at a sampling rate of eight kHz, or 160 samples at a sampling rate of sixteen kHz).

Figure 17:
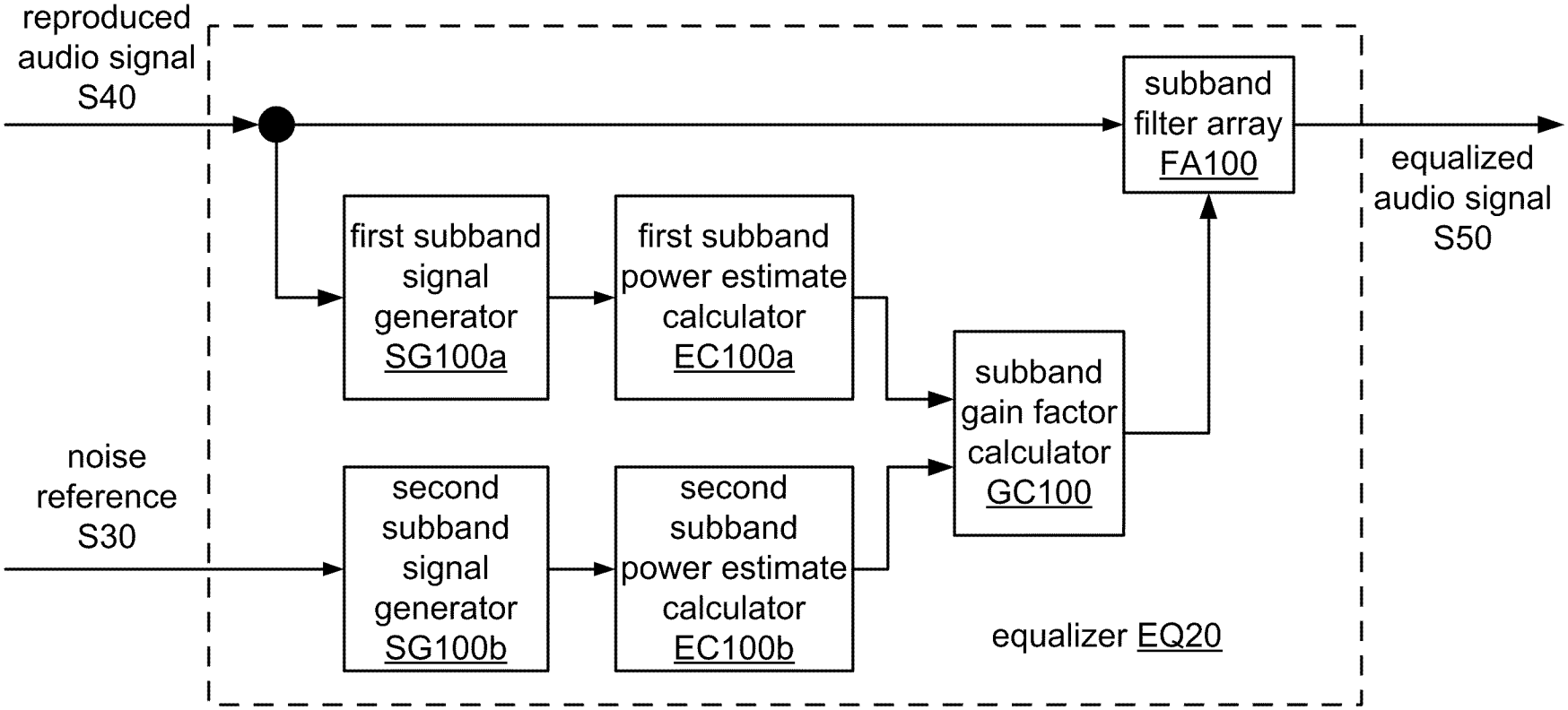
FIG. 17 shows a block diagram of an implementation EQ20 of equalizer EQ10.

FIG. 17 shows a block diagram of an implementation EQ20 of equalizer EQ10 that includes a first subband signal generator SG100*a* and a second subband signal generator SG100*b*. First subband signal generator SG100*a* is configured to produce a set of first subband signals based on information from reproduced audio signal S40, and second subband signal generator SG100*b* is configured to produce a set of second subband signals based on information from noise reference S30. Equalizer EQ20 also includes a first subband power estimate calculator EC100*a* and a second subband power estimate calculator EC100*a*. First subband power estimate calculator EC100*a* is configured to produce a set of first subband power estimates, each based on information from a corresponding one of the first subband signals, and second subband power estimate calculator EC100*b* is configured to produce a set of second subband power estimates, each based on information from a corresponding one of the second subband signals. Equalizer EQ20 also includes a subband gain factor calculator GC100 that is configured to calculate a gain factor for each of the subbands, based on a relation between a corresponding first subband power estimate and a corresponding second subband power estimate, and a subband filter array FA100 that is configured to filter reproduced audio signal S40 according to the subband gain factors to produce equalized audio signal S50.

It is explicitly reiterated that in applying equalizer EQ20 (and any of the other implementations of equalizer EQ10 or EQ20 as disclosed herein), it may be desirable to obtain noise reference S30 from microphone signals that have undergone an echo cancellation operation (e.g., as described above with reference to audio preprocessor AP20 and echo canceller EC10). If acoustic echo remains in noise reference S30 (or in any of the other noise references that may be used by further implementations of equalizer EQ10 as disclosed below), then a positive feedback loop may be created between equalized audio signal S50 and the subband gain factor computation path, such that the louder equalized audio signal S50 drives a far-end loudspeaker, the more that equalizer EQ10 will tend to increase the subband gain factors.

Figure 18A:
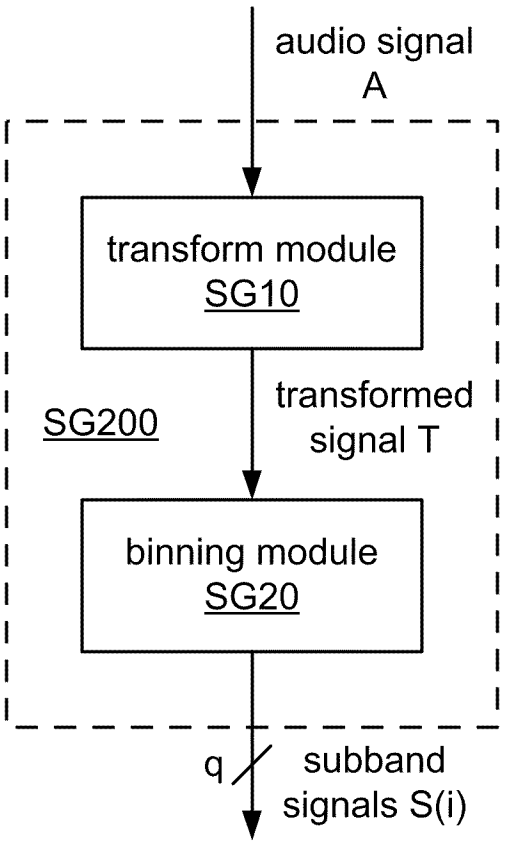
FIG. 18A shows a block diagram of a subband signal generator SG200.

Either or both of first subband signal generator SG100*a* and second subband signal generator SG100*b* may be implemented as an instance of a subband signal generator SG200 as shown in FIG. 18A. Subband signal generator SG200 is configured to produce a set of q subband signals S(i) based on information from an audio signal A (i.e., reproduced audio signal S40 or noise reference S30 as appropriate), where $1 \leqq i \leqq q$ and q is the desired number of subbands. Subband signal generator SG200 includes a transform module SG10 that is configured to perform a transform operation on the time-domain audio signal A to produce a transformed signal T. Transform module SG10 may be configured to perform a frequency domain transform operation on audio signal A (e.g., via a fast Fourier transform or FFT) to produce a frequency-domain transformed signal. Other implementations of transform module SG10 may be configured to perform a different transform operation on audio signal A, such as a wavelet transform operation or a discrete cosine transform (DCT) operation. The transform operation may be performed according to a desired uniform resolution (for example, a 32-, 64-, 128-, 256-, or 512-point FFT operation).

Figure 19:
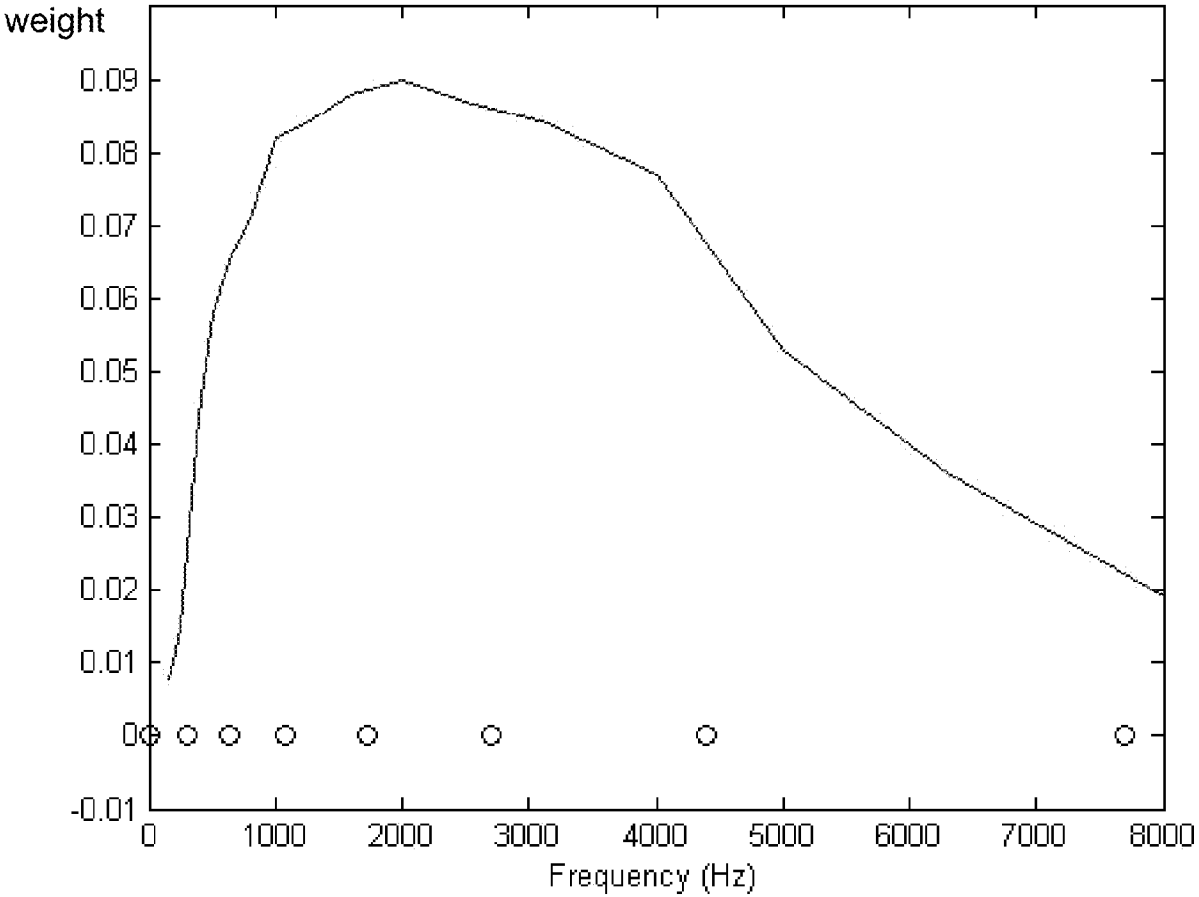
FIG. 19 includes a row of dots that indicate edges of a set of seven Bark scale subbands.

Subband signal generator SG200 also includes a binning module SG20 that is configured to produce the set of subband signals S(i) as a set of q bins by dividing transformed signal T into the set of bins according to a desired subband division scheme. Binning module SG20 may be configured to apply a uniform subband division scheme. In a uniform subband division scheme, each bin has substantially the same width (e.g., within about ten percent). Alternatively, it may be desirable for binning module SG20 to apply a subband division scheme that is nonuniform, as psychoacoustic studies have demonstrated that human hearing works on a nonuniform resolution in the frequency domain. Examples of nonuniform subband division schemes include transcendental schemes, such as a scheme based on the Bark scale, or logarithmic schemes, such as a scheme based on the Mel scale. The row of dots in FIG. 19 indicates edges of a set of seven Bark scale subbands, corresponding to the frequencies 20, 300, 630, 1080, 1720, 2700, 4400, and 7700 Hz. Such an arrangement of subbands may be used in a wideband speech processing system that has a sampling rate of 16 kHz. In other examples of such a division scheme, the lower subband is omitted to obtain a six-subband arrangement and/or the high-frequency limit is increased from 7700 Hz to 8000 Hz. Binning module SG20 is typically implemented to divide transformed signal T into a set of nonoverlapping bins, although binning module SG20 may also be implemented such that one or more (possibly all) of the bins overlaps at least one neighboring bin.

Figure 18B:
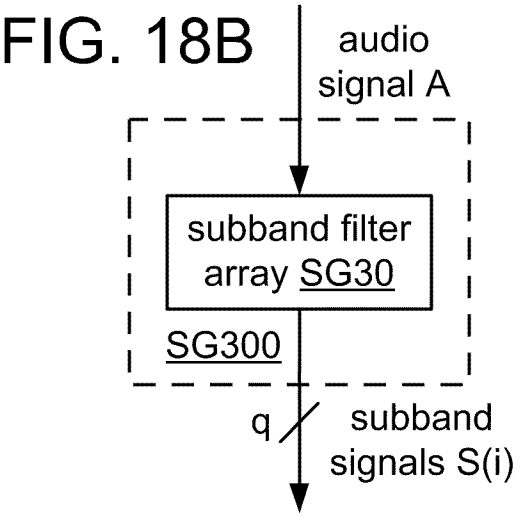
FIG. 18B shows a block diagram of a subband signal generator SG300.

Alternatively or additionally, either or both of first subband signal generator SG100*a* and second subband signal generator SG100*b* may be implemented as an instance of a subband signal generator SG300 as shown in FIG. 18B. Subband signal generator SG300 is configured to produce a set of q subband signals S(i) based on information from audio signal A (i.e., reproduced audio signal S40 or noise reference S30 as appropriate), where $1 \leqq i \leqq q$ and q is the desired number of subbands. In this case, subband signal generator SG300 includes a subband filter array SG30 that is configured to produce each of the subband signals S(1) to S(q) by changing the gain of the corresponding subband of audio signal A relative to the other subbands of audio signal A (i.e., by boosting the passband and/or attenuating the stopband).

Figure 20:
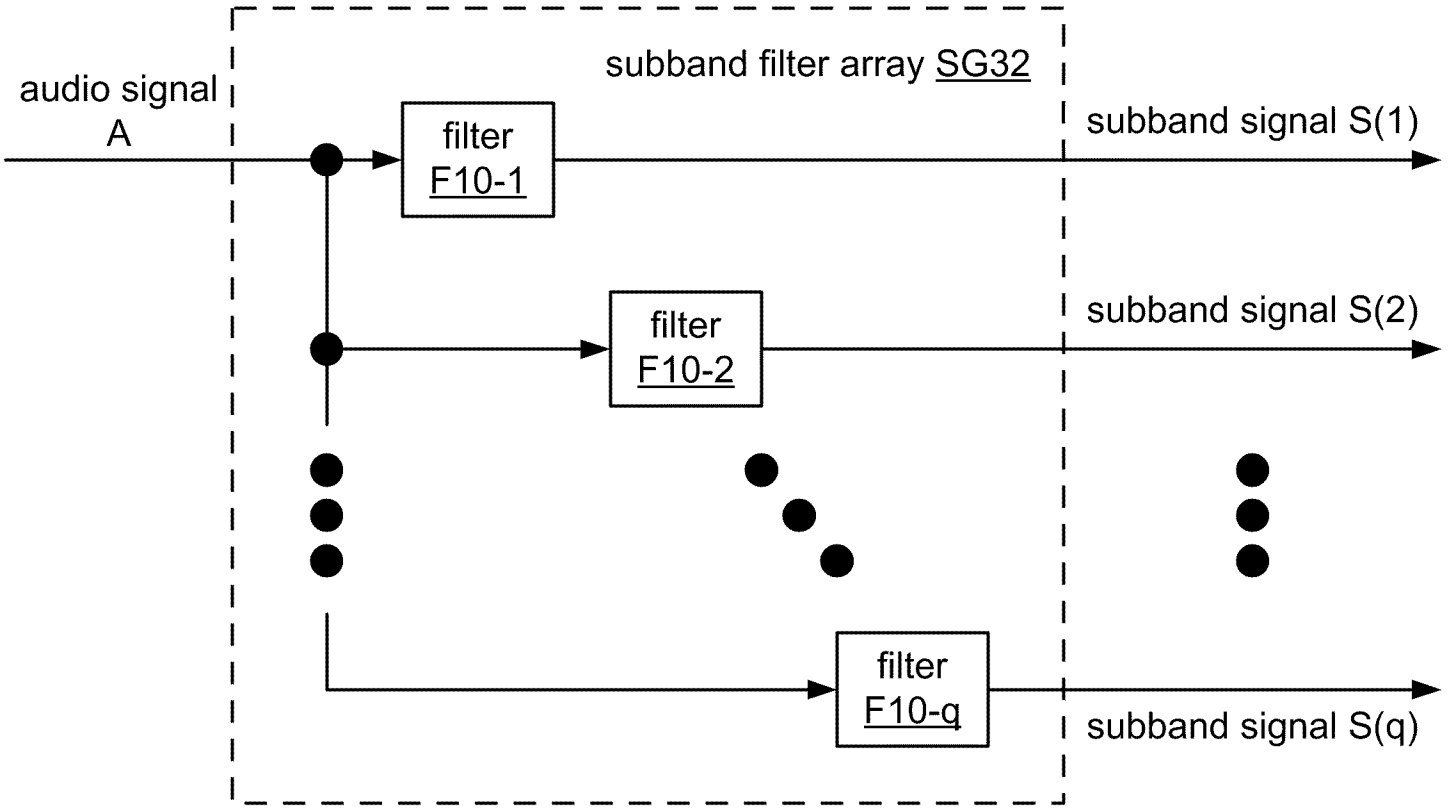
FIG. 20 shows a block diagram of an implementation SG32 of subband filter array SG30.

Subband filter array SG30 may be implemented to include two or more component filters that are configured to produce different subband signals in parallel. FIG. 20 shows a block diagram of such an implementation SG32 of subband filter array SG30 that includes an array of q bandpass filters F10-1 to F10-*q* arranged in parallel to perform a subband decomposition of audio signal A. Each of the filters F10-1 to F10-*q* is configured to filter audio signal A to produce a corresponding one of the q subband signals S(1) to S(q).

Each of the filters F10-1 to F10-*q* may be implemented to have a finite impulse response (FIR) or an infinite impulse response (IIR). For example, each of one or more (possibly all) of filters F10-1 to F10-*q* may be implemented as a second-order IIR section or "biquad". The transfer function of a biquad may be expressed as $$H(z) = \frac{b_0 + b_1 z^{-1} + b_2 z^{-2}}{1 + a_1 z^{-1} + a_2 z^{-2}}. \tag{1}$$

Figure 21B:
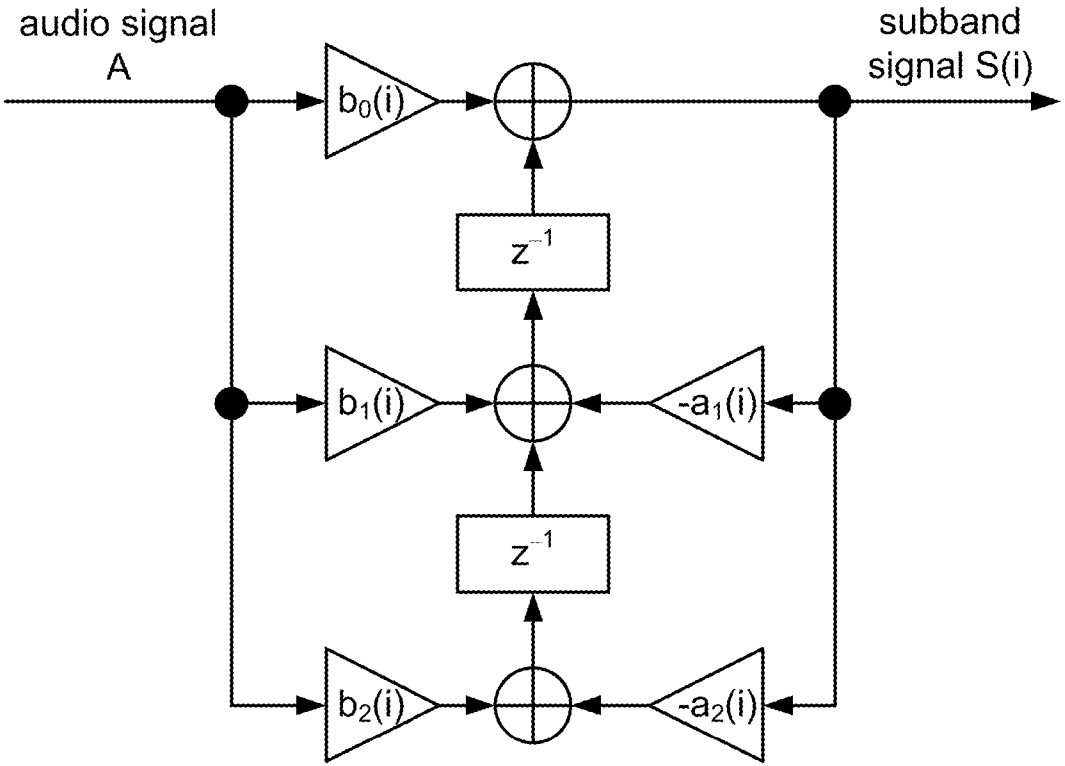
FIG. 21B illustrates a transposed direct form II structure for a biquad implementation of an IIR filter.
Figure 21A:
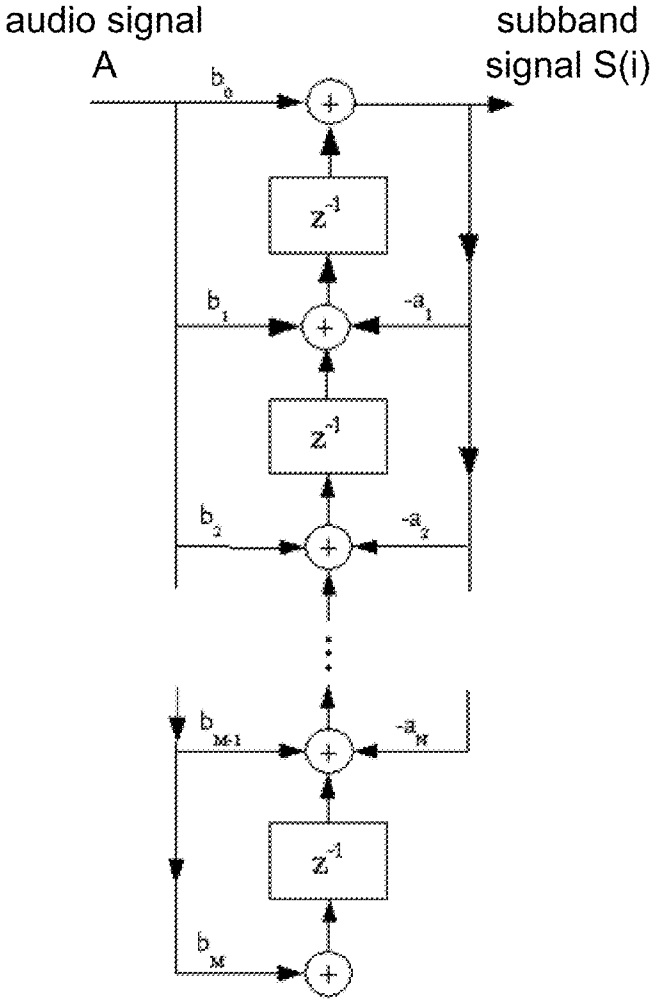
FIG. 21A illustrates a transposed direct form II for a general infinite impulse response (IIR) filter implementation.
Figure 22:
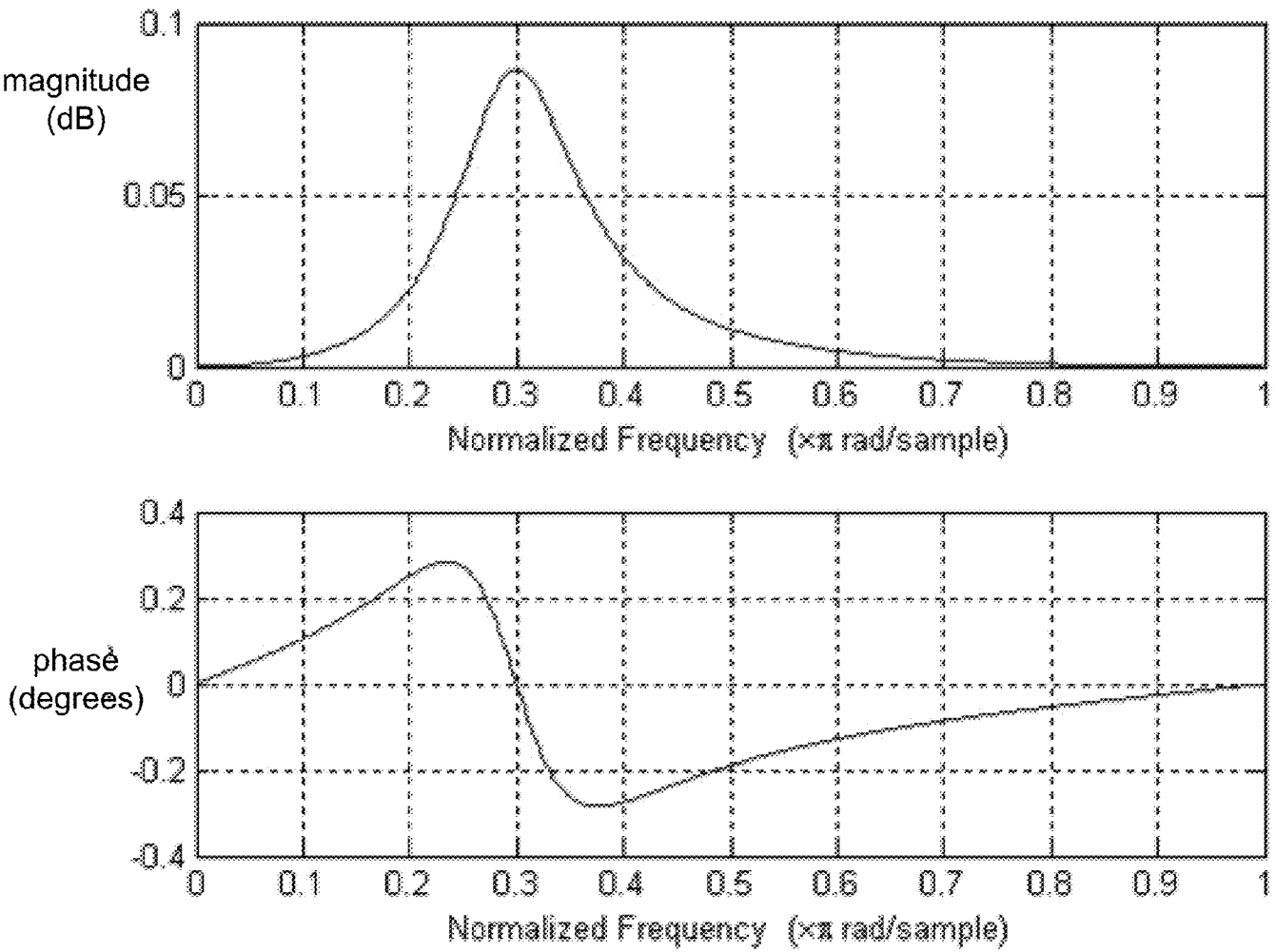
FIG. 22 shows magnitude and phase response plots for one example of a biquad implementation of an IIR filter.

It may be desirable to implement each biquad using the transposed direct form II, especially for floating-point implementations of equalizer EQ10. FIG. 21A illustrates a transposed direct form II for a general IIR filter implementation of one of filters F10-1 to F10-*q*, and FIG. 21B illustrates a transposed direct form II structure for a biquad implementation of one F10-*i* of filters F10-1 to F10-*q*. FIG. 22 shows magnitude and phase response plots for one example of a biquad implementation of one of filters F10-1 to F10-*q*.

It may be desirable for the filters F10-1 to F10-*q* to perform a nonuniform subband decomposition of audio signal A (e.g., such that two or more of the filter passbands have different widths) rather than a uniform subband decomposition (e.g., such that the filter passbands have equal widths). As noted above, examples of nonuniform subband division schemes include transcendental schemes, such as a scheme based on the Bark scale, or logarithmic schemes, such as a scheme based on the Mel scale. One such division scheme is illustrated by the dots in FIG. 19, which correspond to the frequencies 20, 300, 630, 1080, 1720, 2700, 4400, and 7700 Hz and indicate the edges of a set of seven Bark scale subbands whose widths increase with frequency. Such an arrangement of subbands may be used in a wideband speech processing system (e.g., a device having a sampling rate of 16 kHz). In other examples of such a division scheme, the lowest subband is omitted to obtain a six-subband scheme and/or the upper limit of the highest subband is increased from 7700 Hz to 8000 Hz.

In a narrowband speech processing system (e.g., a device that has a sampling rate of 8 kHz), it may be desirable to use an arrangement of fewer subbands. One example of such a subband division scheme is the four-band quasi-Bark scheme 300-510 Hz, 510-920 Hz, 920-1480 Hz, and 1480-4000 Hz. Use of a wide high-frequency band (e.g., as in this example) may be desirable because of low subband energy estimation and/or to deal with difficulty in modeling the highest subband with a biquad.

Figure 23:
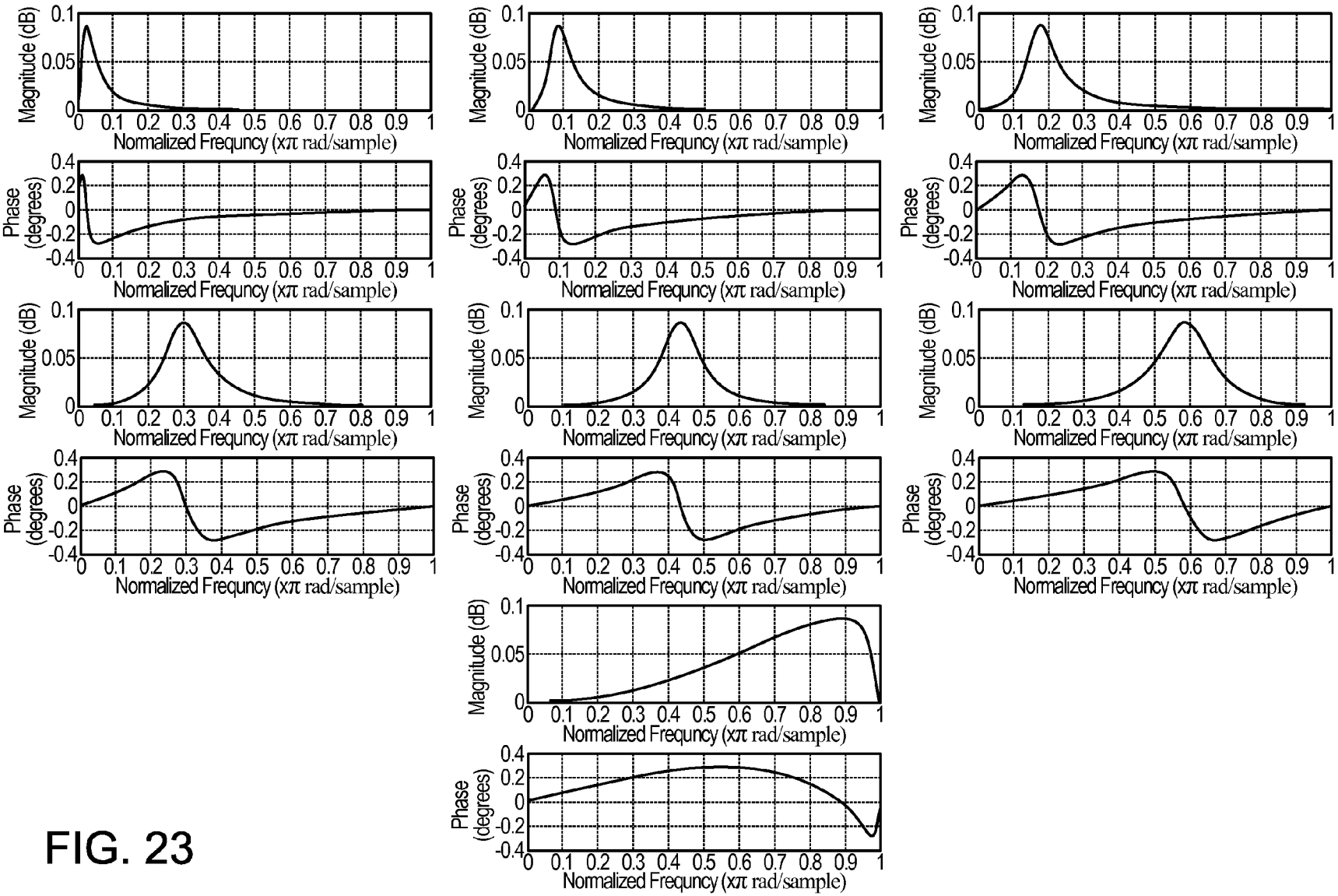
FIG. 23 shows magnitude and phase responses for a series of seven biquads.

Each of the filters F10-1 to F10-*q* is configured to provide a gain boost (i.e., an increase in signal magnitude) over the corresponding subband and/or an attenuation (i.e., a decrease in signal magnitude) over the other subbands. Each of the filters may be configured to boost its respective passband by about the same amount (for example, by three dB, or by six dB). Alternatively, each of the filters may be configured to attenuate its respective stopband by about the same amount (for example, by three dB, or by six dB). FIG. 23 shows magnitude and phase responses for a series of seven biquads that may be used to implement a set of filters F10-1 to F10-*q* where q is equal to seven. In this example, each filter is configured to boost its respective subband by about the same amount. Alternatively, it may be desirable to configure one or more of filters F10-1 to F10-*q* to provide a greater boost (or attenuation) than another of the filters. For example, it may be desirable to configure each of the filters F10-1 to F10-*q* of a subband filter array SG30 in one among first subband signal generator SG100*a* and second subband signal generator SG100*b* to provide the same gain boost to its respective subband (or attenuation to other subbands), and to configure at least some of the filters F10-1 to F10-*q* of a subband filter array SG30 in the other among first subband signal generator SG100*a* and second subband signal generator SG100*b* to provide different gain boosts (or attenuations) from one another according to, e.g., a desired psychoacoustic weighting function.

FIG. 20 shows an arrangement in which the filters F10-1 to F10-*q* produce the subband signals S(1) to S(q) in parallel. One of ordinary skill in the art will understand that each of one or more of these filters may also be implemented to produce two or more of the subband signals serially. For example, subband filter array SG30 may be implemented to include a filter structure (e.g., a biquad) that is configured at one time with a first set of filter coefficient values to filter audio signal A to produce one of the subband signals S(1) to S(q), and is configured at a subsequent time with a second set of filter coefficient values to filter audio signal A to produce a different one of the subband signals S(1) to S(q). In such case, subband filter array SG30 may be implemented using fewer than q bandpass filters. For example, it is possible to implement subband filter array SG30 with a single filter structure that is serially reconfigured in such manner to produce each of the q subband signals S(1) to S(q) according to a respective one of q sets of filter coefficient values.

Figure 18C:
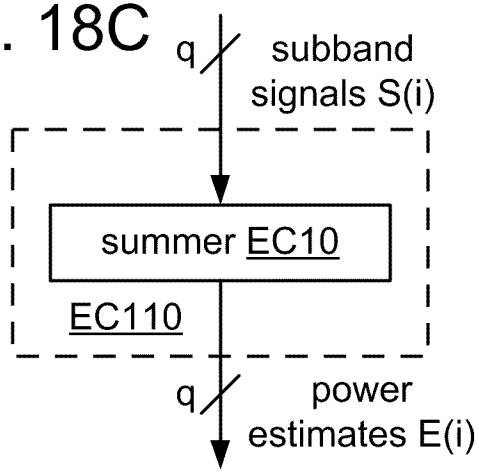
FIG. 18C shows a block diagram of a subband power estimate calculator EC110.

Each of first subband power estimate calculator EC100*a* and second subband power estimate calculator EC100*b* may be implemented as an instance of a subband power estimate calculator EC110 as shown in FIG. 18C. Subband power estimate calculator EC110 includes a summer EC10 that is configured to receive the set of subband signals S(i) and to produce a corresponding set of q subband power estimates E(i), where $1 \leqq i \leqq q$. Summer EC10 is typically configured to calculate a set of q subband power estimates for each block of consecutive samples (also called a "frame") of audio signal A. Typical frame lengths range from about five or ten milliseconds to about forty or fifty milliseconds, and the frames may be overlapping or nonoverlapping. A frame as processed by one operation may also be a segment (i.e., a "subframe") of a larger frame as processed by a different operation. In one particular example, audio signal A is divided into sequences of 10-millisecond nonoverlapping frames, and summer EC10 is configured to calculate a set of q subband power estimates for each frame of audio signal A.

In one example, summer EC10 is configured to calculate each of the subband power estimates E(i) as a sum of the squares of the values of the corresponding one of the subband signals S(i). Such an implementation of summer EC10 may be configured to calculate a set of q subband power estimates for each frame of audio signal A according to an expression such as $$E(i,k)=\Sigma_{j\in k}S(i,j)^2,\ 1\leqq i\leqq q, \tag{2}$$

where E(i,k) denotes the subband power estimate for subband i and frame k and S(i,j) denotes the j-th sample of the i-th subband signal.

In another example, summer EC10 is configured to calculate each of the subband power estimates E(i) as a sum of the magnitudes of the values of the corresponding one of the subband signals S(i). Such an implementation of summer EC10 may be configured to calculate a set of q subband power estimates for each frame of the audio signal according to an expression such as $$E(i,k)=\Sigma_{j\in k}|S(i,j)|,\ 1\leqq i\leqq q. \tag{3}$$

It may be desirable to implement summer EC10 to normalize each subband sum by a corresponding sum of audio signal A. In one such example, summer EC10 is configured to calculate each one of the subband power estimates E(i) as a sum of the squares of the values of the corresponding one of the subband signals S(i), divided by a sum of the squares of the values of audio signal A. Such an implementation of summer EC10 may be configured to calculate a set of q subband power estimates for each frame of the audio signal according to an expression such as $$E(i,k)=\frac{\sum_{j\in k}S(i,j)^2}{\sum_{j\in k}A(j)^2},\ 1\leq i\leq q, \tag{4a}$$

where A(j) denotes the j-th sample of audio signal A. In another such example, summer EC10 is configured to calculate each subband power estimate as a sum of the magnitudes of the values of the corresponding one of the subband signals S(i), divided by a sum of the magnitudes of the values of audio signal A. Such an implementation of summer EC10 may be configured to calculate a set of q subband power estimates for each frame of the audio signal according to an expression such as $$E(i,k)=\frac{\sum_{j\in k}|S(i,j)|}{\sum_{j\in k}|A(j)|},\ 1\leq i\leq q. \tag{4b}$$

Alternatively, for a case in which the set of subband signals S(i) is produced by an implementation of binning module SG20, it may be desirable for summer EC10 to normalize each subband sum by the total number of samples in the corresponding one of the subband signals S(i). For cases in which a division operation is used to normalize each subband sum (e.g., as in expressions (4a) and (4b) above), it may be desirable to add a small positive value ρ to the denominator to avoid the possibility of dividing by zero. The value ρ may be the same for all subbands, or a different value of ρ may be used for each of two or more (possibly all) of the subbands (e.g., for tuning and/or weighting purposes). The value (or values) of ρ may be fixed or may be adapted over time (e.g., from one frame to the next).

Alternatively, it may be desirable to implement summer EC10 to normalize each subband sum by subtracting a corresponding sum of audio signal A. In one such example, summer EC10 is configured to calculate each one of the subband power estimates E(i) as a difference between a sum of the squares of the values of the corresponding one of the subband signals S(i) and a sum of the squares of the values of audio signal A. Such an implementation of summer EC10 may be configured to calculate a set of q subband power estimates for each frame of the audio signal according to an expression such as $$E(i,k)=\Sigma_{j\in k}S(i,j)^2-\Sigma_{j\in k}A(j),\ 1\leqq i\leqq q. \tag{5a}$$

In another such example, summer EC10 is configured to calculate each one of the subband power estimates E(i) as a difference between a sum of the magnitudes of the values of the corresponding one of the subband signals S(i) and a sum of the magnitudes of the values of audio signal A. Such an implementation of summer EC10 may be configured to calculate a set of q subband power estimates for each frame of the audio signal according to an expression such as $$E(i,k)=\Sigma_{j\in k}|S(i,j)|-\Sigma_{j\in k}|A(j)|,\ 1\leqq i\leqq q. \tag{5b}$$

It may be desirable, for example, for an implementation of equalizer EQ20 to include a boosting implementation of subband filter array SG30 and an implementation of summer EC10 that is configured to calculate a set of q subband power estimates according to expression (5b).

Figure 18D:
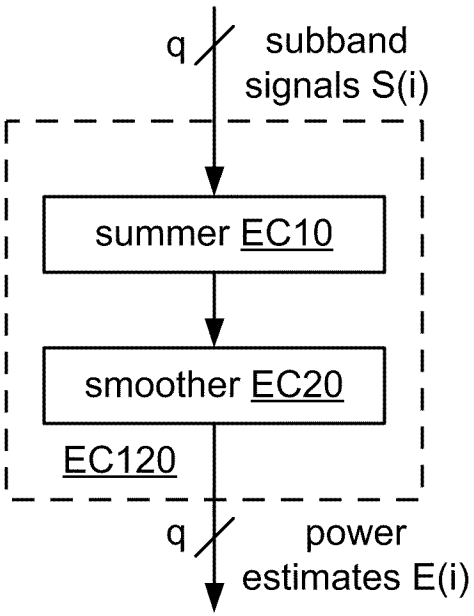
FIG. 18D shows a block diagram of a subband power estimate calculator EC120.

Either or both of first subband power estimate calculator EC100*a* and second subband power estimate calculator EC100*b* may be configured to perform a temporal smoothing operation on the subband power estimates. For example, either or both of first subband power estimate calculator EC100*a* and second subband power estimate calculator EC100*b* may be implemented as an instance of a subband power estimate calculator EC120 as shown in FIG. 18D. Subband power estimate calculator EC120 includes a smoother EC20 that is configured to smooth the sums calculated by summer EC10 over time to produce the subband power estimates E(i). Smoother EC20 may be configured to compute the subband power estimates E(i) as running averages of the sums. Such an implementation of smoother EC20 may be configured to calculate a set of q subband power estimates E(i) for each frame of audio signal A according to a linear smoothing expression such as one of the following:

$$E(i,k) \leftarrow \alpha E(i,k-1)+(1-\alpha)E(i,k), \tag{6}$$

$$E(i,k) \leftarrow \alpha E(i,k-1)+(1-\alpha)|E(i,k)|, \tag{7}$$

$$E(i,k) \leftarrow \alpha E(i,k-1)+(1-\alpha)\sqrt{E(i,k)^2}, \tag{8}$$

for $1 \leqq i \leqq q$, where smoothing factor $\alpha$ is a value between zero (no smoothing) and 0.9 (maximum smoothing) (e.g., 0.3, 0.5, or 0.7). It may be desirable for smoother EC20 to use the same value of smoothing factor $\alpha$ for all of the q subbands. Alternatively, it may be desirable for smoother EC20 to use a different value of smoothing factor $\alpha$ for each of two or more (possibly all) of the q subbands. The value (or values) of smoothing factor $\alpha$ may be fixed or may be adapted over time (e.g., from one frame to the next).

One particular example of subband power estimate calculator EC120 is configured to calculate the q subband sums according to expression (3) above and to calculate the q corresponding subband power estimates according to expression (7) above. Another particular example of subband power estimate calculator EC120 is configured to calculate the q subband sums according to expression (5b) above and to calculate the q corresponding subband power estimates according to expression (7) above. It is noted, however, that all of the eighteen possible combinations of one of expressions (2)-(5b) with one of expressions (6)-(8) are hereby individually expressly disclosed. An alternative implementation of smoother EC20 may be configured to perform a nonlinear smoothing operation on sums calculated by summer EC10.

Figure 24B:
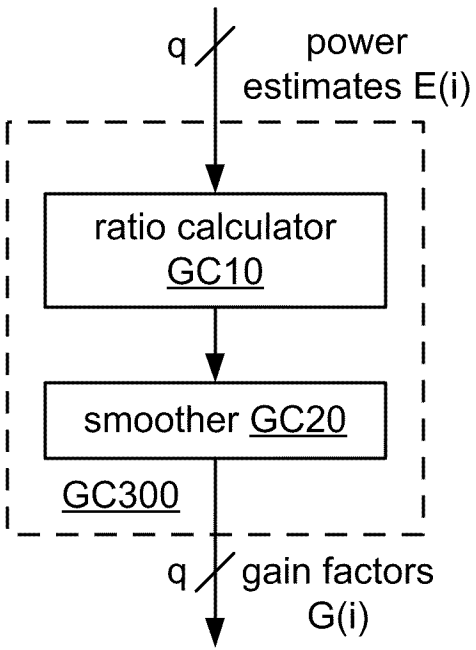
FIG. 24B shows a block diagram of an implementation GC300 of subband gain factor calculator GC100.
Figure 24A:
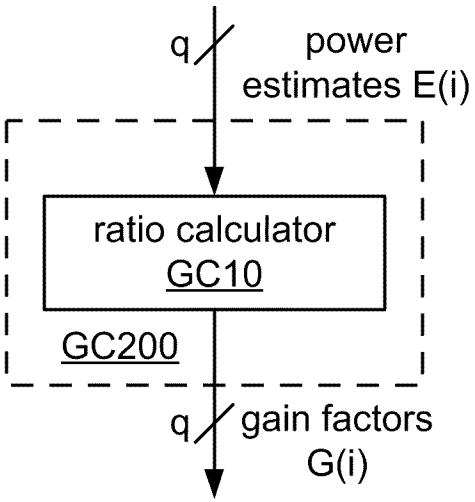
FIG. 24A shows a block diagram of an implementation GC200 of subband gain factor calculator GC100.

Subband gain factor calculator GC100 is configured to calculate a corresponding one of a set of gain factors G(i) for each of the q subbands, based on the corresponding first subband power estimate and the corresponding second subband power estimate, where $1 \leqq i \leqq q$. FIG. 24A shows a block diagram of an implementation GC200 of subband gain factor calculator GC100 that is configured to calculate each gain factor G(i) as a ratio of the corresponding signal and noise subband power estimates. Subband gain factor calculator GC200 includes a ratio calculator GC10 that may be configured to calculate each of a set of q power ratios for each frame of the audio signal according to an expression such as $$G(i,k) = \frac{E_N(i,k)}{E_A(i,k)},\ 1 \le i \le q, \tag{9}$$

where $E_N(i,k)$ denotes the subband power estimate as produced by second subband power estimate calculator EC100*b* (i.e., based on noise reference S20) for subband i and frame k, and $E_A$ (i,k) denotes the subband power estimate as produced by first subband power estimate calculator EC100*a* (i.e., based on reproduced audio signal S10) for subband i and frame k.

In a further example, ratio calculator GC10 is configured to calculate at least one (and possibly all) of the set of q ratios of subband power estimates for each frame of the audio signal according to an expression such as $$G(i,k) = \frac{E_N(i,k)}{E_A(i,k)+\varepsilon},\ 1 \le i \le q, \tag{10}$$

where $\epsilon$ is a tuning parameter having a small positive value (i.e., a value less than the expected value of $E_A$(i,k)). It may be desirable for such an implementation of ratio calculator GC10 to use the same value of tuning parameter $\epsilon$ for all of the subbands. Alternatively, it may be desirable for such an implementation of ratio calculator GC10 to use a different value of tuning parameter $\epsilon$ for each of two or more (possibly all) of the subbands. The value (or values) of tuning parameter $\epsilon$ may be fixed or may be adapted over time (e.g., from one frame to the next).

Subband gain factor calculator GC100 may also be configured to perform a smoothing operation on each of one or more (possibly all) of the q power ratios. FIG. 24B shows a block diagram of such an implementation GC300 of subband gain factor calculator GC100 that includes a smoother GC20 configured to perform a temporal smoothing operation on each of one or more (possibly all) of the q power ratios produced by ratio calculator GC10. In one such example, smoother GC20 is configured to perform a linear smoothing operation on each of the q power ratios according to an expression such as $$G(i,k) \leftarrow \beta G(i,k-1)+(1-\beta)G(i,k),\ 1 \leqq i \leqq q, \tag{11}$$

where $\beta$ is a smoothing factor.

It may be desirable for smoother GC20 to select one among two or more values of smoothing factor $\beta$ depending on a relation between the current and previous values of the subband gain factor. For example, it may be desirable for smoother GC20 to perform a differential temporal smoothing operation by allowing the gain factor values to change more quickly when the degree of noise is increasing and/or by inhibiting rapid changes in the gain factor values when the degree of noise is decreasing. Such a configuration may help to counter a psychoacoustic temporal masking effect in which a loud noise continues to mask a desired sound even after the noise has ended. Accordingly, it may be desirable for the value of smoothing factor $\beta$ to be larger when the current value of the gain factor is less than the previous value, as compared to the value of smoothing factor $\beta$ when the current value of the gain factor is greater than the previous value. In one such example, smoother GC20 is configured to perform a linear smoothing operation on each of the q power ratios according to an expression such as $$G(i,k) \leftarrow \begin{cases} \beta_{att}G(i,k-1)+(1-\beta_{att})G(i,k), & G(i,k)>G(i,k-1) \\ \beta_{dec}G(i,k-1)+(1-\beta_{dec})G(i,k), & \text{otherwise} \end{cases}, \quad (12)$$

for $1 \leqq i \leqq q$, where $\beta_{att}$ denotes an attack value for smoothing factor $\beta$, $\beta_{dec}$ denotes a decay value for smoothing factor $\beta$, and $\beta_{att}<\beta_{dec}$. Another implementation of smoother EC20 is configured to perform a linear smoothing operation on each of the q power ratios according to a linear smoothing expression such as one of the following:

$$G(i,k) \leftarrow \begin{cases} \beta_{att}G(i,k-1)+(1-\beta_{att})G(i,k), & G(i,k)>G(i,k-1) \\ \beta_{dec}G(i,k-1), & \text{otherwise} \end{cases}, \quad (13)$$

$$G(i,k) \leftarrow \begin{cases} \beta_{att}G(i,k-1)+(1-\beta_{att})G(i,k), & G(i,k)>G(i,k-1) \\ \max[\beta_{dec}G(i,k-1), G(i,k)], & \text{otherwise} \end{cases}. \quad (14)$$

FIG. 25A shows a pseudocode listing that describes one example of such smoothing according to expressions (10) and (13) above, which may be performed for each subband i at frame k. In this listing, the current value of the subband gain factor is initialized to a ratio of noise power to audio power. If this ratio is less than the previous value of the subband gain factor, then the current value of the subband gain factor is calculated by scaling down the previous value by a scale factor beta_dec that has a value less than one. Otherwise, the current value of the subband gain factor is calculated as an average of the ratio and the previous value of the subband gain factor, using an averaging factor beta_att that has a value between zero (no smoothing) and one (maximum smoothing, with no updating).

A further implementation of smoother GC20 may be configured to delay updates to one or more (possibly all) of the q gain factors when the degree of noise is decreasing. FIG. 25B shows a modification of the pseudocode listing of FIG. 25A that may be used to implement such a differential temporal smoothing operation. This listing includes hangover logic that delays updates during a ratio decay profile according to an interval specified by the value hangover_max(i). The same value of hangover_max may be used for each subband, or different values of hangover_max may be used for different subbands.

An implementation of subband gain factor calculator GC100 as described above may be further configured to apply an upper bound and/or a lower bound to one or more (possibly all) of the subband gain factors. FIGS. 26A and 26B show modifications of the pseudocode listings of FIGS. 25A and 25B, respectively, that may be used to apply such an upper bound UB and lower bound LB to each of the subband gain factor values. The values of each of these bounds may be fixed. Alternatively, the values of either or both of these bounds may be adapted according to, for example, a desired headroom for equalizer EQ10 and/or a current volume of equalized audio signal S50 (e.g., a current value of volume control signal VS10). Alternatively or additionally, the values of either or both of these bounds may be based on information from reproduced audio signal S40, such as a current level of reproduced audio signal S40.

It may be desirable to configure equalizer EQ10 to compensate for excessive boosting that may result from an overlap of subbands. For example, subband gain factor calculator GC100 may be configured to reduce the value of one or more of the mid-frequency subband gain factors (e.g., a subband that includes the frequency fs/4, where fs denotes the sampling frequency of reproduced audio signal S40). Such an implementation of subband gain factor calculator GC100 may be configured to perform the reduction by multiplying the current value of the subband gain factor by a scale factor having a value of less than one. Such an implementation of subband gain factor calculator GC100 may be configured to use the same scale factor for each subband gain factor to be scaled down or, alternatively, to use different scale factors for each subband gain factor to be scaled down (e.g., based on the degree of overlap of the corresponding subband with one or more adjacent subbands).

Additionally or in the alternative, it may be desirable to configure equalizer EQ10 to increase a degree of boosting of one or more of the high-frequency subbands. For example, it may be desirable to configure subband gain factor calculator GC100 to ensure that amplification of one or more high-frequency subbands of reproduced audio signal S40 (e.g., the highest subband) is not lower than amplification of a mid-frequency subband (e.g., a subband that includes the frequency fs/4, where fs denotes the sampling frequency of reproduced audio signal S40). In one such example, subband gain factor calculator GC100 is configured to calculate the current value of the subband gain factor for a high-frequency subband by multiplying the current value of the subband gain factor for a mid-frequency subband by a scale factor that is greater than one. In another such example, subband gain factor calculator GC100 is configured to calculate the current value of the subband gain factor for a high-frequency subband as the maximum of (A) a current gain factor value that is calculated from the power ratio for that subband in accordance with any of the techniques disclosed above and (B) a value obtained by multiplying the current value of the subband gain factor for a mid-frequency subband by a scale factor that is greater than one.

Figure 27:
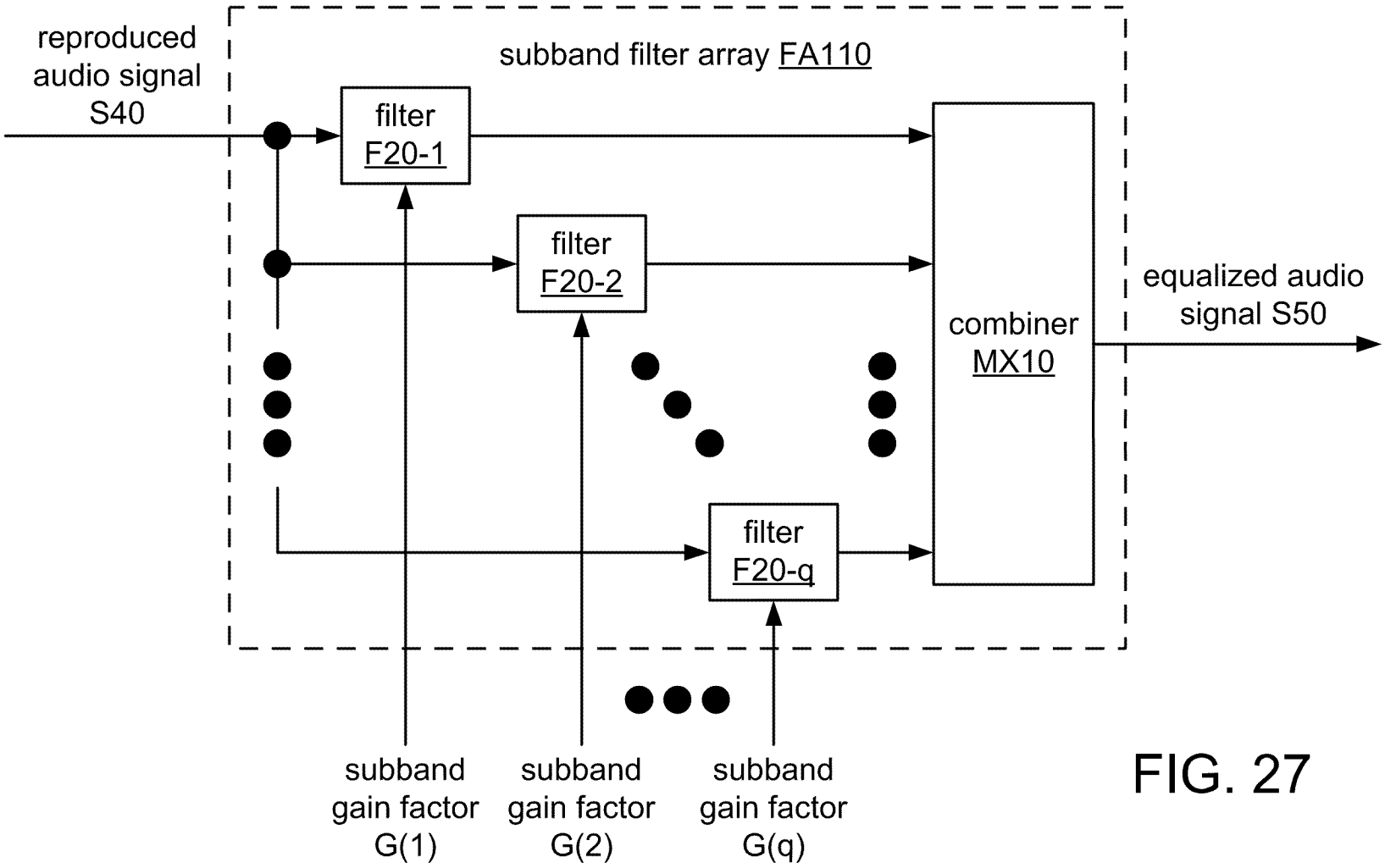
FIG. 27 shows a block diagram of an implementation FA110 of subband filter array FA100 that includes a set of bandpass filters arranged in parallel.
Figure 28A:
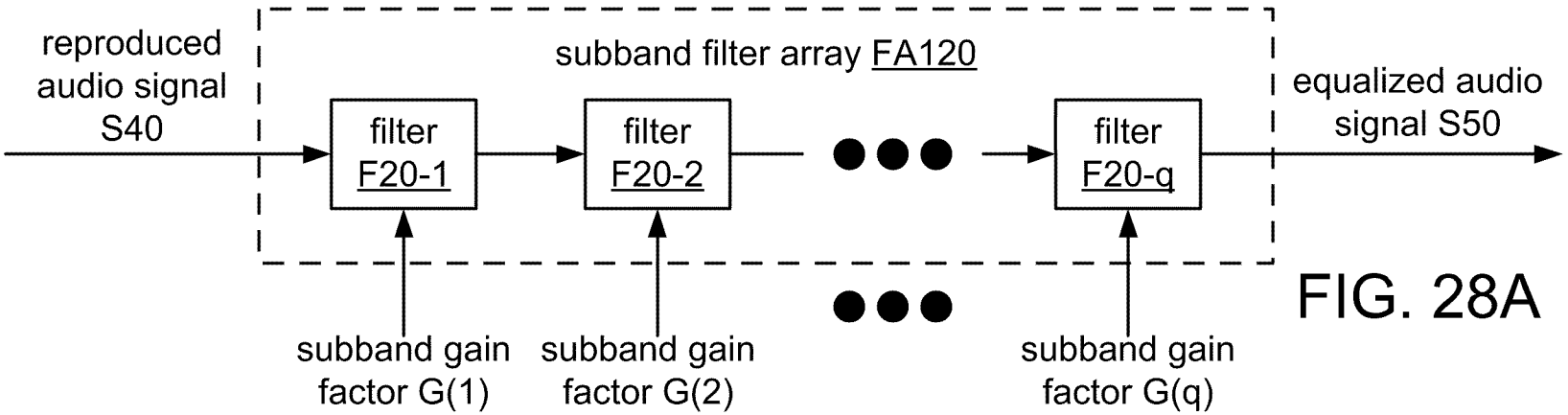
FIG. 28A shows a block diagram of an implementation FA120 of subband filter array FA100 in which the bandpass filters are arranged in serial.

Subband filter array FA100 is configured to apply each of the subband gain factors to a corresponding subband of reproduced audio signal S40 to produce equalized audio signal S50. Subband filter array FA100 may be implemented to include an array of bandpass filters, each configured to apply a respective one of the subband gain factors to a corresponding subband of reproduced audio signal S40. The filters of such an array may be arranged in parallel and/or in serial. FIG. 27 shows a block diagram of an implementation FA10 of subband filter array FA100 that includes a set of q bandpass filters F20-1 to F20-*q* arranged in parallel. In this case, each of the filters F20-1 to F20-*q* is arranged to apply a corresponding one of q subband gain factors G(1) to G(q) (e.g., as calculated by subband gain factor calculator GC100) to a corresponding subband of reproduced audio signal S40 by filtering reproduced audio signal S40 according to the gain factor to produce a corresponding bandpass signal. Subband filter array FA110 also includes a combiner MX10 that is configured to mix the q bandpass signals to produce equalized audio signal S50. FIG. 28A shows a block diagram of another implementation FA120 of subband filter array FA100 in which the bandpass filters F20-1 to F20-*q* are arranged to apply each of the subband gain factors G(1) to G(q) to a corresponding subband of reproduced audio signal S40 by filtering reproduced audio signal S40 according to the subband gain factors in serial (i.e., in a cascade, such that each filter F20-*k* is arranged to filter the output of filter F20-(*k*−1) for $2 \leqq k \leqq q$).

Each of the filters F20-1 to F20-*q* may be implemented to have a finite impulse response (FIR) or an infinite impulse response (IIR). For example, each of one or more (possibly all) of filters F20-1 to F20-*q* may be implemented as a biquad. For example, subband filter array FA120 may be implemented as a cascade of biquads. Such an implementation may also be referred to as a biquad IIR filter cascade, a cascade of second-order IIR sections or filters, or a series of subband IIR biquads in cascade. It may be desirable to implement each biquad using the transposed direct form II, especially for floating-point implementations of equalizer EQ10.

It may be desirable for the passbands of filters F20-1 to F20-*q* to represent a division of the bandwidth of reproduced audio signal S40 into a set of nonuniform subbands (e.g., such that two or more of the filter passbands have different widths) rather than a set of uniform subbands (e.g., such that the filter passbands have equal widths). As noted above, examples of nonuniform subband division schemes include transcendental schemes, such as a scheme based on the Bark scale, or logarithmic schemes, such as a scheme based on the Mel scale. Filters F20-1 to F20-*q* may be configured in accordance with a Bark scale division scheme as illustrated by the dots in FIG. 19, for example. Such an arrangement of subbands may be used in a wideband speech processing system (e.g., a device having a sampling rate of 16 kHz). In other examples of such a division scheme, the lowest subband is omitted to obtain a six-subband scheme and/or the upper limit of the highest subband is increased from 7700 Hz to 8000 Hz.

In a narrowband speech processing system (e.g., a device that has a sampling rate of 8 kHz), it may be desirable to design the passbands of filters F20-1 to F20-*q* according to a division scheme having fewer than six or seven subbands. One example of such a subband division scheme is the four-band quasi-Bark scheme 300-510 Hz, 510-920 Hz, 920-1480 Hz, and 1480-4000 Hz. Use of a wide high-frequency band (e.g., as in this example) may be desirable because of low subband energy estimation and/or to deal with difficulty in modeling the highest subband with a biquad.

Each of the subband gain factors G(1) to G(q) may be used to update one or more filter coefficient values of a corresponding one of filters F20-1 to F20-*q*. In such case, it may be desirable to configure each of one or more (possibly all) of the filters F20-1 to F20-*q* such that its frequency characteristics (e.g., the center frequency and width of its passband) are fixed and its gain is variable. Such a technique may be implemented for an FIR or IIR filter by varying only the values of the feedforward coefficients (e.g., the coefficients $b_0$, $b_1$, and $b_2$ in biquad expression (1) above) by a common factor (e.g., the current value of the corresponding one of subband gain factors G(1) to G(q)). For example, the values of each of the feedforward coefficients in a biquad implementation of one F20-*i* of filters F20-1 to F20-*q* may be varied according to the current value of a corresponding one G(i) of subband gain factors G(1) to G(q) to obtain the following transfer function:

$$H_i(z) = \frac{G(i)b_0(i) + G(i)b_1(i)z^{-1} + G(i)b_2(i)z^{-2}}{1 + a_1(i)z^{-1} + a_2(i)z^{-2}}. \quad (15)$$

Figure 28B:
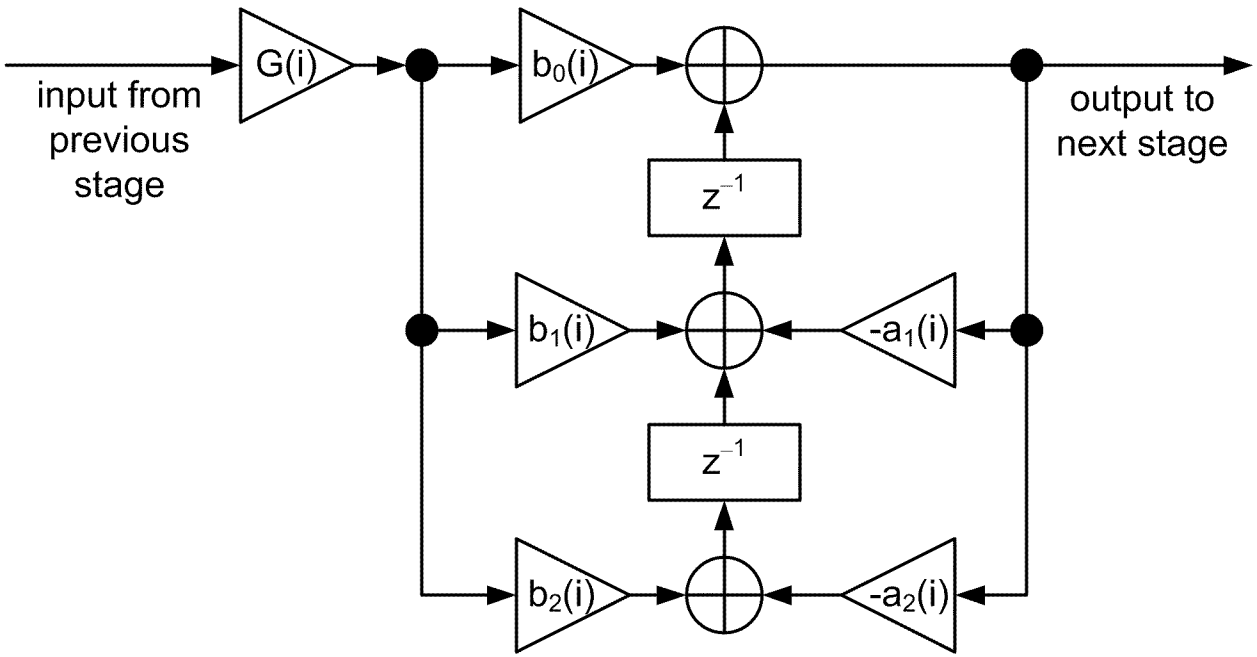
FIG. 28B shows another example of a biquad implementation of an IIR filter.

FIG. 28B shows another example of a biquad implementation of one F20-*i* of filters F20-1 to F20-*q* in which the filter gain is varied according to the current value of the corresponding subband gain factor G(i).

It may be desirable for subband filter array FA100 to apply the same subband division scheme as an implementation of subband filter array SG30 of first subband signal generator SG100*a* and/or an implementation of a subband filter array SG30 of second subband signal generator SG100*b*. For example, it may be desirable for subband filter array FA100 to use a set of filters having the same design as those of such a filter or filters (e.g., a set of biquads), with fixed values being used for the gain factors of the subband filter array or arrays. Subband filter array FA100 may even be implemented using the same component filters as such a subband filter array or arrays (e.g., at different times, with different gain factor values, and possibly with the component filters being differently arranged, as in the cascade of array FA120).

It may be desirable to configure equalizer EQ10 to pass one or more subbands of reproduced audio signal S40 without boosting. For example, boosting of a low-frequency subband may lead to muffling of other subbands, and it may be desirable for equalizer EQ10 to pass one or more low-frequency subbands of reproduced audio signal S40 (e.g., a subband that includes frequencies less than 300 Hz) without boosting.

It may be desirable to design subband filter array FA100 according to stability and/or quantization noise considerations. As noted above, for example, subband filter array FA120 may be implemented as a cascade of second-order sections. Use of a transposed direct form II biquad structure to implement such a section may help to minimize round-off noise and/or to obtain robust coefficient/frequency sensitivities within the section. Equalizer EQ10 may be configured to perform scaling of filter input and/or coefficient values, which may help to avoid overflow conditions. Equalizer EQ10 may be configured to perform a sanity check operation that resets the history of one or more IIR filters of subband filter array FA100 in case of a large discrepancy between filter input and output. Numerical experiments and online testing have led to the conclusion that equalizer EQ10 may be implemented without any modules for quantization noise compensation, but one or more such modules may be included as well (e.g., a module configured to perform a dithering operation on the output of each of one or more filters of subband filter array FA100).

It may be desirable to configure apparatus A100 to bypass equalizer EQ10, or to otherwise suspend or inhibit equalization of reproduced audio signal S40, during intervals in which reproduced audio signal S40 is inactive. Such an implementation of apparatus A100 may include a voice activity detector (VAD) that is configured to classify a frame of reproduced audio signal S40 as active (e.g., speech) or inactive (e.g., noise) based on one or more factors such as frame energy, signal-to-noise ratio, periodicity, autocorrelation of speech and/or residual (e.g., linear prediction coding residual), zero crossing rate, and/or first reflection coefficient. Such classification may include comparing a value or magnitude of such a factor to a threshold value and/or comparing the magnitude of a change in such a factor to a threshold value.

Figure 29:
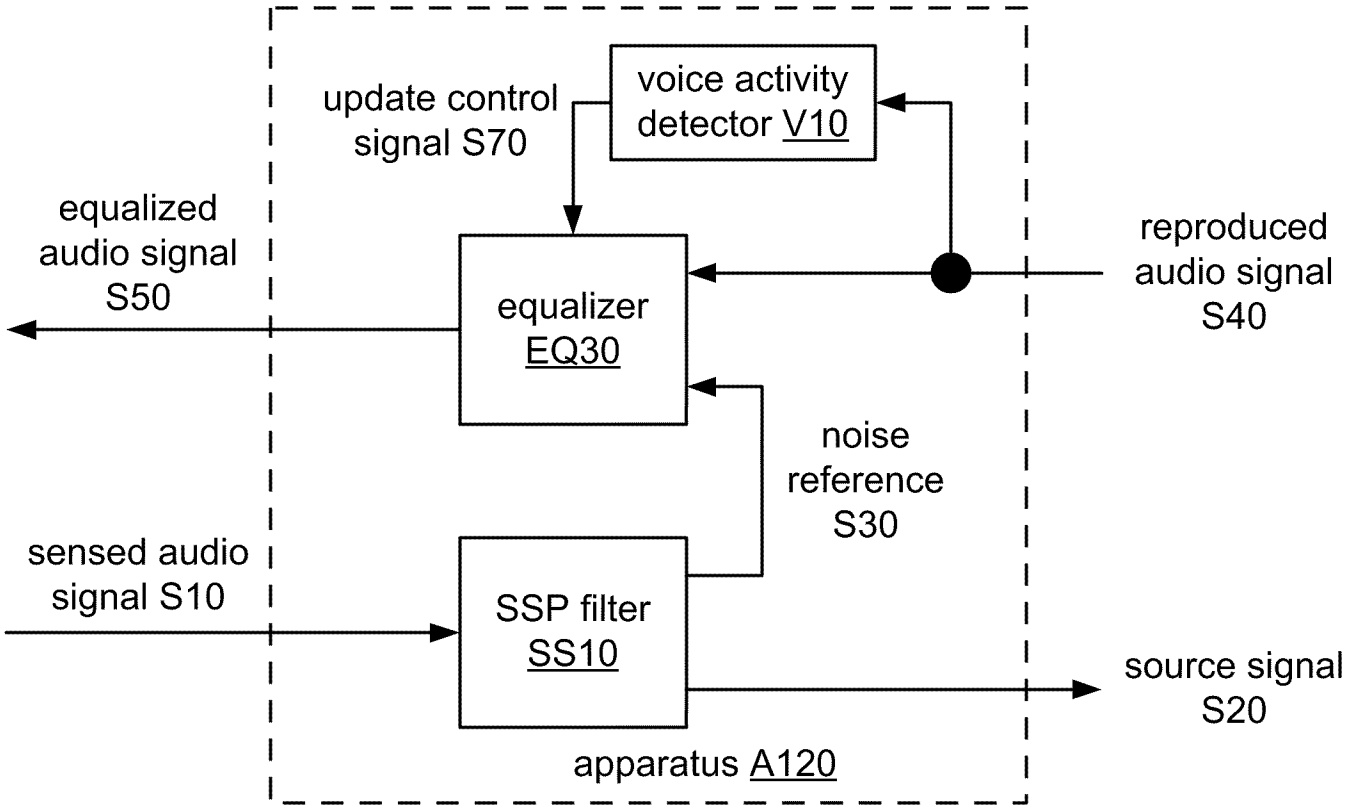
FIG. 29 shows a block diagram of an implementation A120 of apparatus A100.

FIG. 29 shows a block diagram of an implementation A120 of apparatus A100 that includes such a VAD V10. Voice activity detector V10 is configured to produce an update control signal S70 whose state indicates whether speech activity is detected on reproduced audio signal S40. Apparatus A120 also includes an implementation EQ30 of equalizer EQ10 (e.g., of equalizer EQ20) that is controlled according to the state of update control signal S70. For example, equalizer EQ30 may be configured such that updates of the subband gain factor values are inhibited during intervals (e.g., frames) of reproduced audio signal S40 when speech is not detected. Such an implementation of equalizer EQ30 may include an implementation of subband gain factor calculator GC100 that is configured to suspend updates of the subband gain factors (e.g., to set the values of the subband gain factors to, or to allow the values of the subband gain factors to decay to, a lower bound value) when VAD V10 indicates that the current frame of reproduced audio signal S40 is inactive.

Voice activity detector V10 may be configured to classify a frame of reproduced audio signal S40 as active or inactive (e.g., to control a binary state of update control signal S70)

based on one or more factors such as frame energy, signal-to-noise ratio (SNR), periodicity, zero-crossing rate, autocorrelation of speech and/or residual, and first reflection coefficient. Such classification may include comparing a value or magnitude of such a factor to a threshold value and/or comparing the magnitude of a change in such a factor to a threshold value. Alternatively or additionally, such classification may include comparing a value or magnitude of such a factor, such as energy, or the magnitude of a change in such a factor, in one frequency band to a like value in another frequency band. It may be desirable to implement VAD V10 to perform voice activity detection based on multiple criteria (e.g., energy, zero-crossing rate, etc.) and/or a memory of recent VAD decisions. One example of a voice activity detection operation that may be performed by VAD V10 includes comparing highband and lowband energies of reproduced audio signal S40 to respective thresholds as described, for example, in section 4.7 (pp. 4-49 to 4-57) of the 3GPP2 document C.S0014-C, v1.0, entitled "Enhanced Variable Rate Codec, Speech Service Options 3, 68, and 70 for Wideband Spread Spectrum Digital Systems," January 2007 (available online at www-dot-3gpp-dot-org). Voice activity detector V10 is typically configured to produce update control signal S70 as a binary-valued voice detection indication signal, but configurations that produce a continuous and/or multi-valued signal are also possible.

FIGS. 30A and 30B show modifications of the pseudocode listings of FIGS. 26A and 26B, respectively, in which the state of variable VAD (e.g., update control signal S70) is 1 when the current frame of reproduced audio signal S40 is active and 0 otherwise. In these examples, which may be performed by a corresponding implementation of subband gain factor calculator GC100, the current value of the subband gain factor for subband i and frame k is initialized to the most recent value. FIGS. 31A and 31B show other modifications of the pseudocode listings of FIGS. 26A and 26B, respectively, in which the value of the subband gain factor is allowed to decay to a lower bound value when no voice activity is detected (i.e., for inactive frames).

It may be desirable to configure apparatus A100 to control the level of reproduced audio signal S40. For example, it may be desirable to configure apparatus A100 to control the level of reproduced audio signal S40 to provide sufficient headroom to accommodate subband boosting by equalizer EQ10. Additionally or in the alternative, it may be desirable to configure apparatus A100 to determine values for either or both of upper bound UB and lower bound LB, as disclosed above with reference to subband gain factor calculator GC100, based on information regarding reproduced audio signal S40 (e.g., a current level of reproduced audio signal S40).

Figure 32:
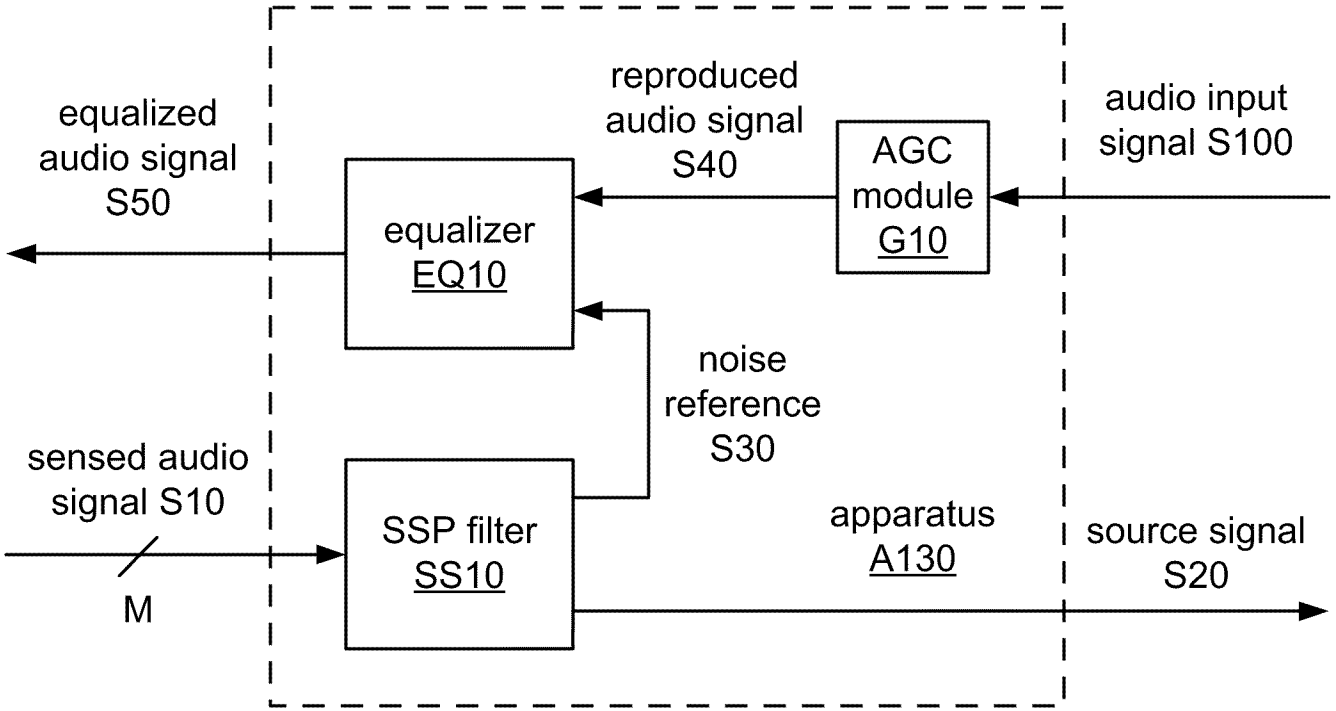
FIG. 32 shows a block diagram of an implementation A130 of apparatus A100.

FIG. 32 shows a block diagram of an implementation A130 of apparatus A100 in which equalizer EQ10 is arranged to receive reproduced audio signal S40 via an automatic gain control (AGC) module G10. Automatic gain control module G10 may be configured to compress the dynamic range of an audio input signal S100 into a limited amplitude band, according to any AGC technique known or to be developed, to obtain reproduced audio signal S40. Automatic gain control module G10 may be configured to perform such dynamic compression by, for example, boosting segments (e.g., frames) of the input signal that have low power and decreasing energy in segments of the input signal that have high power. Apparatus A130 may be arranged to receive audio input signal S100 from a decoding stage. For example, communications device D100 as described above may be constructed to include an implementation of apparatus A110 that is also an implementation of apparatus A130 (i.e., that includes AGC module G10).

Automatic gain control module G10 may be configured to provide a headroom definition and/or a master volume setting. For example, AGC module G10 may be configured to provide values for upper bound UB and/or lower bound LB as disclosed above to equalizer EQ10. Operating parameters of AGC module G10, such as a compression threshold and/or volume setting, may limit the effective headroom of equalizer EQ10. It may be desirable to tune apparatus A100 (e.g., to tune equalizer EQ10 and/or AGC module G10 if present) such that in the absence of noise on sensed audio signal S10, the net effect of apparatus A100 is substantially no gain amplification (e.g., with a difference in levels between reproduced audio signal S40 and equalized audio signal S50 being less than about plus or minus five, ten, or twenty percent).

Time-domain dynamic compression may increase signal intelligibility by, for example, increasing the perceptibility of a change in the signal over time. One particular example of such a signal change involves the presence of clearly defined formant trajectories over time, which may contribute significantly to the intelligibility of the signal. The start and end points of formant trajectories are typically marked by consonants, especially stop consonants (e.g., [k], [t], [p], etc.). These marking consonants typically have low energies as compared to the vowel content and other voiced parts of speech. Boosting the energy of a marking consonant may increase intelligibility by allowing a listener to more clearly follow speech onset and offsets. Such an increase in intelligibility differs from that which may be gained through frequency subband power adjustment (e.g., as described herein with reference to equalizer EQ10). Therefore, exploiting synergies between these two effects (e.g., in an implementation of apparatus A130) may allow a considerable increase in the overall speech intelligibility.

Figure 33:
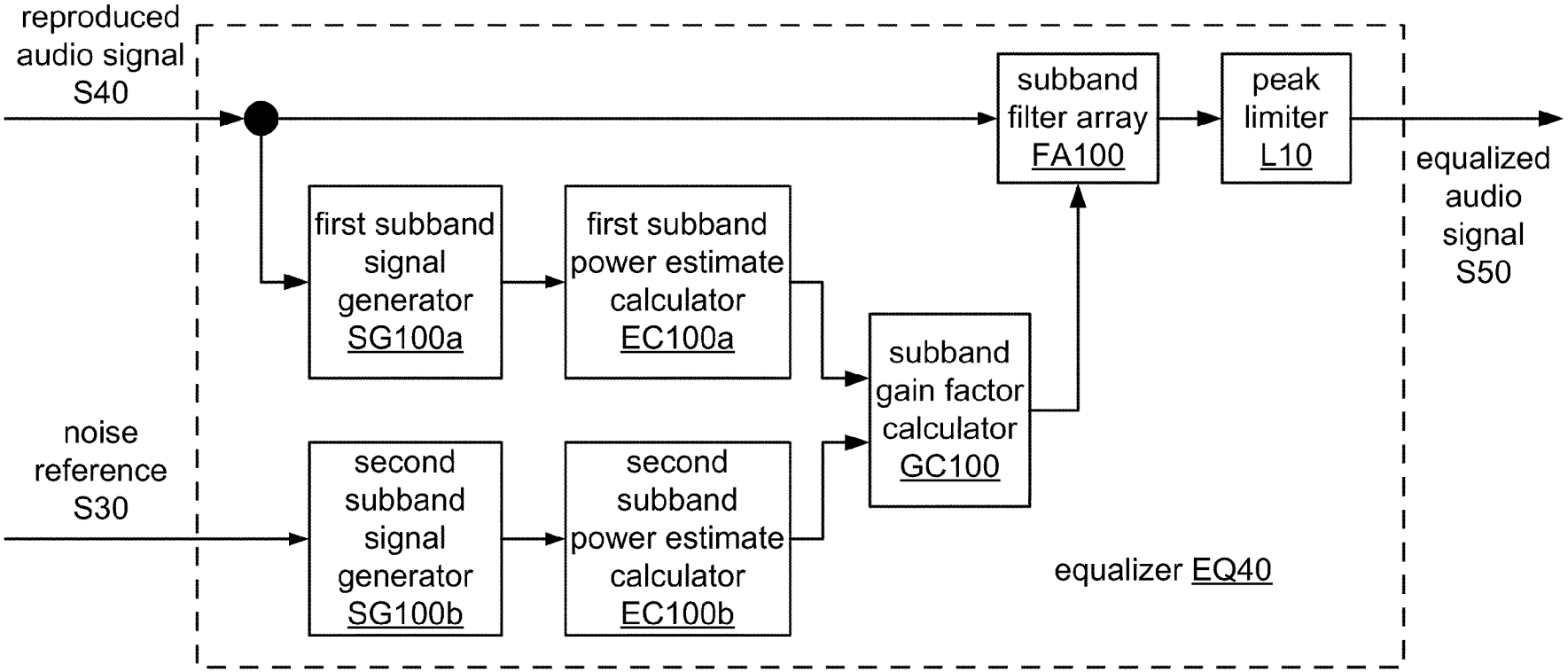
FIG. 33 shows a block diagram of an implementation EQ40 of equalizer EQ20 that includes a peak limiter L10.
Figure 34:
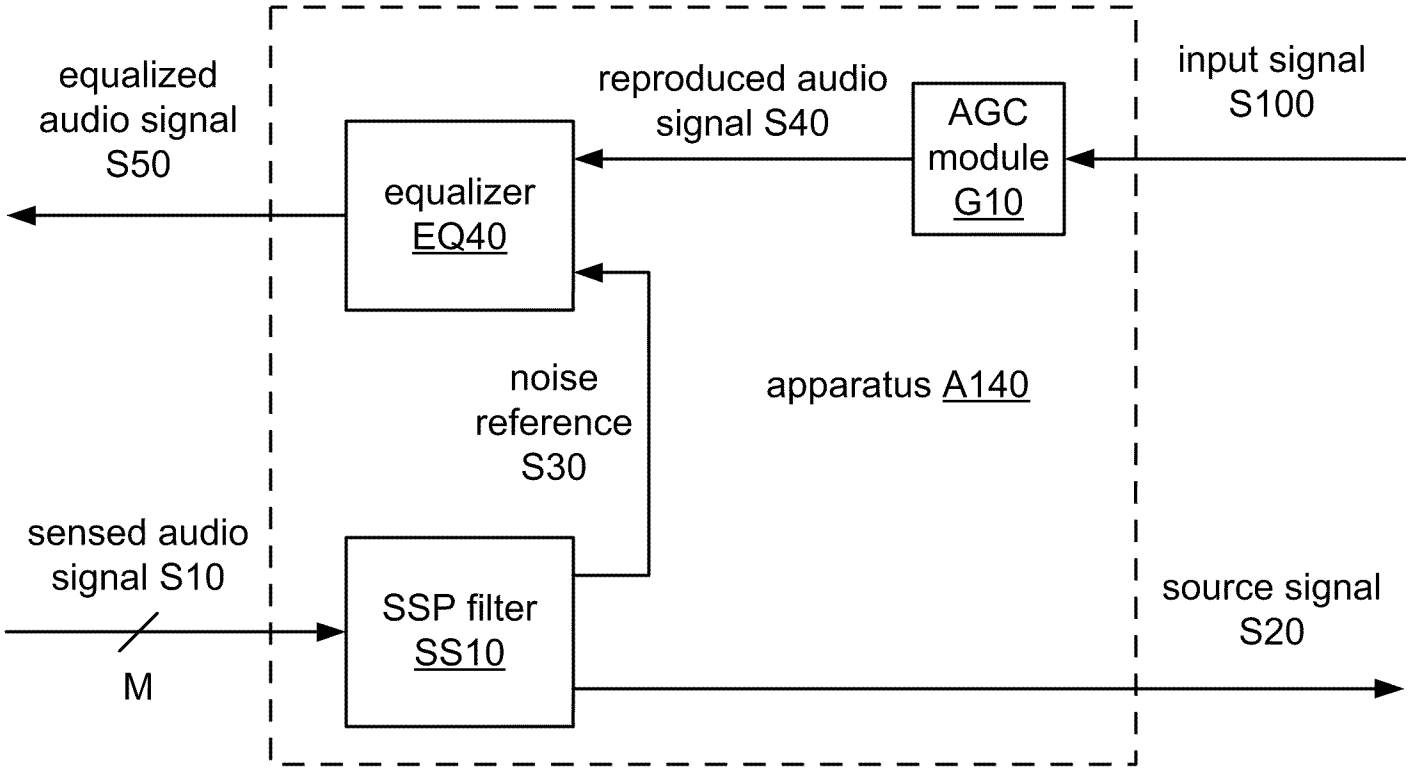
FIG. 34 shows a block diagram of an implementation A140 of apparatus A100.

It may be desirable to configure apparatus A100 to further control the level of equalized audio signal S50. For example, apparatus A100 may be configured to include an AGC module (in addition to, or in the alternative to, AGC module G10) that is arranged to control the level of equalized audio signal S50. FIG. 33 shows a block diagram of an implementation EQ40 of equalizer EQ20 that includes a peak limiter L10 arranged to limit the acoustic output level of the equalizer. Peak limiter L10 may be implemented as a variable-gain audio level compressor. For example, peak limiter L10 may be configured to compress high peak values to threshold values such that equalizer EQ40 achieves a combined equalization/compression effect. FIG. 34 shows a block diagram of an implementation A140 of apparatus A100 that includes equalizer EQ40 as well as AGC module G10.

The pseudocode listing of FIG. 35A describes one example of a peak limiting operation that may be performed by peak limiter L10. For each sample k of an input signal sig (e.g., for each sample k of equalized audio signal S50), this operation calculates a difference pkdiff between the sample magnitude and a soft peak limit peak_lim. The value of peak_lim may be fixed or may be adapted over time. For example, the value of peak_lim may be based on information from AGC module G10, such as the value of upper bound UB and/or lower bound LB, information relating to a current level of reproduced audio signal S40, etc.

If the value of pkdiff is at least zero, then the sample magnitude does not exceed the peak limit peak_lim. In this case, a differential gain value diffgain is set to one. Otherwise, the sample magnitude is greater than the peak limit peak_lim, and diffgain is set to a value that is less than one in proportion to the excess magnitude.

The peak limiting operation may also include smoothing of the gain value. Such smoothing may differ according to whether the gain is increasing or decreasing over time. As shown in FIG. 35A, for example, if the value of diffgain exceeds the previous value of peak gain parameter g_pk, then the value of g_pk is updated using the previous value of g_pk, the current value of diffgain, and an attack gain smoothing parameter gamma_att. Otherwise, the value of g_pk is updated using the previous value of g_pk, the current value of diffgain, and a decay gain smoothing parameter gamma_dec. The values gamma_att and gamma_dec are selected from a range of about zero (no smoothing) to about 0.999 (maximum smoothing). The corresponding sample k of input signal sig is then multiplied by the smoothed value of g_pk to obtain a peak-limited sample.

FIG. 35B shows a modification of the pseudocode listing of FIG. 35A that uses a different expression to calculate differential gain value diffgain. As an alternative to these examples, peak limiter L10 may be configured to perform a further example of a peak limiting operation as described in FIG. 35A or 35B in which the value of pkdiff is updated less frequently (e.g., in which the value of pkdiff is calculated as a difference between peak_lim and an average of the absolute values of several samples of signal sig).

As noted herein, a communications device may be constructed to include an implementation of apparatus A100. At some times during the operation of such a device, it may be desirable for apparatus A100 to equalize reproduced audio signal S40 according to information from a reference other than noise reference S30. In some environments or orientations, for example, a directional processing operation of SSP filter SS10 may produce an unreliable result. In some operating modes of the device, such as a push-to-talk (PTT) mode or a speakerphone mode, spatially selective processing of the sensed audio channels may be unnecessary or undesirable. In such cases, it may be desirable for apparatus A100 to operate in a non-spatial (or "single-channel") mode rather than a spatially selective (or "multichannel") mode.

An implementation of apparatus A100 may be configured to operate in a single-channel mode or a multichannel mode according to the current state of a mode select signal. Such an implementation of apparatus A100 may include a separation evaluator that is configured to produce the mode select signal (e.g., a binary flag) based on a quality of at least one among sensed audio signal S10, source signal S20, and noise reference S30. The criteria used by such a separation evaluator to determine the state of the mode select signal may include a relation between a current value of one or more of the following parameters to a corresponding threshold value: a difference or ratio between energy of source signal S20 and energy of noise reference S30; a difference or ratio between energy of noise reference S20 and energy of one or more channels of sensed audio signal S10; a correlation between source signal S20 and noise reference S30; a likelihood that source signal S20 is carrying speech, as indicated by one or more statistical metrics of source signal S20 (e.g., kurtosis, autocorrelation). In such cases, a current value of the energy of a signal may be calculated as a sum of squared sample values of a block of consecutive samples (e.g., the current frame) of the signal.

Figure 36:
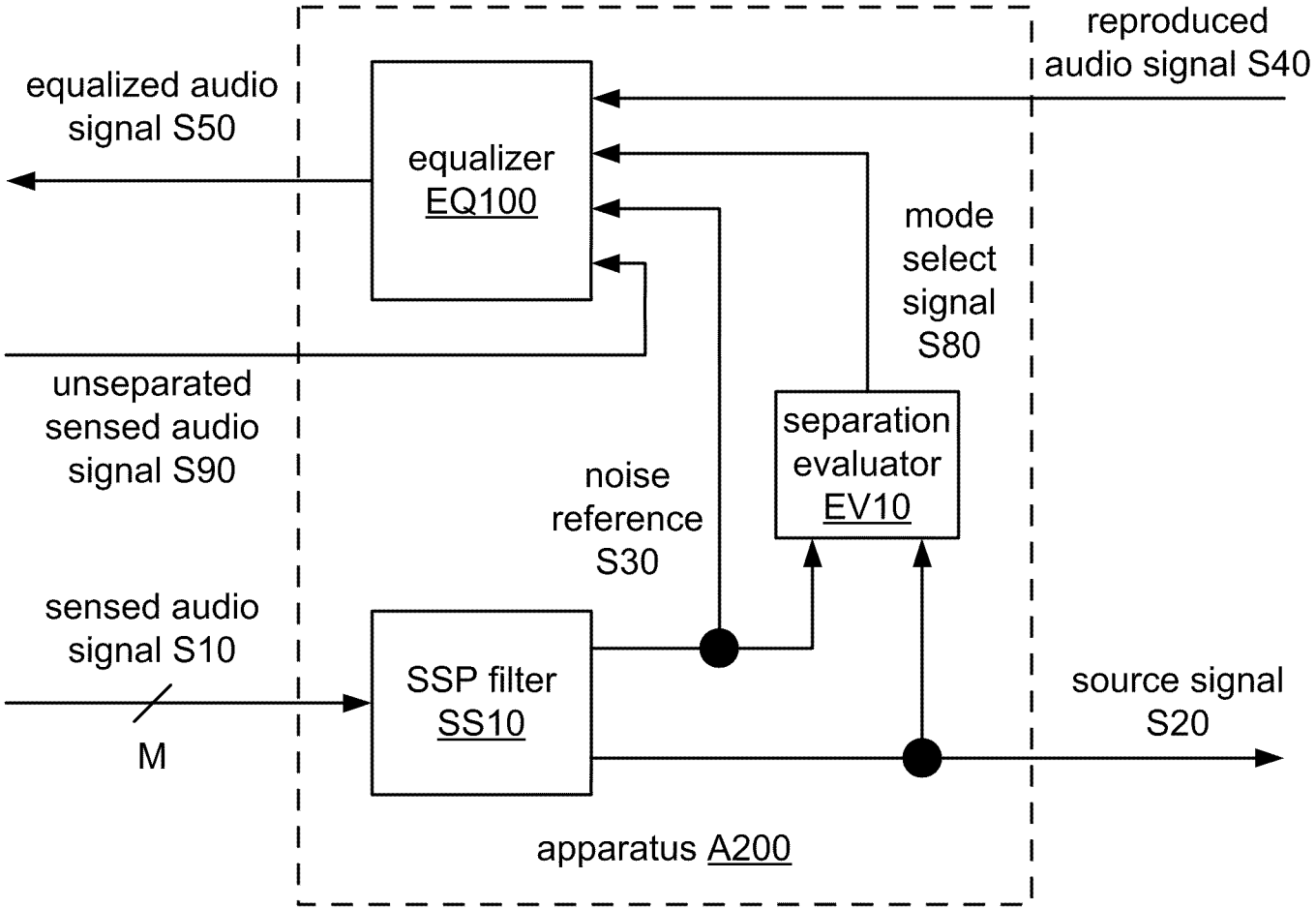
FIG. 36 shows a block diagram of an implementation A200 of apparatus A100 that includes a separation evaluator EV10.

FIG. 36 shows a block diagram of such an implementation A200 of apparatus A100 that includes a separation evaluator EV10 configured to produce a mode select signal S80 based on information from source signal S20 and noise reference S30 (e.g., based on a difference or ratio between energy of source signal S20 and energy of noise reference S30). Such a separation evaluator may be configured to produce mode select signal S80 to have a first state, indicating a multichannel mode, when it determines that SSP filter SS10 has sufficiently separated a desired sound component (e.g., the user's voice) into source signal S20 and to have a second state, indicating a single-channel mode, otherwise. In one such example, separation evaluator EV10 is configured to indicate sufficient separation when it determines that a difference between a current energy of source signal S20 and a current energy of noise reference S30 exceeds (alternatively, is not less than) a corresponding threshold value. In another such example, separation evaluator EV10 is configured to indicate sufficient separation when it determines that a correlation between a current frame of source signal S20 and a current frame of noise reference S30 is less than (alternatively, does not exceed) a corresponding threshold value.

Apparatus A200 also includes an implementation EQ100 of equalizer EQ10. Equalizer EQ100 is configured to operate in a multichannel mode (e.g., according to any of the implementations of equalizer EQ10 disclosed above) when mode select signal S80 has the first state and to operate in a single-channel mode when mode select signal S80 has the second state. In the single-channel mode, equalizer EQ100 is configured to calculate the subband gain factor values G(1) to G(q) based on a set of subband power estimates from an unseparated sensed audio signal S90. Equalizer EQ100 may be arranged to receive unseparated sensed audio signal S90 from a time-domain buffer. In one such example, the time-domain buffer has a length of ten milliseconds (e.g., eighty samples at a sampling rate of eight kHz, or 160 samples at a sampling rate of sixteen kHz).

Figure 37:
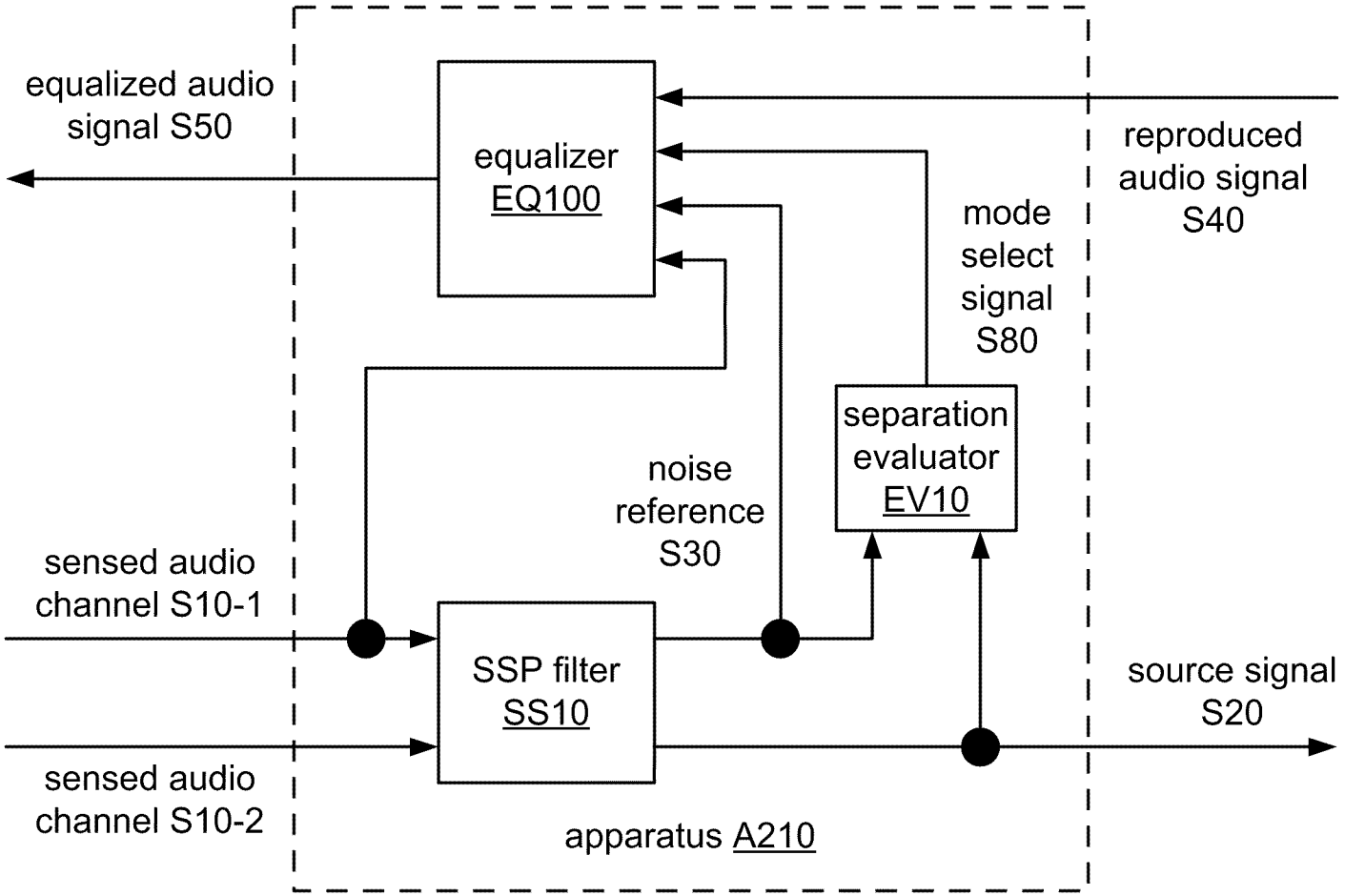
FIG. 37 shows a block diagram of an implementation A210 of apparatus A200.

Apparatus A200 may be implemented such that unseparated sensed audio signal S90 is one of sensed audio channels S10-1 and S10-2. FIG. 37 shows a block diagram of such an implementation A210 of apparatus A200 in which unseparated sensed audio signal S90 is sensed audio channel S10-1. In such cases, it may be desirable for apparatus A200 to receive sensed audio channel S10 via an echo canceller or other audio preprocessing stage that is configured to perform an echo cancellation operation on the microphone signals, such as an instance of audio preprocessor AP20. In a more general implementation of apparatus A200, unseparated sensed audio signal S90 is an unseparated microphone signal, such as either of microphone signals SM10-1 and SM10-2 or either of microphone signals DM10-1 and DM10-2, as described above.

Apparatus A200 may be implemented such that unseparated sensed audio signal S90 is the particular one of sensed audio channels S10-1 and S10-2 that corresponds to a primary microphone of the communications device (e.g., a microphone that usually receives the user's voice most directly). Alternatively, apparatus A200 may be implemented such that unseparated sensed audio signal S90 is the particular one of sensed audio channels S10-1 and S10-2 that corresponds to a secondary microphone of the communications device (e.g., a microphone that usually receives the user's voice only indirectly). Alternatively, apparatus A200 may be implemented to obtain unseparated sensed audio signal S90 by mixing sensed audio channels S10-1 and S10-2 down to a single channel. In a further alternative, apparatus A200 may be implemented to select unseparated sensed audio signal S90 from among sensed audio channels S10-1 and S10-2 according to one or more criteria such as highest signal-to-noise ratio, greatest speech likelihood (e.g., as indicated by one or more statistical metrics), the current operating configuration of the communications device, and/or the direction from which the desired source signal is determined to originate. (In a more general implementation of apparatus A200, the principles described in this paragraph may be used to obtain unseparated sensed audio signal S90 from a set of two or more microphone signals, such as microphone signals SM10-1 and SM10-2 or microphone signals DM10-1 and DM10-2 as described above.) As discussed above, it may be desirable to obtain unseparated sensed audio signal S90 from one or more microphone signals that have undergone an echo cancellation operation (e.g., as described above with reference to audio preprocessor AP20 and echo canceller EC10).

Figure 38:
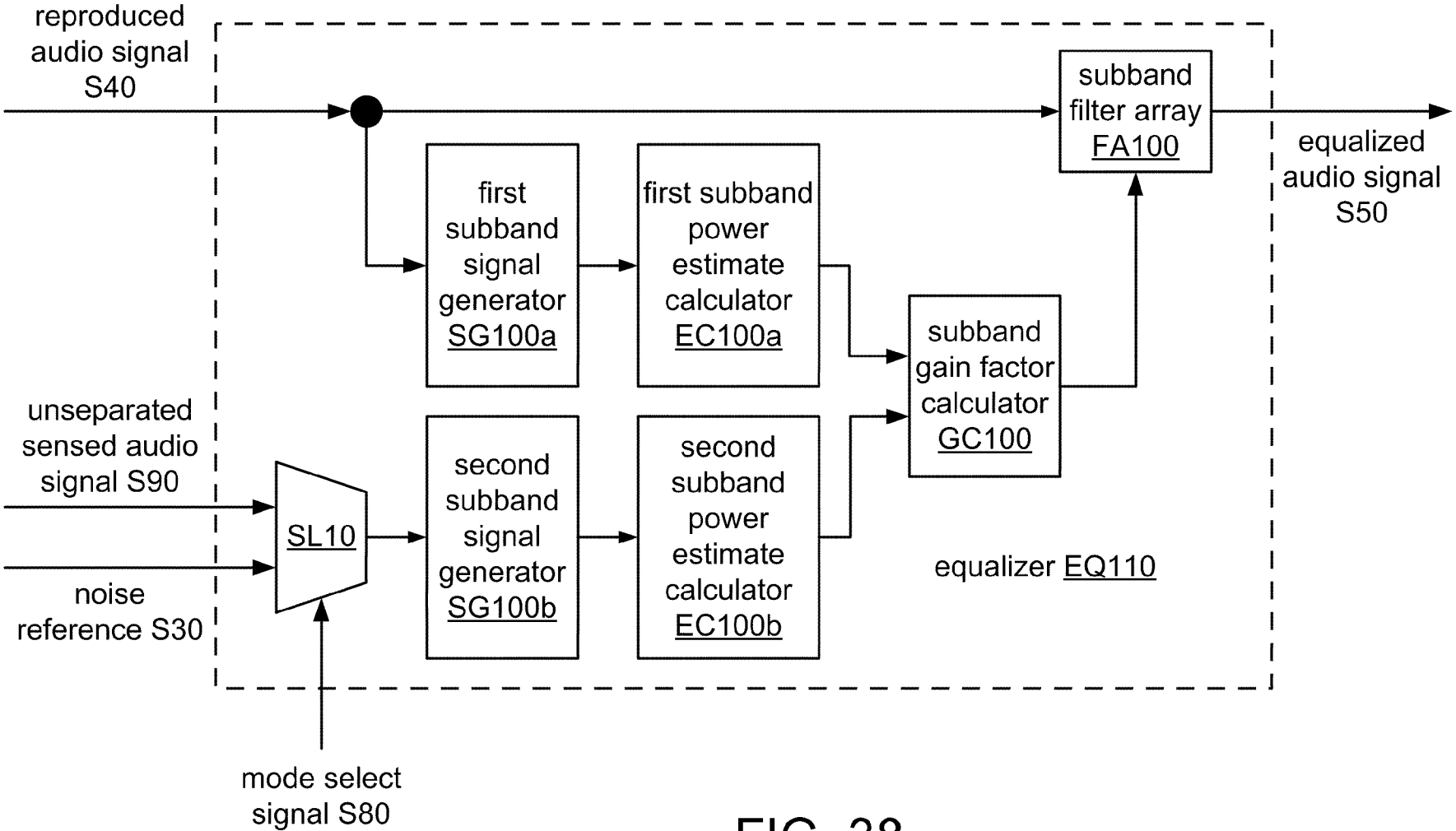
FIG. 38 shows a block diagram of an implementation EQ110 of equalizer EQ100 (and of equalizer EQ20).

Equalizer EQ100 may be configured to generate the set of second subband signals based on one among noise reference S30 and unseparated sensed audio signal S90, according to the state of mode select signal S80. FIG. 38 shows a block diagram of such an implementation EQ110 of equalizer EQ100 (and of equalizer EQ20) that includes a selector SL10 (e.g., a demultiplexer) configured to select one among noise reference S30 and unseparated sensed audio signal S90 according to the current state of mode select signal S80.

Figure 39:
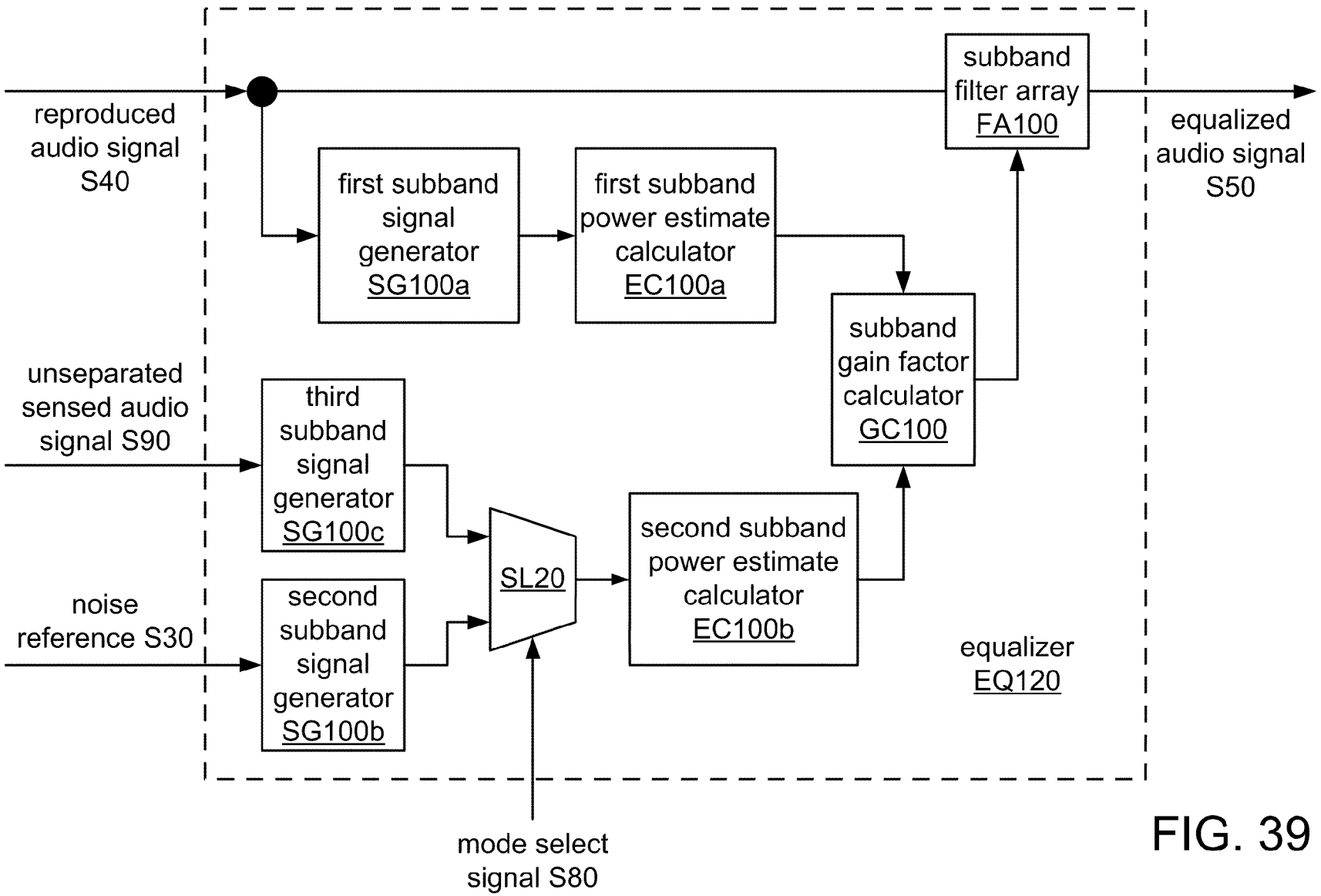
FIG. 39 shows a block diagram of an implementation EQ120 of equalizer EQ100 (and of equalizer EQ20).

Alternatively, equalizer EQ100 may be configured to select among different sets of subband signals, according to the state of mode select signal S80, to generate the set of second subband power estimates. FIG. 39 shows a block diagram of such an implementation EQ120 of equalizer EQ100 (and of equalizer EQ20) that includes a third subband signal generator SG100*c* and a selector SL20. Third subband signal generator SG100*c*, which may be implemented as an instance of subband signal generator SG200 or as an instance of subband signal generator SG300, is configured to generate a set of subband signals that is based on unseparated sensed audio signal S90. Selector SL20 (e.g., a demultiplexer) is configured to select, according to the current state of mode select signal S80, one among the sets of subband signals generated by second subband signal generator SG100*b* and third subband signal generator SG100*c*, and to provide the selected set of subband signals to second subband power estimate calculator EC100*b* as the second set of subband signals.

Figure 40:
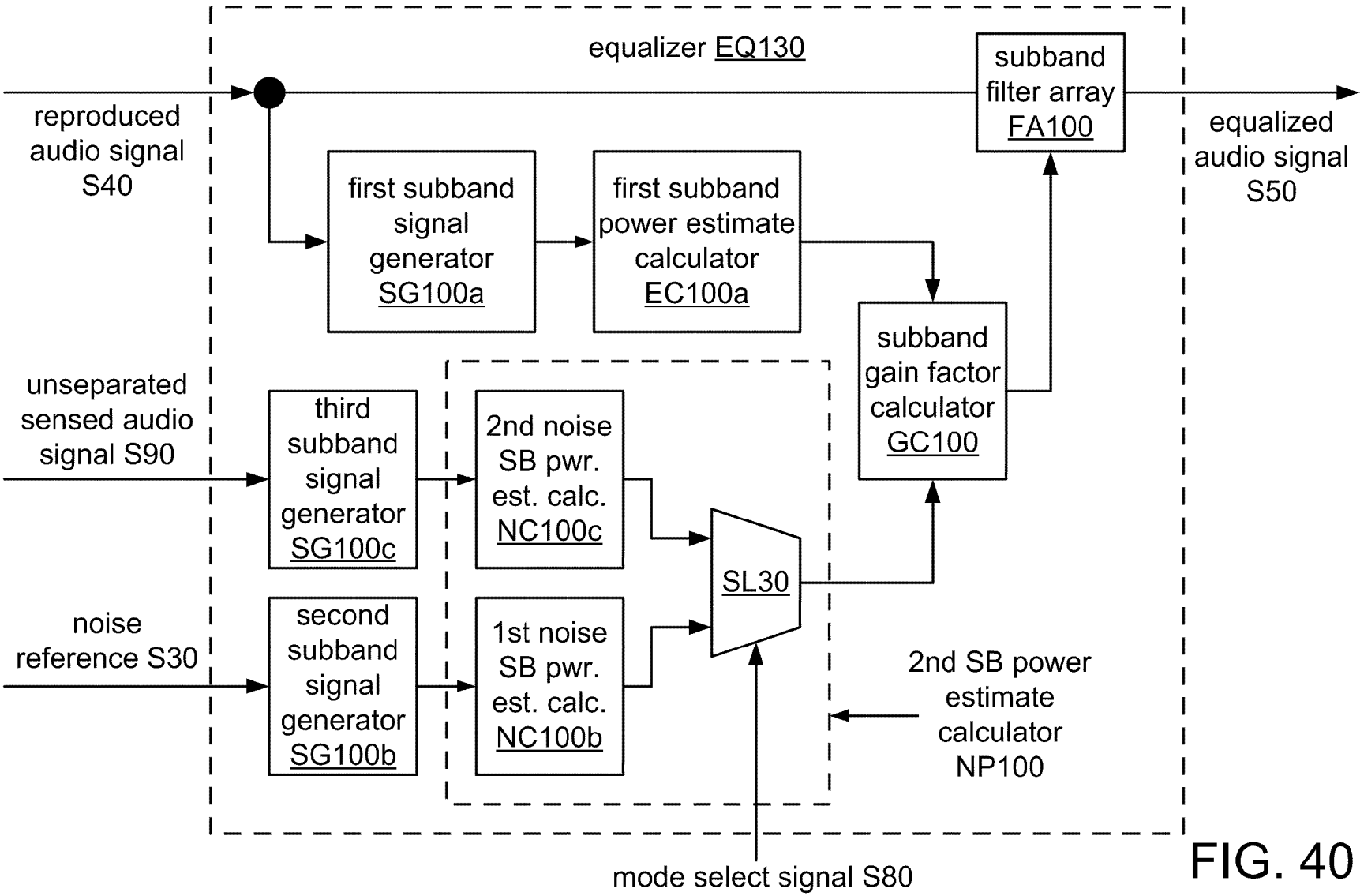
FIG. 40 shows a block diagram of an implementation EQ130 of equalizer EQ100 (and of equalizer EQ20).

In a further alternative, equalizer EQ100 is configured to select among different sets of noise subband power estimates, according to the state of mode select signal S80, to generate the set of subband gain factors. FIG. 40 shows a block diagram of such an implementation EQ130 of equalizer EQ100 (and of equalizer EQ20) that includes third subband signal generator SG100*c* and a second subband power estimate calculator NP100. Calculator NP100 includes a first noise subband power estimate calculator NC100*b*, a second noise subband power estimate calculator NC100*c*, and a selector SL30. First noise subband power estimate calculator NC100*b* is configured to generate a first set of noise subband power estimates that is based on the set of subband signals produced by second subband signal generator SG100*b* as described above. Second noise subband power estimate calculator NC100*c* is configured to generate a second set of noise subband power estimates that is based on the set of subband signals produced by third subband signal generator SG100*c* as described above. For example, equalizer EQ130 may be configured to evaluate subband power estimates for each of the noise references in parallel. Selector SL30 (e.g., a demultiplexer) is configured to select, according to the current state of mode select signal S80, one among the sets of noise subband power estimates generated by first noise subband power estimate calculator NC100*b* and second noise subband power estimate calculator NC100*c*, and to provide the selected set of noise subband power estimates to subband gain factor calculator GC100 as the second set of subband power estimates.

Figure 41B:
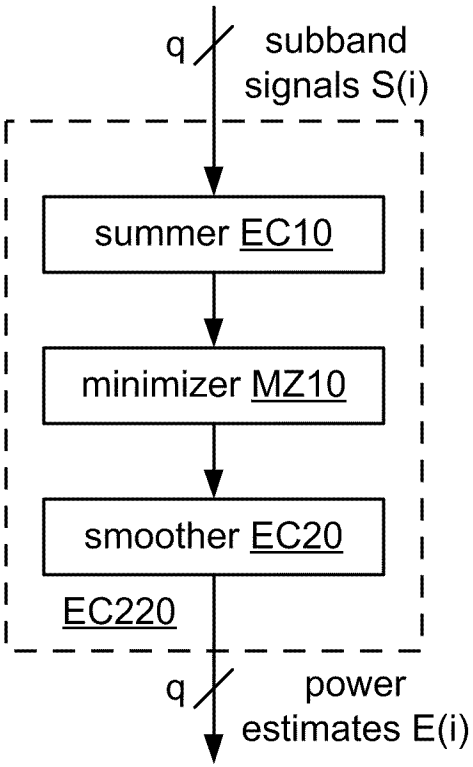
FIG. 41B shows a block diagram of subband signal generator EC220.
Figure 41A:
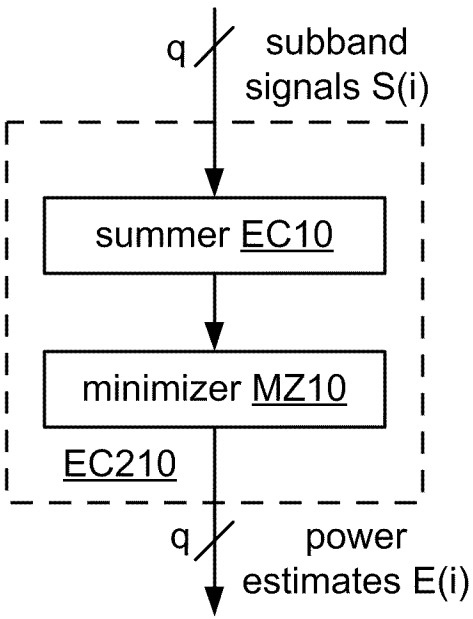
FIG. 41A shows a block diagram of subband signal generator EC210.

First noise subband power estimate calculator NC100*b* may be implemented as an instance of subband power estimate calculator EC110 or as an instance of subband power estimate calculator EC120. Second noise subband power estimate calculator NC100*c* may also be implemented as an instance of subband power estimate calculator EC110 or as an instance of subband power estimate calculator EC120. Second noise subband power estimate calculator NC100*c* may also be further configured to identify the minimum of the current subband power estimates for unseparated sensed audio signal S90 and to replace the other current subband power estimates for unseparated sensed audio signal S90 with this minimum. For example, second noise subband power estimate calculator NC100*c* may be implemented as an instance of subband signal generator EC210 as shown in FIG. 41A. Subband signal generator EC210 is an implementation of subband signal generator EC110 as described above that includes a minimizer MZ10 configured to identify and apply the minimum subband power estimate according to an expression such as $$E(i,k) \leftarrow \min_{1 \le i \le q} E(i,k)$$

for $1 \leqq i \leqq q$. Alternatively, second noise subband power estimate calculator NC100*c* may be implemented as an instance of subband signal generator EC220 as shown in FIG. 41B. Subband signal generator EC220 is an implementation of subband signal generator EC120 as described above that includes an instance of minimizer MZ10.

Figure 42:
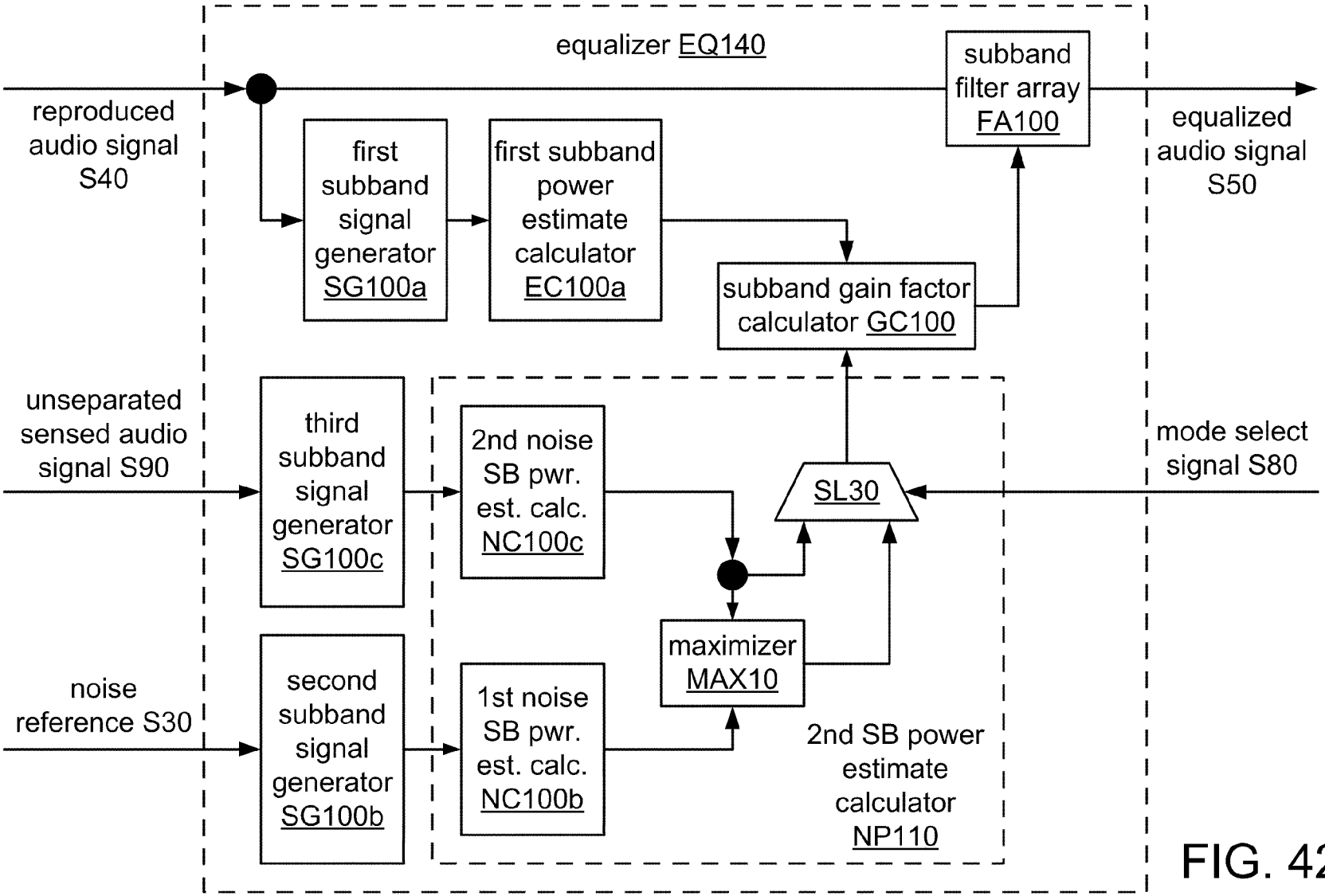
FIG. 42 shows a block diagram of an implementation EQ140 of equalizer EQ130.

It may be desirable to configure equalizer EQ130 to calculate subband gain factor values based on subband power estimates from unseparated sensed audio signal S90 as well as on subband power estimates from noise reference S30 when operating in the multichannel mode. FIG. 42 shows a block diagram of such an implementation EQ140 of equalizer EQ130. Equalizer EQ140 includes an implementation NP110 of second subband power estimate calculator NP10 that includes a maximizer MAX10. Maximizer MAX10 is configured to calculate a set of subband power estimates according to an expression such as $$E(i,k) \leftarrow \max(E_b(i,k), E_c(i,k))$$

for $1 \leqq i \leqq q$, where $E_b(i,k)$ denotes the subband power estimate calculated by first noise subband power estimate calculator EC100*b* for subband i and frame k, and $E_c(i,k)$ denotes the subband power estimate calculated by second noise subband power estimate calculator EC100*c* for subband i and frame k.

Figure 43A:
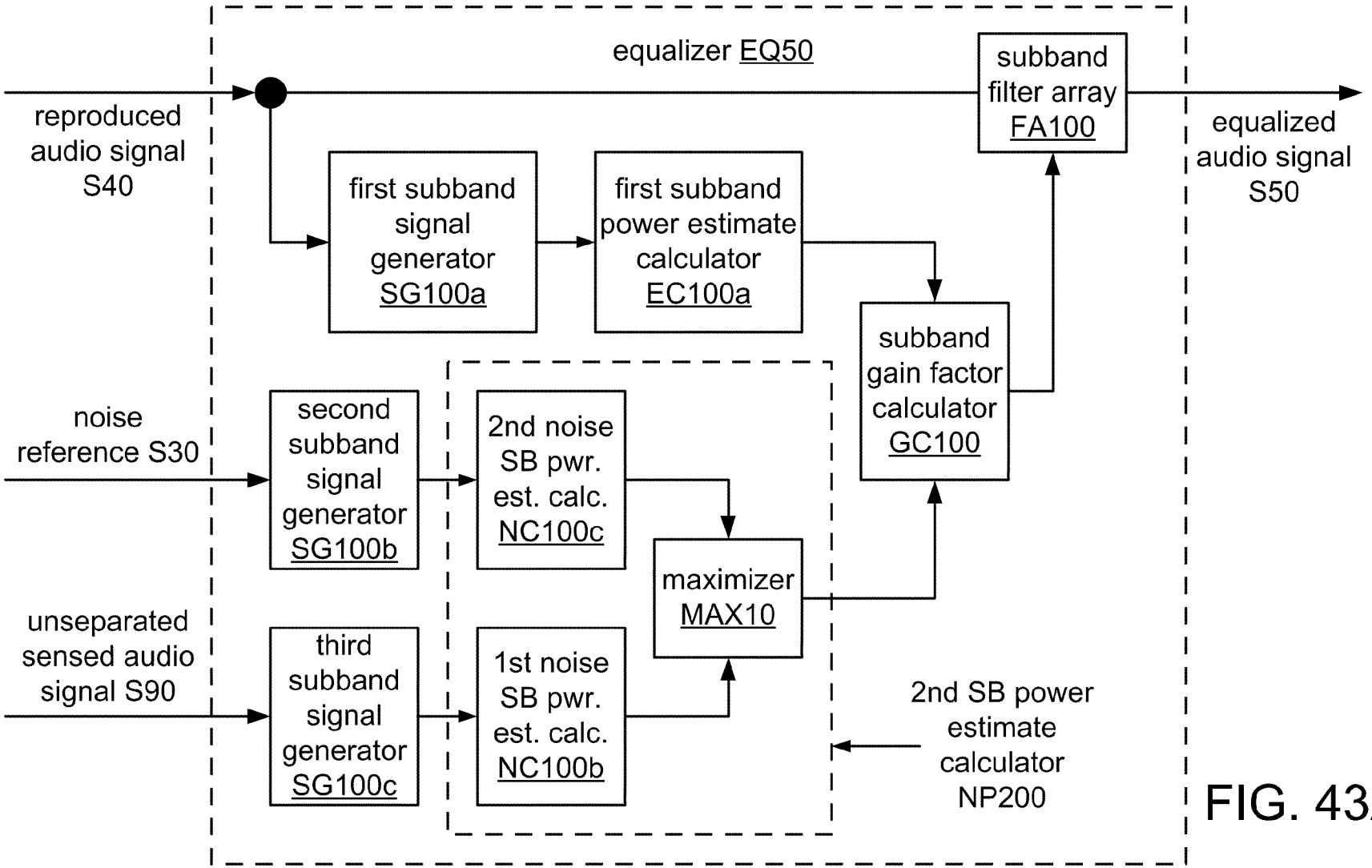
FIG. 43A shows a block diagram of an implementation EQ50 of equalizer EQ20.

It may be desirable for an implementation of apparatus A100 to operate in a mode that combines noise subband power information from single-channel and multichannel noise references. While a multichannel noise reference may support a dynamic response to nonstationary noise, the resulting operation of the apparatus may be overly reactive to changes, for example, in the user's position. A single-channel noise reference may provide a response that is more stable but lacks the ability to compensate for nonstationary noise. FIG. 43A shows a block diagram of an implementation EQ50 of equalizer EQ20 that is configured to equalize reproduced audio signal S40 based on information from noise reference S30 and on information from unseparated sensed audio signal S90. Equalizer EQ50 includes an implementation NP200 of second subband power estimate calculator NP100 that includes an instance of maximizer MAX10 configured as disclosed above.

Calculator NP200 may also be implemented to allow independent manipulation of the gains of the single-channel and multichannel noise subband power estimates. For example, it may be desirable to implement calculator NP200 to apply a gain factor (or a corresponding one of a set of gain factors) to scale each of one or more (possibly all) of the noise subband power estimates produced by first subband power estimate calculator NC100*b* or second subband power estimate calculator NC100*c* such that the scaled subband power estimate values are used in the maximization operation performed by maximizer MAX10.

At some times during the operation of a device that includes an implementation of apparatus A100, it may be desirable for the apparatus to equalize reproduced audio signal S40 according to information from a reference other than noise reference S30. For a situation in which a desired sound component (e.g., the user's voice) and a directional noise component (e.g., from an interfering speaker, a public address system, a television or radio) arrive at the microphone array from the same direction, for example, a directional processing operation may provide inadequate separation of these components. For example, the directional processing operation may separate the directional noise component into the source signal, such that the resulting noise reference may be inadequate to support the desired equalization of the reproduced audio signal.

It may be desirable to implement apparatus A100 to apply results of both a directional processing operation and a distance processing operation as disclosed herein. For example, such an implementation may provide improved equalization performance for a case in which a near-field desired sound component (e.g., the user's voice) and a far-field directional noise component (e.g., from an interfering speaker, a public address system, a television or radio) arrive at the microphone array from the same direction.

Figure 43B:
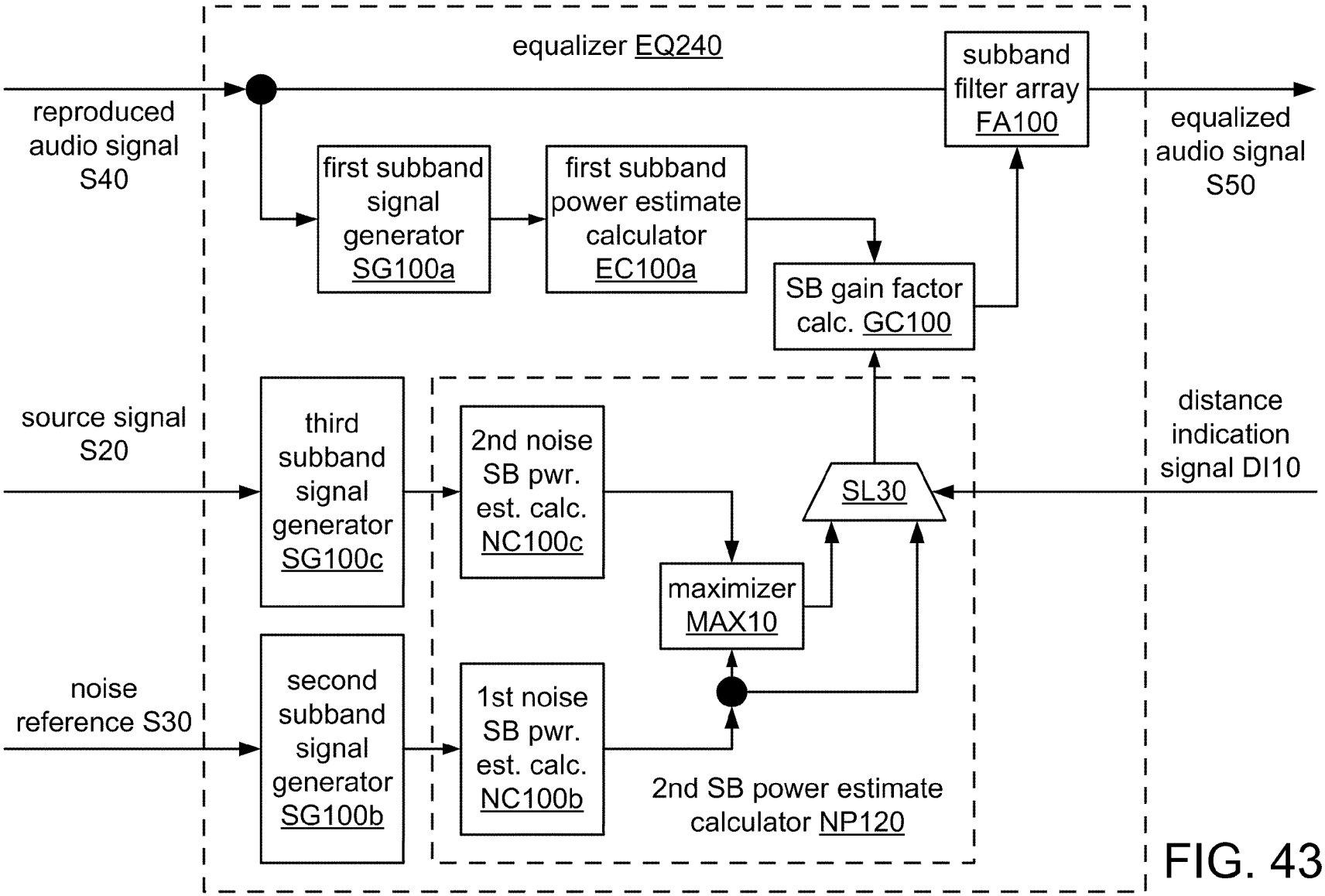
FIG. 43B shows a block diagram of an implementation EQ240 of equalizer EQ20.

It may be desirable to implement apparatus A100 to boost at least one subband of reproduced audio signal S40 relative to another subband of reproduced audio signal S40 according to noise subband power estimates that are based on information from noise reference S30 and on information from source signal S20. FIG. 43B shows a block diagram of such an implementation EQ240 of equalizer EQ20 that is configured to process source signal S20 as a second noise reference. Equalizer EQ240 includes an implementation NP120 of second subband power estimate calculator NP100 that includes an instance of maximizer MAX10 that is configured as disclosed herein. In this implementation, selector SL30 is arranged to receive distance indication signal DI10 as produced by an implementation of SSP filter SS10 as disclosed herein. Selector SL30 is arranged to select the output of maximizer MAX10 when the current state of distance indication signal DI10 indicates a far-field signal, and to select the output of first noise subband power estimate calculator EC100*b* otherwise.

(It is expressly disclosed that apparatus A100 may also be implemented to include an instance of an implementation of equalizer EQ100 as disclosed herein such that the equalizer is configured to receive source signal S20 as a second noise reference instead of unseparated sensed audio signal S90.)

Figure 43C:
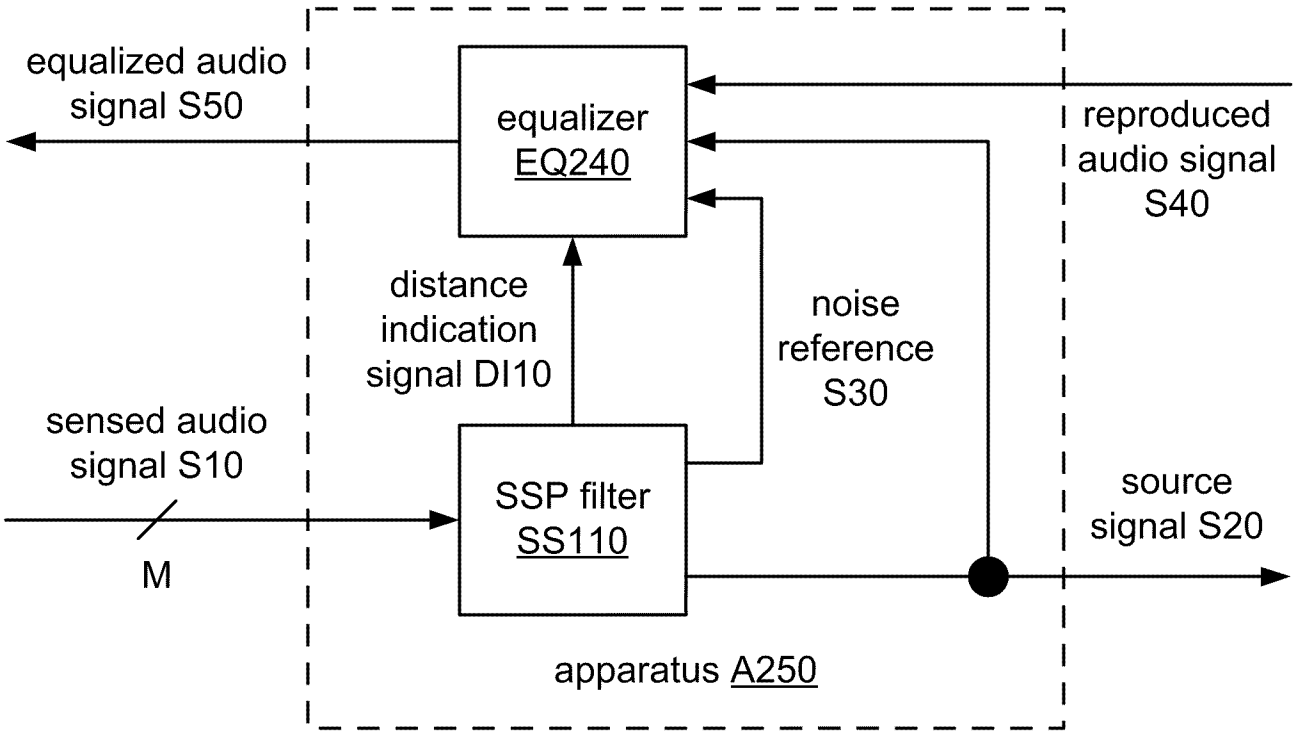
FIG. 43C shows a block diagram of an implementation A250 of apparatus A100.
Figure 43D:
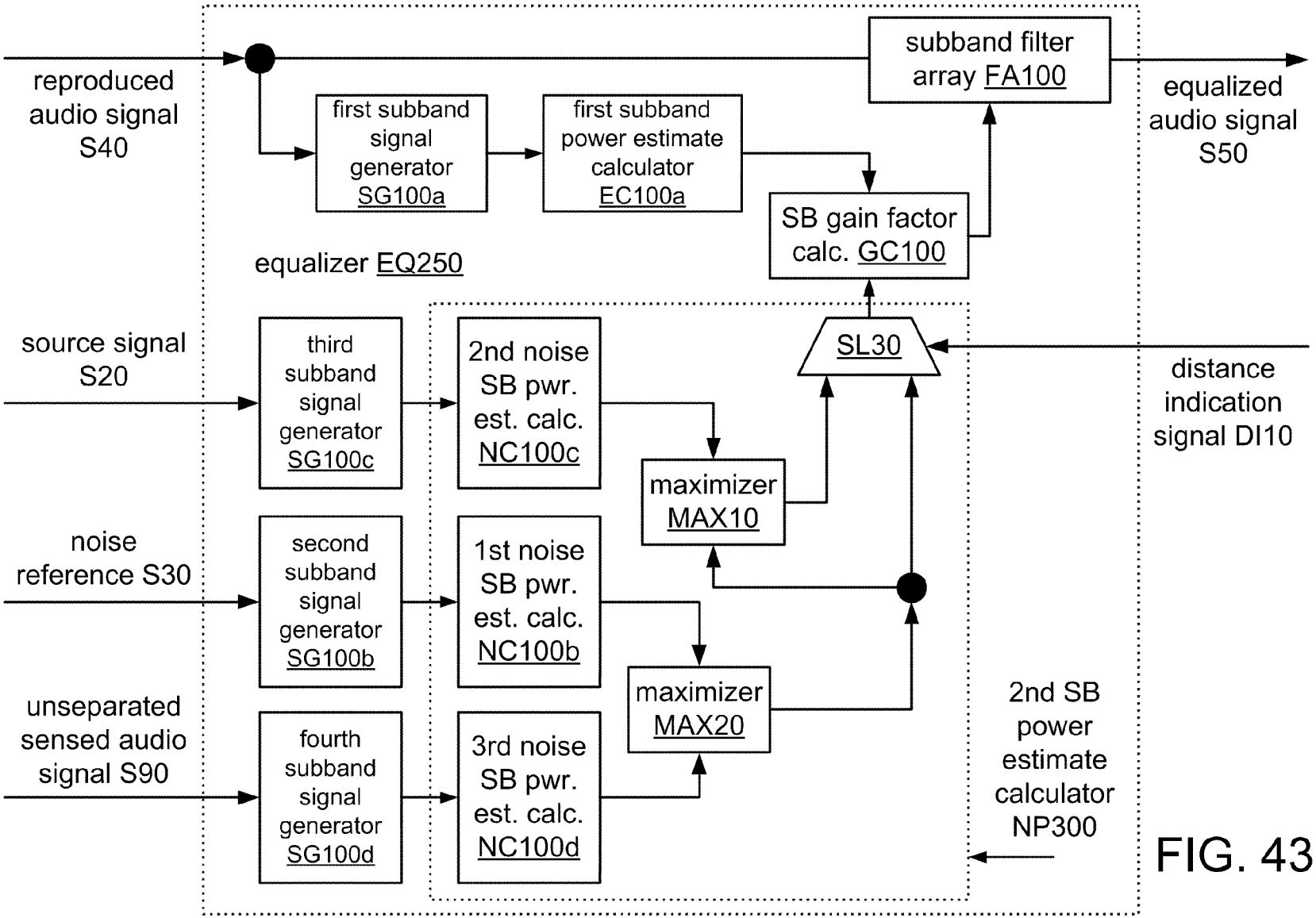
FIG. 43D shows a block diagram of an implementation EQ250 of equalizer EQ240.

FIG. 43C shows a block diagram of an implementation A250 of apparatus A100 that includes SSP filter SS110 and equalizer EQ240 as disclosed herein. FIG. 43D shows a block diagram of an implementation EQ250 of equalizer EQ240 that combines support for compensation of far-field nonstationary noise (e.g., as disclosed herein with reference to equalizer EQ240) with noise subband power information from both single-channel and multichannel noise references (e.g., as disclosed herein with reference to equalizer EQ50). In this example, the second subband power estimates are based on three different noise estimates: an estimate of stationary noise from unseparated sensed audio signal S90 (which may be heavily smoothed and/or smoothed over a long term, such as more than five frames), an estimate of far-field nonstationary noise from source signal S20 (which may be unsmoothed or only minimally smoothed), and noise reference S30 which may be direction-based. It is reiterated that in any application of unseparated sensed audio signal S90 as a noise reference that is disclosed herein (e.g., as illustrated in FIG. 43D), a smoothed noise estimate from source signal S20 (e.g., a heavily smoothed estimate and/or a long-term estimate that is smoothed over several frames) may be used instead.

It may be desirable to configure equalizer EQ100 (or equalizer EQ50 or equalizer EQ240) to update the single-channel subband noise power estimates only during intervals in which unseparated sensed audio signal S90 (alternatively, sensed audio signal S10) is inactive. Such an implementation of apparatus A100 may include a voice activity detector (VAD) that is configured to classify a frame of unseparated sensed audio signal S90 (or of sensed audio signal S10) as active (e.g., speech) or inactive (e.g., noise) based on one or more factors such as frame energy, signal-to-noise ratio, periodicity, autocorrelation of speech and/or residual (e.g., linear prediction coding residual), zero crossing rate, and/or first reflection coefficient. Such classification may include comparing a value or magnitude of such a factor to a threshold value and/or comparing the magnitude of a change in such a factor to a threshold value. It may be desirable to implement this VAD to perform voice activity detection based on multiple criteria (e.g., energy, zero-crossing rate, etc.) and/or a memory of recent VAD decisions.

Figure 44:
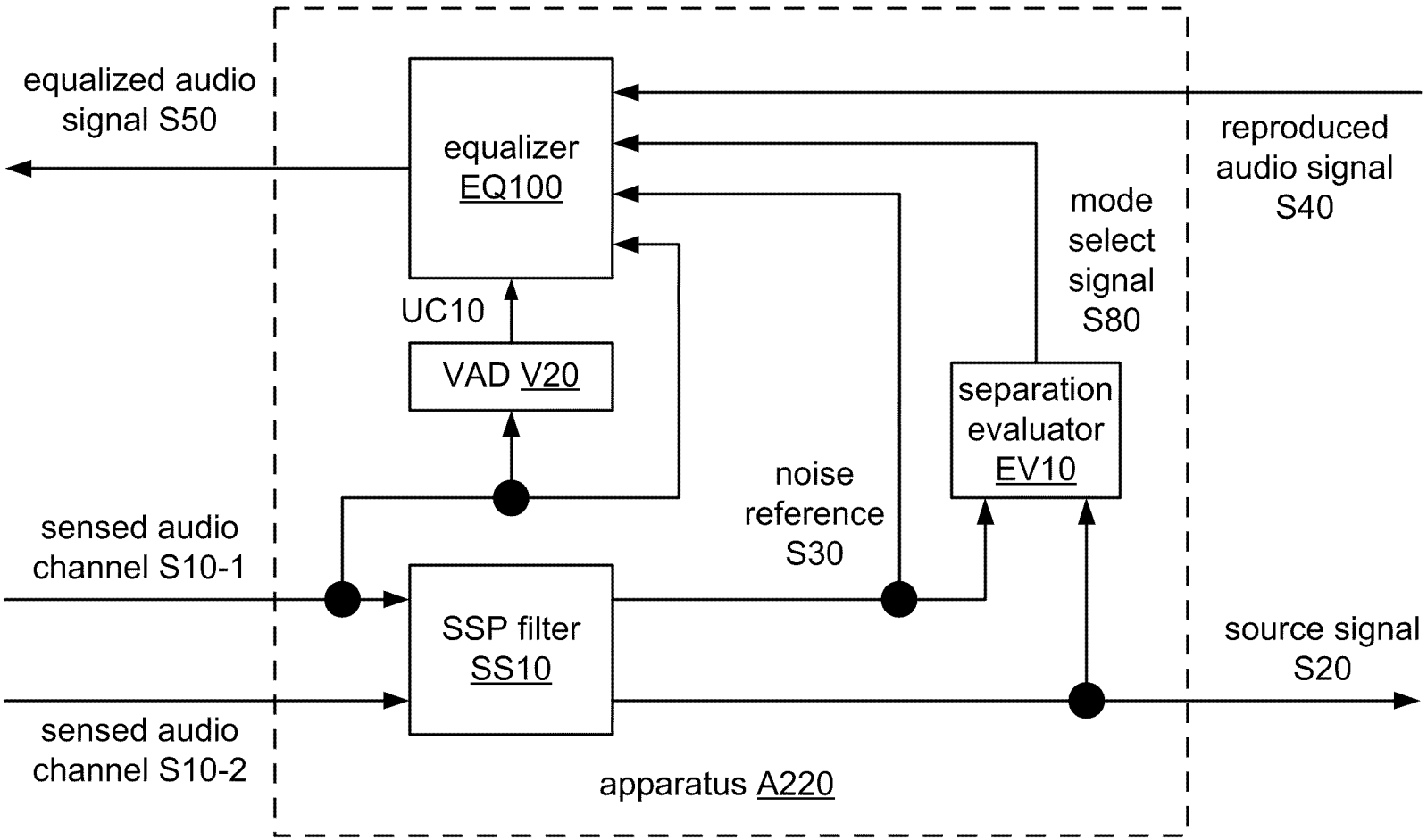
FIG. 44 shows an implementation A220 of apparatus A200 that includes a voice activity detector V20.

FIG. 44 shows such an implementation A220 of apparatus A200 that includes such a voice activity detector (or "VAD") V20. Voice activity detector V20, which may be implemented as an instance of VAD V10 as described above, is configured to produce an update control signal UC10 whose state indicates whether speech activity is detected on sensed audio channel S10-1. For a case in which apparatus A220 includes an implementation EQ110 of equalizer EQ100 as shown in FIG. 38, update control signal UC10 may be applied to prevent second subband signal generator SG100*b* from updating its output during intervals (e.g., frames) when speech is detected on sensed audio channel S10-1 and a single-channel mode is selected. For a case in which apparatus A220 includes an implementation EQ110 of equalizer EQ100 as shown in FIG. 38 or an implementation EQ120 of equalizer EQ100 as shown in FIG. 39, update control signal UC10 may be applied to prevent second subband power estimate generator EC100*b* from updating its output during intervals (e.g., frames) when speech is detected on sensed audio channel S10-1 and a single-channel mode is selected.

For a case in which apparatus A220 includes an implementation EQ120 of equalizer EQ100 as shown in FIG. 39, update control signal UC10 may be applied to prevent third subband signal generator SG100*c* from updating its output during intervals (e.g., frames) when speech is detected on sensed audio channel S10-1. For a case in which apparatus A220 includes an implementation EQ130 of equalizer EQ100 as shown in FIG. 40 or an implementation EQ140 of equalizer EQ100 as shown in FIG. 41, or for a case in which apparatus A100 includes an implementation EQ40 of equalizer EQ100 as shown in FIG. 43, update control signal UC10 may be applied to prevent third subband signal generator SG100*c* from updating its output, and/or to prevent third subband power estimate generator EC100*c* from updating its output, during intervals (e.g., frames) when speech is detected on sensed audio channel S10-1.

Figure 45:
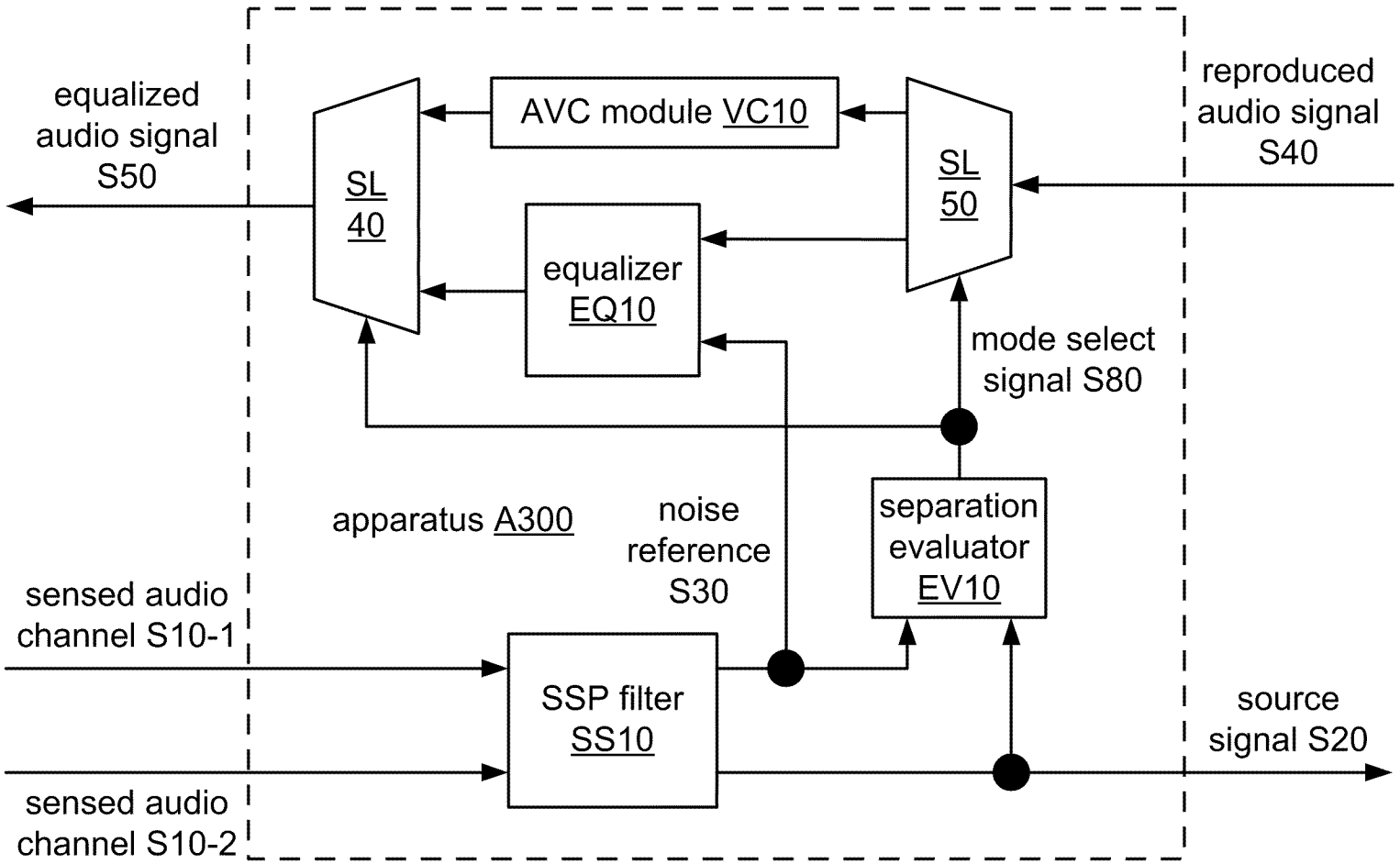
FIG. 45 shows a block diagram of an implementation A300 of apparatus A100.
Figure 46:
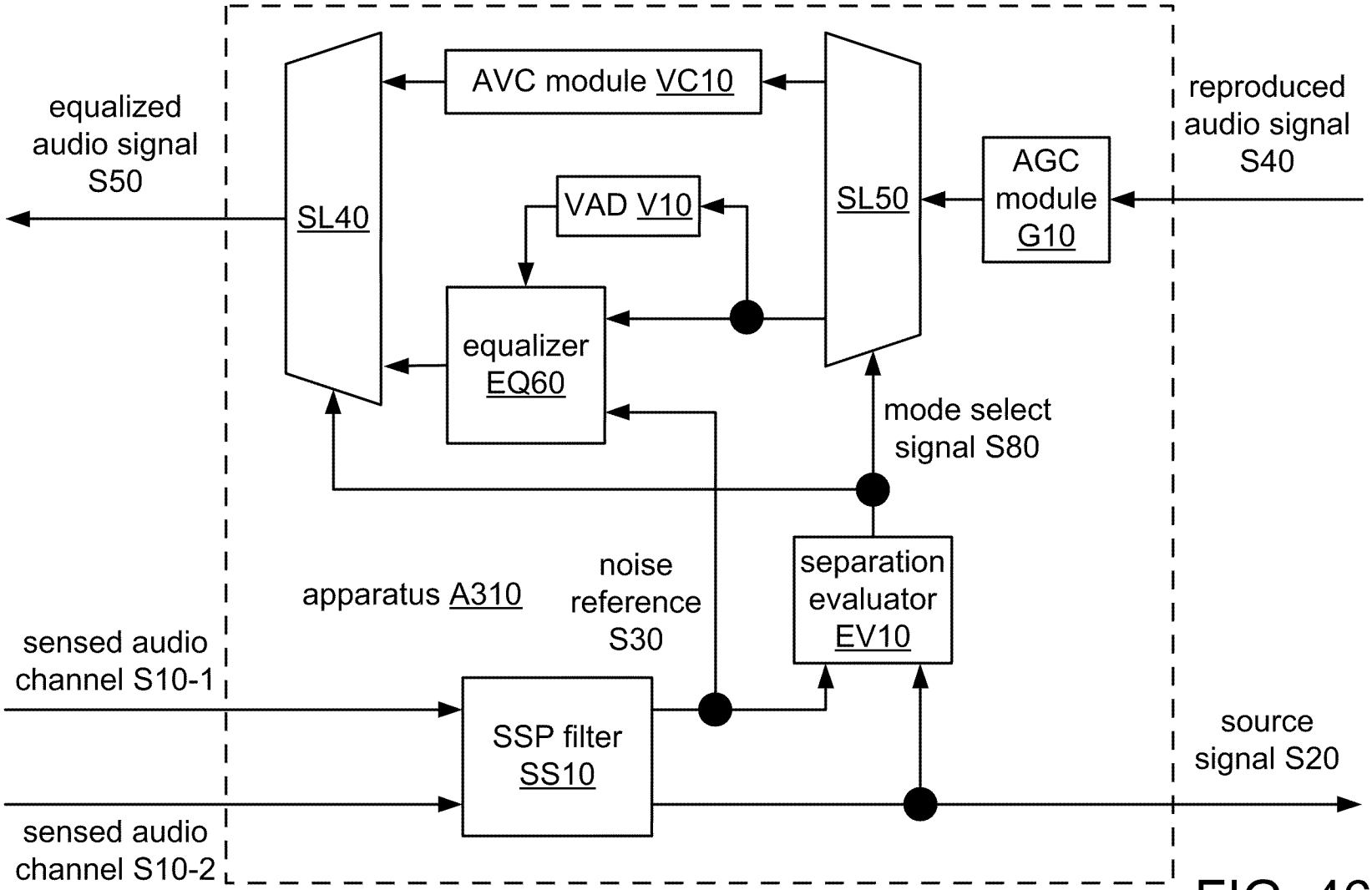
FIG. 46 shows a block diagram of an implementation A310 of apparatus A300.

FIG. 45 shows a block diagram of an alternative implementation A300 of apparatus A100 that is configured to operate in a single-channel mode or a multichannel mode according to the current state of a mode select signal. Like apparatus A200, apparatus A300 of apparatus A100 includes a separation evaluator (e.g., separation evaluator EV10) that is configured to generate a mode select signal S80. In this case, apparatus A300 also includes an automatic volume control (AVC) module VC10 that is configured to perform an AGC or AVC operation on reproduced audio signal S40, and mode select signal S80 is applied to control selectors SL40 (e.g., a multiplexer) and SL50 (e.g., a demultiplexer) to select one among AVC module VC10 and equalizer EQ10 for each frame according to a corresponding state of mode select signal S80. FIG. 46 shows a block diagram of an implementation A310 of apparatus A300 that also includes an implementation EQ60 of equalizer EQ30 and instances of AGC module G10 and VAD V10 as described herein. In this example, equalizer EQ60 is also an implementation of equalizer EQ40 as described above that includes an instance of peak limiter L10 arranged to limit the acoustic output level of the equalizer. (One of ordinary skill will understand that this and the other disclosed configurations of apparatus A300 may also be implemented using alternate implementations of equalizer EQ10 as disclosed herein, such as equalizer EQ50 or EQ240.)

Figure 47:
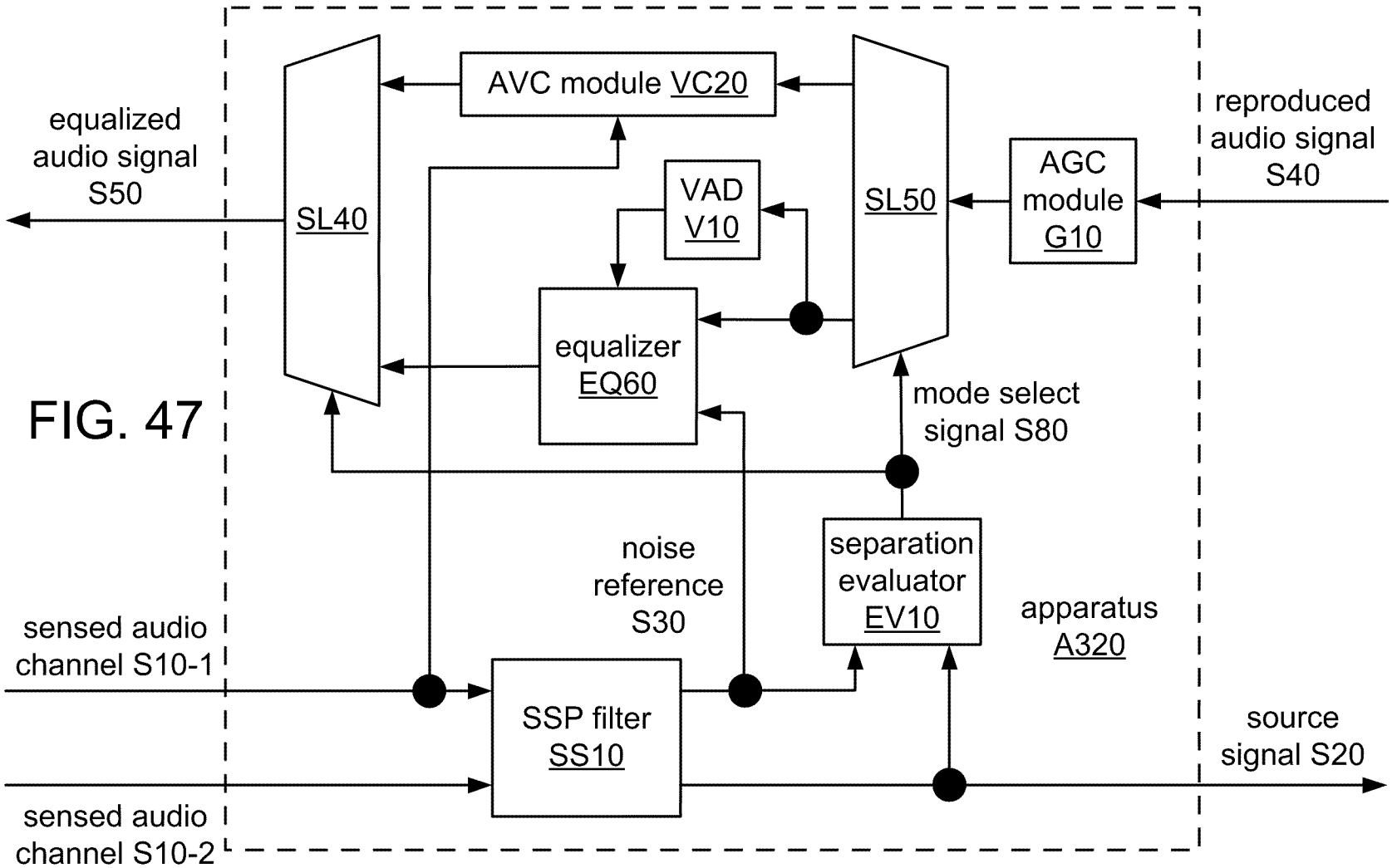
FIG. 47 shows a block diagram of an implementation A320 of apparatus A310.
Figure 48:
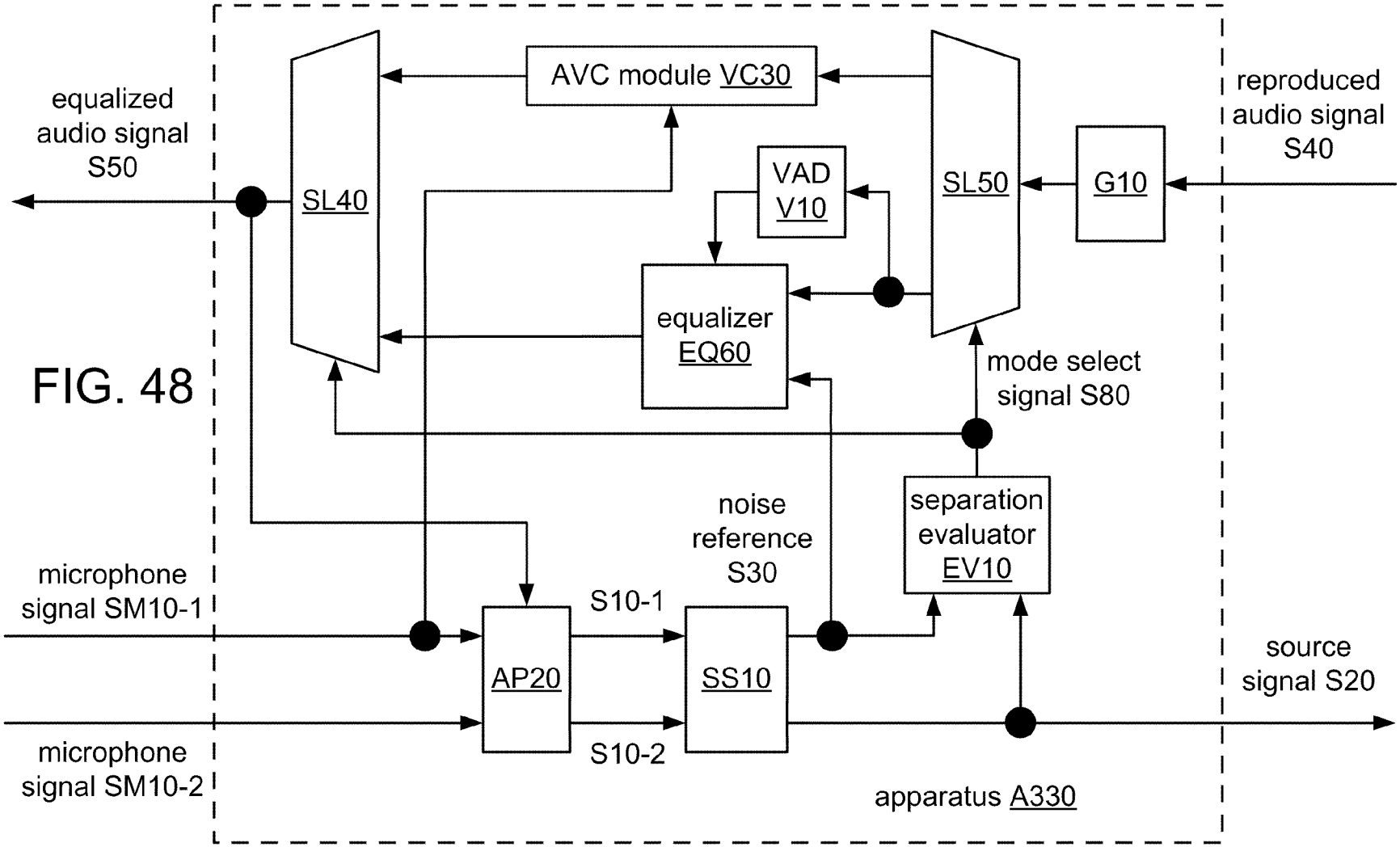
FIG. 48 shows a block diagram of an implementation A330 of apparatus A310.

An AGC or AVC operation controls a level of an audio signal based on a stationary noise estimate, which is typically obtained from a single microphone. Such an estimate may be calculated from an instance of unseparated sensed audio signal S90 as described herein (alternatively, sensed audio signal S10). For example, it may be desirable to configure AVC module VC10 to control a level of reproduced audio signal S40 according to the value of a parameter such as a power estimate of the unseparated sensed audio signal (e.g., energy, or sum of absolute values, of the current frame). As described above with reference to other power estimates, it may be desirable to configure AVC module VC10 to perform a temporal smoothing operation on such a parameter value and/or to update the parameter value only when the unseparated sensed audio signal does not currently contain voice activity. FIG. 47 shows a block diagram of an implementation A320 of apparatus A310 in which an implementation VC20 of AVC module VC10 is configured to control the volume of reproduced audio signal S40 according to information from sensed audio channel S10-1 (e.g., a current power estimate of signal S10-1). FIG. 48 shows a block diagram of an implementation A330 of apparatus A310 in which an implementation VC30 of AVC module VC10 is configured to control the volume of reproduced audio signal S40 according to information from microphone signal SM10-1 (e.g., a current power estimate of signal SM10-1).

Figure 49:
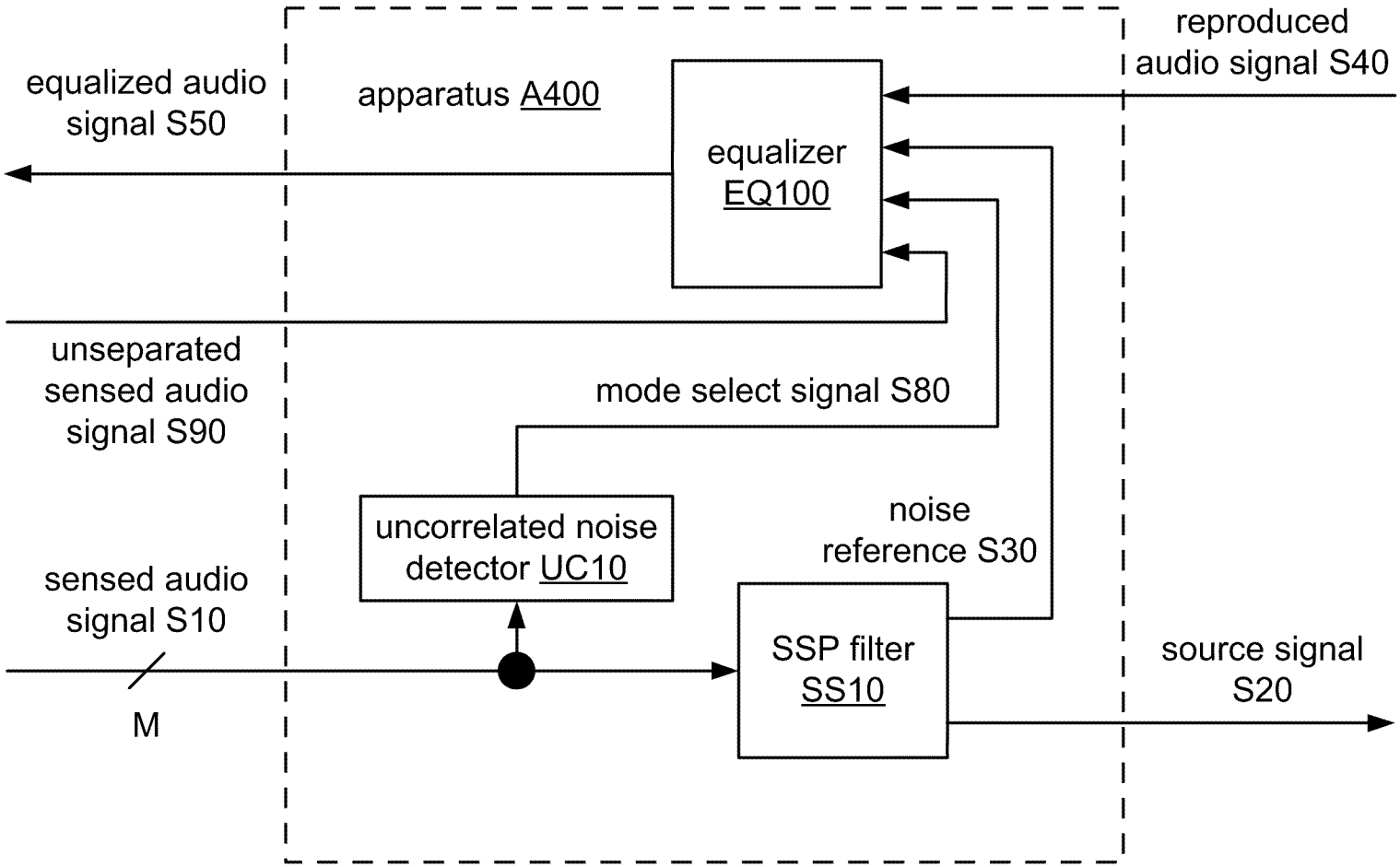
FIG. 49 shows a block diagram of an implementation A400 of apparatus A100.

FIG. 49 shows a block diagram of another implementation A400 of apparatus A100. Apparatus A400 includes an implementation of equalizer EQ100 as described herein and is similar to apparatus A200. In this case, however, mode select signal S80 is generated by an uncorrelated noise detector UC10. Uncorrelated noise, which is noise that affects one microphone of an array and not another, may include wind noise, breath sounds, scratching, and the like. Uncorrelated noise may cause an undesirable result in a multi-microphone signal separation system such as SSP filter SS10, as the system may actually amplify such noise if permitted. Techniques for detecting uncorrelated noise include estimating a cross-correlation of the microphone signals (or portions thereof, such as a band in each microphone signal from about 200 Hz to about 800 or 1000 Hz). Such cross-correlation estimation may include gain-adjusting the passband of a secondary microphone signal to equalize far-field response between the microphones, subtracting the gain-adjusted signal from the passband of the primary microphone signal, and comparing the energy of the difference signal to a threshold value (which may be adaptive based on the energy over time of the difference signal and/or of the primary microphone passband). Uncorrelated noise detector UC10 may be implemented according to such a technique and/or any other suitable technique. Detection of uncorrelated noise in a multiple-microphone device is also discussed in U.S. patent application Ser. No. 12/201,528, filed Aug. 29, 2008, entitled "SYSTEMS, METHODS, AND APPARATUS FOR DETECTION OF UNCORRELATED COMPONENT," which document is hereby incorporated by reference for purposes limited to disclosure of design, implementation, and/or integration of uncorrelated noise detector UC10.

Figure 50:
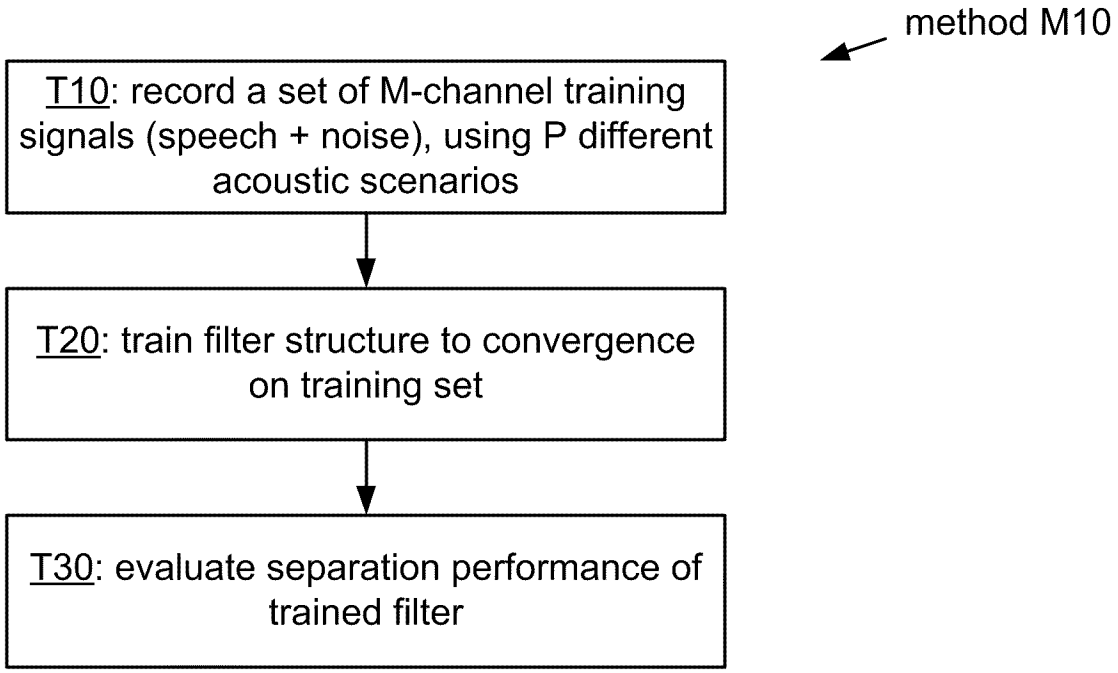
FIG. 50 shows a flowchart of a design method M10.

FIG. 50 shows a flowchart of a design method M10 that may be used to obtain the coefficient values that characterize one or more directional processing stages of SSP filter SS10. Method M10 includes a task T10 that records a set of multichannel training signals, a task T20 that trains a structure of SSP filter SS10 to convergence, and a task T30 that evaluates the separation performance of the trained filter. Tasks T20 and T30 are typically performed outside the audio reproduction device, using a personal computer or workstation. One or more of the tasks of method M10 may be iterated until an acceptable result is obtained in task T30. The various tasks of method M10 are discussed in more detail below, and additional description of these tasks is found in U.S. patent application Ser. No. 12/197,924, filed Aug. 25, 2008, entitled "SYSTEMS, METHODS, AND APPARATUS FOR SIGNAL SEPARATION," which document is hereby incorporated by reference for purposes limited to the design, implementation, training, and/or evaluation of one or more directional processing stages of SSP filter SS10.

Task T10 uses an array of at least M microphones to record a set of M-channel training signals such that each of the M channels is based on the output of a corresponding one of the M microphones. Each of the training signals is based on signals produced by this array in response to at least one information source and at least one interference source, such that each training signal includes both speech and noise components. It may be desirable, for example, for each of the training signals to be a recording of speech in a noisy environment. The microphone signals are typically sampled, may be pre-processed (e.g., filtered for echo cancellation, noise reduction, spectrum shaping, etc.), and may even be pre-separated (e.g., by another spatial separation filter or adaptive filter as described herein). For acoustic applications such as speech, typical sampling rates range from 8 kHz to 16 kHz.

Each of the set of M-channel training signals is recorded under one of P scenarios, where P may be equal to two but is generally any integer greater than one. As described below, each of the P scenarios may comprise a different spatial feature (e.g., a different handset or headset orientation) and/or a different spectral feature (e.g., the capturing of sound sources which may have different properties). The set of training signals includes at least P training signals that are each recorded under a different one of the P scenarios, although such a set would typically include multiple training signals for each scenario.

It is possible to perform task T10 using the same audio reproduction device that contains the other elements of apparatus A100 as described herein. More typically, however, task T10 would be performed using a reference instance of an audio reproduction device (e.g., a handset or headset). The resulting set of converged filter solutions produced by method M10 would then be copied into other instances of the same or a similar audio reproduction device during production (e.g., loaded into flash memory of each such production instance).

In such case, the reference instance of the audio reproduction device (the "reference device") includes the array of M microphones. It may be desirable for the microphones of the reference device to have the same acoustic response as those of the production instances of the audio reproduction device (the "production devices"). For example, it may be desirable for the microphones of the reference device to be the same model or models, and to be mounted in the same manner and in the same locations, as those of the production devices. Moreover, it may be desirable for the reference device to otherwise have the same acoustic characteristics as the production devices. It may even be desirable for the reference device to be as acoustically identical to the production devices as they are to one another. For example, it may be desirable for the reference device to be the same device model as the production devices. In a practical production environment, however, the reference device may be a pre-production version that differs from the production devices in one or more minor (i.e., acoustically unimportant) aspects. In a typical case, the reference device is used only for recording the training signals, such that it may not be necessary for the reference device itself to include the elements of apparatus A100.

The same M microphones may be used to record all of the training signals. Alternatively, it may be desirable for the set of M microphones used to record one of the training signals to differ (in one or more of the microphones) from the set of M microphones used to record another of the training signals. For example, it may be desirable to use different instances of the microphone array in order to produce a plurality of filter coefficient values that is robust to some degree of variation among the microphones. In one such case, the set of M-channel training signals includes signals recorded using at least two different instances of the reference device.

Each of the P scenarios includes at least one information source and at least one interference source. Typically each information source is a loudspeaker reproducing a speech signal or a music signal, and each interference source is a loudspeaker reproducing an interfering acoustic signal, such as another speech signal or ambient background sound from a typical expected environment, or a noise signal. The various types of loudspeaker that may be used include electrodynamic (e.g., voice coil) speakers, piezoelectric speakers, electrostatic speakers, ribbon speakers, planar magnetic speakers, etc. A source that serves as an information source in one scenario or application may serve as an interference source in a different scenario or application. Recording of the input data from the M microphones in each of the P scenarios may be performed using an M-channel tape recorder, a computer with M-channel sound recording or capturing capability, or another device capable of capturing or otherwise recording the output of the M microphones simultaneously (e.g., to within the order of a sampling resolution).

Figure 51:
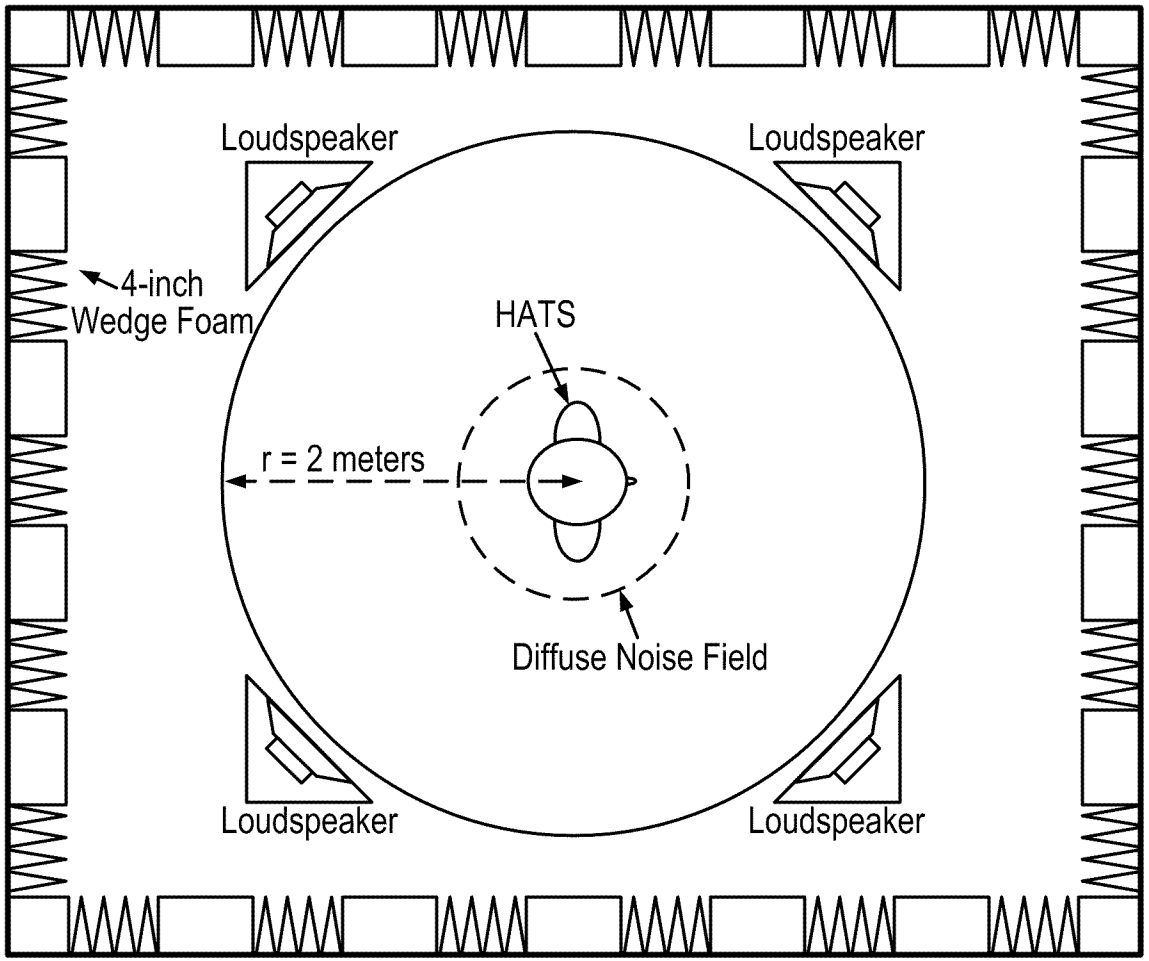
FIG. 51 shows an example of an acoustic anechoic chamber configured for recording of training data.

An acoustic anechoic chamber may be used for recording the set of M-channel training signals. FIG. 51 shows an example of an acoustic anechoic chamber configured for recording of training data. In this example, a Head and Torso Simulator (HATS, as manufactured by Bruel & Kjaer, Naerum, Denmark) is positioned within an inward-focused array of interference sources (i.e., the four loudspeakers). The HATS head is acoustically similar to a representative human head and includes a loudspeaker in the mouth for reproducing a speech signal. The array of interference sources may be driven to create a diffuse noise field that encloses the HATS as shown. In one such example, the array of loudspeakers is configured to play back noise signals at a sound pressure level of 75 to 78 dB at the HATS ear reference point or mouth reference point. In other cases, one or more such interference sources may be driven to create a noise field having a different spatial distribution (e.g., a directional noise field).

Types of noise signals that may be used include white noise, pink noise, grey noise, and Hoth noise (e.g., as described in IEEE Standard 269-2001, "Draft Standard Methods for Measuring Transmission Performance of Analog and Digital Telephone Sets, Handsets and Headsets," as promulgated by the Institute of Electrical and Electronics Engineers (IEEE), Piscataway, N.J.). Other types of noise signals that may be used include brown noise, blue noise, and purple noise.

The P scenarios differ from one another in terms of at least one spatial and/or spectral feature. The spatial configuration of sources and microphones may vary from one scenario to another in any one or more of at least the following ways: placement and/or orientation of a source relative to the other source or sources, placement and/or orientation of a microphone relative to the other microphone or microphones, placement and/or orientation of the sources relative to the microphones, and placement and/or orientation of the microphones relative to the sources. At least two among the P scenarios may correspond to a set of microphones and sources arranged in different spatial configurations, such that at least one of the microphones or sources among the set has a position or orientation in one scenario that is different from its position or orientation in the other scenario. For example, at least two among the P scenarios may relate to different orientations of a portable communications device, such as a handset or headset having an array of M microphones, relative to an information source such as a user's mouth. Spatial features that differ from one scenario to another may include hardware constraints (e.g., the locations of the microphones on the device), projected usage patterns of the device (e.g., typical expected user holding poses), and/or different microphone positions and/or activations (e.g., activating different pairs among three or more microphones).

Spectral features that may vary from one scenario to another include at least the following: spectral content of at least one source signal (e.g., speech from different voices, noise of different colors), and frequency response of one or more of the microphones. In one particular example as mentioned above, at least two of the scenarios differ with respect to at least one of the microphones (in other words, at least one of the microphones used in one scenario is replaced with another microphone or is not used at all in the other scenario). Such a variation may be desirable to support a solution that is robust over an expected range of changes in the frequency and/or phase response of a microphone and/or is robust to failure of a microphone.

In another particular example, at least two of the scenarios include background noise and differ with respect to the signature of the background noise (i.e., the statistics of the noise over frequency and/or time). In such case, the interference sources may be configured to emit noise of one color (e.g., white, pink, or Hoth) or type (e.g., a reproduction of street noise, babble noise, or car noise) in one of the P scenarios and to emit noise of another color or type in another of the P scenarios (for example, babble noise in one scenario, and street and/or car noise in another scenario).

At least two of the P scenarios may include information sources producing signals having substantially different spectral content. In a speech application, for example, the information signals in two different scenarios may be different voices, such as two voices that have average pitches (i.e., over the length of the scenario) which differ from each other by not less than ten percent, twenty percent, thirty percent, or even fifty percent. Another feature that may vary from one scenario to another is the output amplitude of a source relative to that of the other source or sources. Another feature that may vary from one scenario to another is the gain sensitivity of a microphone relative to that of the other microphone or microphones of the array.

As described below, the set of M-channel training signals is used in task T20 to obtain a converged set of filter coefficient values. The duration of each of the training signals may be selected based on an expected convergence rate of the training operation. For example, it may be desirable to select a duration for each training signal that is long enough to permit significant progress toward convergence but short enough to allow other training signals to also contribute substantially to the converged solution. In a typical application, each of the training signals lasts from about one-half or one to about five or ten seconds. For a typical training operation, copies of the training signals are concatenated in a random order to obtain a sound file to be used for training. Typical lengths for a training file include 10, 30, 45, 60, 75, 90, 100, and 120 seconds.

In a near-field scenario (e.g., when a communications device is held close to the user's mouth), different amplitude and delay relationships may exist between the microphone outputs than in a far-field scenario (e.g., when the device is held farther from the user's mouth). It may be desirable for the range of P scenarios to include both near-field and far-field scenarios. Alternatively, it may be desirable for the range of P scenarios to include only near-field scenarios. In such case, a corresponding production device may be configured to suspend equalization, or to use a single-channel equalization mode as described herein with reference to equalizer EQ100, when insufficient separation of sensed audio signal S10 is detected during operation.

For each of the P acoustic scenarios, the information signal may be provided to the M microphones by reproducing from the HATS's mouth artificial speech (as described in ITU-T Recommendation P.50, International Telecommunication Union, Geneva, CH, March 1993) and/or a voice uttering standardized vocabulary such as one or more of the Harvard Sentences (as described in IEEE Recommended Practices for Speech Quality Measurements in IEEE Transactions on Audio and Electroacoustics, vol. 17, pp. 227-46, 1969). In one such example, the speech is reproduced from the mouth loudspeaker of a HATS at a sound pressure level of 89 dB. At least two of the P scenarios may differ from one another with respect to this information signal. For example, different scenarios may use voices having substantially different pitches. Additionally or in the alternative, at least two of the P scenarios may use different instances of the reference device (e.g., to support a converged solution that is robust to variations in response of the different microphones).

In one particular set of applications, the M microphones are microphones of a portable device for wireless communications such as a cellular telephone handset. FIGS. 6A and 6B show two different operating configurations for such a device, and it is possible to perform separate instances of method M10 for each operating configuration of the device (e.g., to obtain a separate converged filter state for each configuration). In such case, apparatus A100 may be configured to select among the various converged filter states (i.e., among different sets of filter coefficient values for a directional processing stage of SSP filter SS10, or among different instances of a directional processing stage of SSP filter SS10) at runtime. For example, apparatus A100 may be configured to select a filter or filter state that corresponds to the state of a switch which indicates whether the device is open or closed.

In another particular set of applications, the M microphones are microphones of a wired or wireless earpiece or other headset. FIG. 8 shows one example 63 of such a headset as described herein. The training scenarios for such a headset may include any combination of the information and/or interference sources as described with reference to the handset applications above. Another difference that may be modeled by different ones of the P training scenarios is the varying angle of the transducer axis with respect to the ear, as indicated in FIG. 8 by headset mounting variability 66. Such variation may occur in practice from one user to another. Such variation may even with respect to the same user over a single period of wearing the device. It will be understood that such variation may adversely affect signal separation performance by changing the direction and distance from the transducer array to the user's mouth. In such case, it may be desirable for one of the plurality of M-channel training signals to be based on a scenario in which the headset is mounted in the ear 65 at an angle at or near one extreme of the expected range of mounting angles, and for another of the M-channel training signals to be based on a scenario in which the headset is mounted in the ear 65 at an angle at or near the other extreme of the expected range of mounting angles. Others of the P scenarios may include one or more orientations corresponding to angles that are intermediate between these extremes.

In a further set of applications, the M microphones are microphones provided in a hands-free car kit. FIG. 9 shows one example of such a communications device 83 in which the loudspeaker 85 is disposed broadside to the microphone array 84. The P acoustic scenarios for such a device may include any combination of the information and/or interference sources as described with reference to the handset applications above. For example, two or more of the P scenarios may differ in the location of the desired sound source with respect to the microphone array. One or more of the P scenarios may also include reproducing an interfering signal from the loudspeaker 85. Different scenarios may include interfering signals reproduced from loudspeaker 85, such as music and/or voices having different signatures in time and/or frequency (e.g., substantially different pitch frequencies). In such case, it may be desirable for method M10 to produce a filter state that separates the interfering signal from a desired speech signal. One or more of the P scenarios may also include interference such as a diffuse or directional noise field as described above.

The spatial separation characteristics of the converged filter solution produced by method M10 (e.g., the shape and orientation of the corresponding beam pattern) are likely to be sensitive to the relative characteristics of the microphones used in task T10 to acquire the training signals. It may be desirable to calibrate at least the gains of the M microphones of the reference device relative to one another before using the device to record the set of training signals. Such calibration may include calculating or selecting a weighting factor to be applied to the output of one or more of the microphones such that the resulting ratio of the gains of the microphones is within a desired range. It may also be desirable during and/or after production to calibrate at least the gains of the microphones of each production device relative to one another.

Even if an individual microphone element is acoustically well characterized, differences in factors such as the manner in which the element is mounted to the audio reproduction device and the qualities of the acoustic port may cause similar microphone elements to have significantly different frequency and gain response patterns in actual use. Therefore it may be desirable to perform such a calibration of the microphone array after it has been installed in the audio reproduction device.

Calibration of the array of microphones may be performed within a special noise field, with the audio reproduction device being oriented in a particular manner within that noise field. For example, a two-microphone audio reproduction device, such as a handset, may be placed into a two-point-source noise field such that both microphones (each of which may be omni- or unidirectional) are equally exposed to the same SPL levels. Examples of other calibration enclosures and procedures that may be used to perform factory calibration of production devices (e.g., handsets) are described in U.S. patent application Ser. No. 61/077,144, filed Jun. 30, 2008, entitled "SYSTEMS, METHODS, AND APPARATUS FOR CALIBRATION OF MULTI-MICROPHONE DEVICES." Matching the frequency response and gains of the microphones of the reference device may help to correct for fluctuations in acoustic cavity and/or microphone sensitivity during production, and it may also be desirable to calibrate the microphones of each production device.

It may be desirable to ensure that the microphones of the production device and the microphones of the reference device are properly calibrated using the same procedure. Alternatively, a different acoustic calibration procedure may be used during production. For example, it may be desirable to calibrate the reference device in a room-sized anechoic chamber using a laboratory procedure, and to calibrate each production device in a portable chamber (e.g., as described in U.S. patent application Ser. No. 61/077,144) on the factory floor. For a case in which performing an acoustic calibration procedure during production is not feasible, it may be desirable to configure a production device to perform an automatic gain matching procedure. Examples of such a procedure are described in U.S. Provisional Pat. Appl. No. 61/058,132, filed Jun. 2, 2008, entitled "SYSTEM AND METHOD FOR AUTOMATIC GAIN MATCHING OF A PAIR OF MICROPHONES."

The characteristics of the microphones of the production device may drift over time. Alternatively or additionally, the array configuration of such a device may change mechanically over time. Consequently, it may be desirable to include a calibration routine within the audio reproduction device that is configured to match one or more microphone frequency properties and/or sensitivities (e.g., a ratio between the microphone gains) during service on a periodic basis or upon some other event (e.g., at power-up, upon a user selection, etc.). Examples of such a procedure are described in U.S. Provisional Pat. Appl. No. 61/058,132.

One or more of the P scenarios may include driving one or more loudspeakers of the audio reproduction device (e.g., by artificial speech and/or a voice uttering standardized vocabulary) to provide a directional interference source. Including one or more such scenarios may help to support robustness of the resulting converged filter solution to interference from a reproduced audio signal. It may be desirable in such case for the loudspeaker or loudspeakers of the reference device to be the same model or models, and to be mounted in the same manner and in the same locations, as those of the production devices. For an operating configuration as shown in FIG. 6A, such a scenario may include driving primary speaker SP10, while for an operating configuration as shown in FIG. 6B, such a scenario may include driving secondary speaker SP20. A scenario may include such an interference source in addition to, or in the alternative to, a diffuse noise field created, for example, by an array of interference sources as shown in FIG. 51.

Alternatively or additionally, an instance of method M10 may be performed to obtain one or more converged filter sets for an echo canceller EC10 as described above. The trained filters of the echo canceller may then be used to perform echo cancellation on the microphone signals during recording of the training signals for SSP filter SS10.

While a HATS located within an anechoic chamber is described as a suitable test device for recording the training signals in task T10, any other humanoid simulator or a human speaker can be substituted for a desired speech generating source. It may be desirable in such case to use at least some amount of background noise (e.g., to better condition a resulting matrix of trained filter coefficient values over the desired range of audio frequencies). It is also possible to perform testing on the production device prior to use and/or during use of the device. For example, the testing can be personalized based on the features of the user of the audio reproduction device, such as typical distance of the microphones to the mouth, and/or based on the expected usage environment. A series of preset "questions" can be designed for user response, for example, which may help to condition the system to particular features, traits, environments, uses, etc.

Task T20 uses the set of training signals to train a structure of SSP filter SS10 (i.e., to calculate a corresponding converged filter solution) according to a source separation algorithm. Task T20 may be performed within the reference device but is typically performed outside the audio reproduction device, using a personal computer or workstation. It may be desirable for task T20 to produce a converged filter structure that is configured to filter a multichannel input signal having a directional component (e.g., sensed audio signal S10) such that in the resulting output signal, the energy of the directional component is concentrated into one of the output channels (e.g., source signal S20). This output channel may have an increased signal-to-noise ratio (SNR) as compared to any of the channels of the multichannel input signal.

The term "source separation algorithm" includes blind source separation (BSS) algorithms, which are methods of separating individual source signals (which may include signals from one or more information sources and one or more interference sources) based only on mixtures of the source signals. Blind source separation algorithms may be used to separate mixed signals that come from multiple independent sources. Because these techniques do not require information on the source of each signal, they are known as "blind source separation" methods. The term "blind" refers to the fact that the reference signal or signal of interest is not available, and such methods commonly include assumptions regarding the statistics of one or more of the information and/or interference signals. In speech applications, for example, the speech signal of interest is commonly assumed to have a supergaussian distribution (e.g., a high kurtosis). The class of BSS algorithms also includes multivariate blind deconvolution algorithms.

A BSS method may include an implementation of independent component analysis. Independent component analysis (ICA) is a technique for separating mixed source signals (components) which are presumably independent from each other. In its simplified form, independent component analysis applies an "un-mixing" matrix of weights to the mixed signals (for example, by multiplying the matrix with the mixed signals) to produce separated signals. The weights may be assigned initial values that are then adjusted to maximize joint entropy of the signals in order to minimize information redundancy. This weight-adjusting and entropy-increasing process is repeated until the information redundancy of the signals is reduced to a minimum. Methods such as ICA provide relatively accurate and flexible means for the separation of speech signals from noise sources. Independent vector analysis ("IVA") is a related BSS technique in which the source signal is a vector source signal instead of a single variable source signal.

The class of source separation algorithms also includes variants of BSS algorithms, such as constrained ICA and constrained IVA, which are constrained according to other a priori information, such as a known direction of each of one or more of the source signals with respect to, for example, an axis of the microphone array. Such algorithms may be distinguished from beamformers that apply fixed, non-adaptive solutions based only on directional information and not on observed signals.

As discussed above with reference to FIG. 11B, SSP filter SS10 may include one or more stages (e.g., fixed filter stage FF10, adaptive filter stage AF10). Each of these stages may be based on a corresponding adaptive filter structure, whose coefficient values are calculated by task T20 using a learning rule derived from a source separation algorithm. The filter structure may include feedforward and/or feedback coefficients and may be a finite-impulse-response (FIR) or infinite-impulse-response (IIR) design. Examples of such filter structures are described in U.S. patent application Ser. No. 12/197,924 as incorporated above.

Figure 52A:
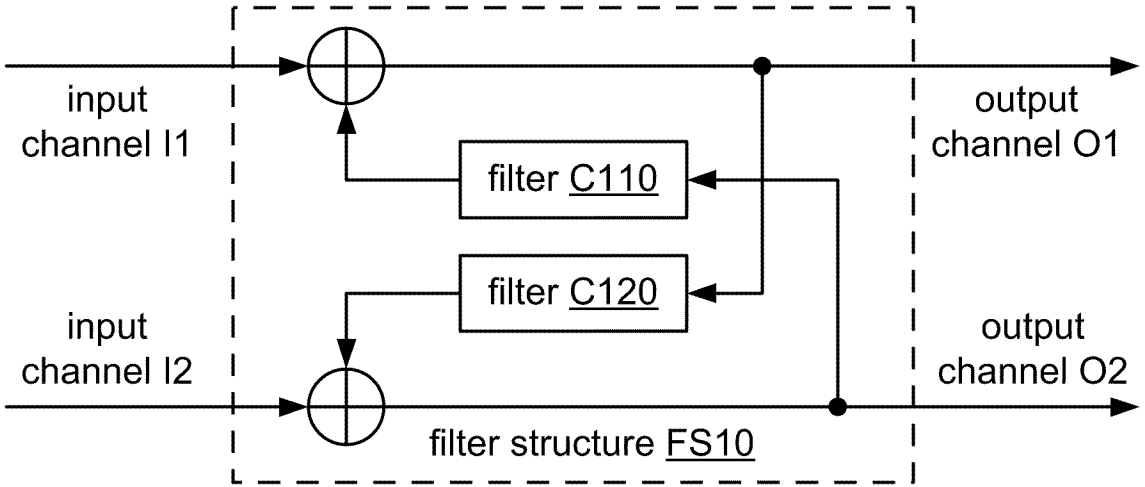
FIG. 52A shows a block diagram of a two-channel example of an adaptive filter structure FS10.
Figure 52B:
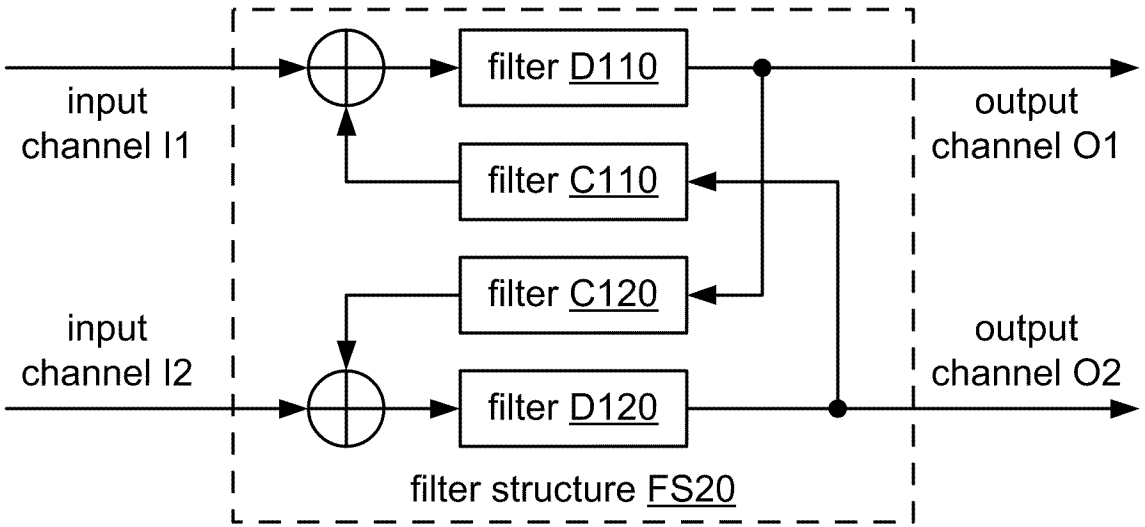
FIG. 52B shows a block diagram of an implementation FS20 of filter structure FS10.

FIG. 52A shows a block diagram of a two-channel example of an adaptive filter structure FS10 that includes two feedback filters C110 and C120, and FIG. 52B shows a block diagram of an implementation FS20 of filter structure FS10 that also includes two direct filters D10 and D120. Spatially selective processing filter SS10 may be implemented to include such a structure such that, for example, input channels I1, I2 correspond to sensed audio channels S10-1, S10-2, respectively, and output channels O1, O2 correspond to source signal S20 and noise reference S30, respectively. The learning rule used by task T20 to train such a structure may be designed to maximize information between the filter's output channels (e.g., to maximize the amount of information contained by at least one of the filter's output channels). Such a criterion may also be restated as maximizing the statistical independence of the output channels, or minimizing mutual information among the output channels, or maximizing entropy at the output. Particular examples of the different learning rules that may be used include maximum information (also known as infomax), maximum likelihood, and maximum nongaussianity (e.g., maximum kurtosis). Further examples of such adaptive structures, and learning rules that are based on ICA or IVA adaptive feedback and feedforward schemes, are described in U.S. Publ. Pat. Appl. No. 2006/0053002 A1, entitled "System and Method for Speech Processing using Independent Component Analysis under Stability Constraints", published Mar. 9, 2006; U.S. Prov. App. No. 60/777,920, entitled "System and Method for Improved Signal Separation using a Blind Signal Source Process," filed Mar. 1, 2006; U.S. Prov. App. No. 60/777,900, entitled "System and Method for Generating a Separated Signal," filed Mar. 1, 2006; and Int'l Pat. Publ. WO 2007/100330 A1 (Kim et al.), entitled "Systems and Methods for Blind Source Signal Separation." Additional description of adaptive filter structures, and learning rules that may be used in task T20 to train such filter structures, may be found in U.S. patent application Ser. No. 12/197,924 as incorporated by reference above.

One example of a learning rule that may be used to train a feedback structure FS10 as shown in FIG. 52A may be expressed as follows:

$$y_1(t)=x_1(t)+(h_{12}(t)\otimes y_2(t)) \quad \text{(A)}$$

$$y_2(t)=x_2(t)+(h_{21}(t)\otimes y_1(t)) \quad \text{(B)}$$

$$\Delta h_{12k}=-f(y_1(t))\times y_2(t-k) \quad \text{(C)}$$

$$\Delta h_{21k}=-f(y_2(t))\times y_1(t-k) \quad \text{(D)}$$

where t denotes a time sample index, $h_{12}$ (t) denotes the coefficient values of filter C110 at time t, $h_{21}$ (t) denotes the coefficient values of filter C120 at time t, the symbol $\otimes$ denotes the time-domain convolution operation, $\Delta h_{12k}$ denotes a change in the k-th coefficient value of filter C110 subsequent to the calculation of output values $y_1(t)$ and $y_2(t)$, and $\Delta h_{21k}$ denotes a change in the k-th coefficient value of filter C120 subsequent to the calculation of output values $y_1(t)$ and $y_2(t)$. It may be desirable to implement the activation function $f$ as a nonlinear bounded function that approximates the cumulative density function of the desired signal. Examples of nonlinear bounded functions that may be used for activation signal $f$ for speech applications include the hyperbolic tangent function, the sigmoid function, and the sign function.

As noted herein, the filter coefficient values of a directional processing stage of SSP filter SS10 may be calculated using a BSS, beamforming, or combined BSS/beamforming method. Although ICA and IVA techniques allow for adaptation of filters to solve very complex scenarios, it is not always possible or desirable to implement these techniques for signal separation processes that are configured to adapt in real time. First, the convergence time and the number of instructions required for the adaptation may for some applications be prohibitive. While incorporation of a priori training knowledge in the form of good initial conditions may speed up convergence, in some applications, adaptation is not necessary or is only necessary for part of the acoustic scenario. Second, IVA learning rules can converge much slower and get stuck in local minima if the number of input channels is large. Third, the computational cost for online adaptation of IVA may be prohibitive. Finally, adaptive filtering may be associated with transients and adaptive gain modulation which may be perceived by users as additional reverberation or detrimental to speech recognition systems mounted downstream of the processing scheme.

Another class of techniques that may be used for directional processing of signals received from a linear microphone array is often referred to as "beamforming". Beamforming techniques use the time difference between channels that results from the spatial diversity of the microphones to enhance a component of the signal that arrives from a particular direction. More particularly, it is likely that one of the microphones will be oriented more directly at the desired source (e.g., the user's mouth), whereas the other microphone may generate a signal from this source that is relatively attenuated. These beamforming techniques are methods for spatial filtering that steer a beam towards a sound source, putting a null at the other directions. Beamforming techniques make no assumption on the sound source but assume that the geometry between source and sensors, or the sound signal itself, is known for the purpose of dereverberating the signal or localizing the sound source. The filter coefficient values of a structure of SSP filter SS10 may be calculated according to a data-dependent or data-independent beamformer design (e.g., a superdirective beamformer, least-squares beamformer, or statistically optimal beamformer design). In the case of a data-independent beamformer design, it may be desirable to shape the beam pattern to cover a desired spatial area (e.g., by tuning the noise correlation matrix).

A well studied technique in robust adaptive beamforming referred to as "Generalized Sidelobe Canceling" (GSC) is discussed in Hoshuyama, O., Sugiyama, A., Hirano, A., A Robust Adaptive Beamformer for Microphone Arrays with a Blocking Matrix using Constrained Adaptive Filters, IEEE Transactions on Signal Processing, vol. 47, No. 10, pp. 2677-2684, October 1999. Generalized sidelobe canceling aims at filtering out a single desired source signal from a set of measurements. A more complete explanation of the GSC principle may be found in, e.g., Griffiths, L. J., Jim, C. W., An alternative approach to linear constrained adaptive beamforming, IEEE Transactions on Antennas and Propagation, vol. 30, no. 1, pp. 27-34, January 1982.

Task T20 trains the adaptive filter structure to convergence according to a learning rule. Updating of the filter coefficient values in response to the set of training signals may continue until a converged solution is obtained. During this operation, at least some of the training signals may be submitted as input to the filter structure more than once, possibly in a different order. For example, the set of training signals may be repeated in a loop until a converged solution is obtained. Convergence may be determined based on the filter coefficient values. For example, it may be decided that the filter has converged when the filter coefficient values no longer change, or when the total change in the filter coefficient values over some time interval is less than (alternatively, not greater than) a threshold value. Convergence may also be monitored by evaluating correlation measures. For a filter structure that includes cross filters, convergence may be determined independently for each cross filter, such that the updating operation for one cross filter may terminate while the updating operation for another cross filter continues. Alternatively, updating of each cross filter may continue until all of the cross filters have converged.

Task T30 evaluates the trained filter produced in task T20 by evaluating its separation performance. For example, task T30 may be configured to evaluate the response of the trained filter to a set of evaluation signals. This set of evaluation signals may be the same as the training set used in task T20. Alternatively, the set of evaluation signals may be a set of M-channel signals that are different from but similar to the signals of the training set (e.g., are recorded using at least part of the same array of microphones and at least some of the same P scenarios). Such evaluation may be performed automatically and/or by human supervision. Task T30 is typically performed outside the audio reproduction device, using a personal computer or workstation.

Task T30 may be configured to evaluate the filter response according to the values of one or more metrics. For example, task T30 may be configured to calculate values for each of one or more metrics and to compare the calculated values to respective threshold values. One example of a metric that may be used to evaluate a filter response is a correlation between (A) the original information component of an evaluation signal (e.g., the speech signal that was reproduced from the mouth loudspeaker of the HATS during the recording of the evaluation signal) and (B) at least one channel of the response of the filter to that evaluation signal. Such a metric may indicate how well the converged filter structure separates information from interference. In this case, separation is indicated when the information component is substantially correlated with one of the M channels of the filter response and has little correlation with the other channels.

Other examples of metrics that may be used to evaluate a filter response (e.g., to indicate how well the filter separates information from interference) include statistical properties such as variance, Gaussianity, and/or higher-order statistical moments such as kurtosis. Additional examples of metrics that may be used for speech signals include zero crossing rate and burstiness over time (also known as time sparsity). In general, speech signals exhibit a lower zero crossing rate and a lower time sparsity than noise signals. A further example of a metric that may be used to evaluate a filter response is the degree to which the actual location of an information or interference source with respect to the array of microphones during recording of an evaluation signal agrees with a beam pattern (or null beam pattern) as indicated by the response of the filter to that evaluation signal. It may be desirable for the metrics used in task T30 to include, or to be limited to, the separation measures used in a corresponding implementation of apparatus A200 (e.g., as discussed above with reference to a separation evaluator, such as separation evaluator EV10).

Task T30 may be configured to compare each calculated metric value to a corresponding threshold value. In such case, a filter may be said to produce an adequate separation result for a signal if the calculated value for each metric is above (alternatively, is at least equal to) a respective threshold value. One of ordinary skill will recognize that in such a comparison scheme for multiple metrics, a threshold value for one metric may be reduced when the calculated value for one or more other metrics is high.

It may be also desirable for task T30 to verify that the set of converged filter solutions complies with other performance criteria, such as a send response nominal loudness curve as specified in a standards document such as TIA-810-B (e.g., the version of November 2006, as promulgated by the Telecommunications Industry Association, Arlington, Va.).

It may be desirable to configure task T30 to pass a converged filter solution even if the filter has failed to adequately separate one or more of the evaluation signals. In an implementation of apparatus A200 as described above, for example, a single-channel mode may be used for situations in which adequate separation of sensed audio signal S10 is not achieved, such that a failure to separate a small percentage of the set of evaluation signals in task T30 (e.g., up to two, five, ten, or twenty percent) may be acceptable.

It is possible that the trained filter will converge to a local minimum in task T20, leading to a failure in evaluation task T30. In such case, task T20 may be repeated using different training parameters (e.g., a different learning rate, different geometric constraints, etc.). Method M10 is typically an iterative design process, and it may be desirable to change and repeat one or more of tasks T10 and T20 until a desired evaluation result is obtained in task T30. For example, an iteration of method M10 may include using new training parameter values in task T20 (e.g., initial weight values, convergence rate, etc.) and/or recording new training data in task T10.

Once a desired evaluation result has been obtained in task T30 for a fixed filter stage of SSP filter SS10 (e.g., fixed filter stage FF10), the corresponding filter state may be loaded into the production devices as a fixed state of SSP filter SS10 (i.e., a fixed set of filter coefficient values). As described above, it may also be desirable to perform a procedure to calibrate the gain and/or frequency responses of the microphones in each production device, such as a laboratory, factory, or automatic (e.g., automatic gain matching) calibration procedure.

A trained fixed filter produced in one instance of method M10 may be used in another instance of method M10 to filter another set of training signals, also recorded using the reference device, in order to calculate initial conditions for an adaptive filter stage (e.g., for adaptive filter stage AF10 of SSP filter SS10). Examples of such calculation of initial conditions for an adaptive filter are described in U.S. patent application Ser. No. 12/197,924, filed Aug. 25, 2008, entitled "SYSTEMS, METHODS, AND APPARATUS FOR SIGNAL SEPARATION," for example, at paragraphs [00129]-[00135] (beginning with "It may be desirable" and ending with "cancellation in parallel"), which paragraphs are hereby incorporated by reference for purposes limited to description of design, training, and/or implementation of adaptive filter stages. Such initial conditions may also be loaded into other instances of the same or a similar device during production (e.g., as for the trained fixed filter stages).

Figure 53:
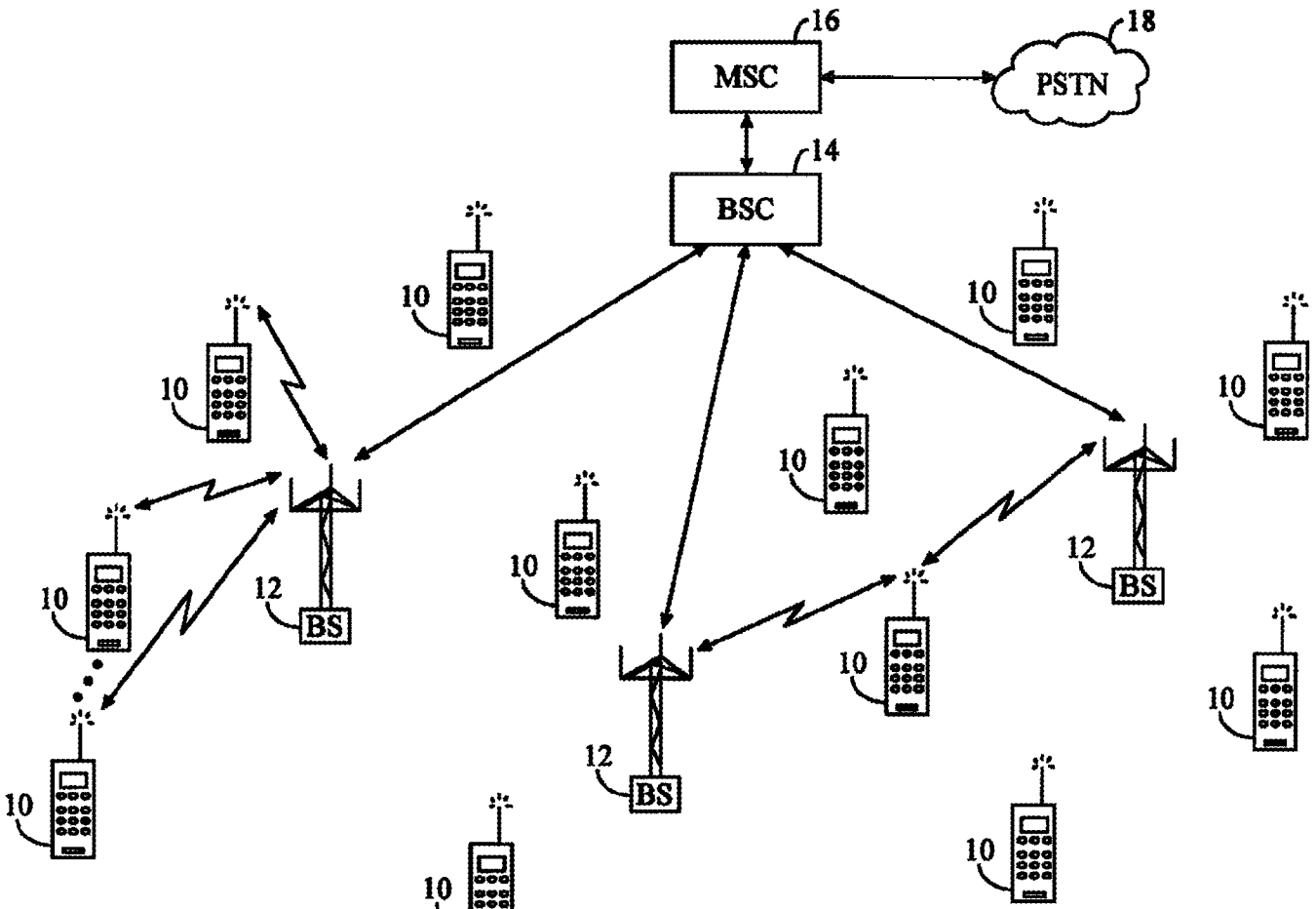
FIG. 53 illustrates a wireless telephone system.

As illustrated in FIG. 53, a wireless telephone system (e.g., a CDMA, TDMA, FDMA, and/or TD-SCDMA system) generally includes a plurality of mobile subscriber units 10 configured to communicate wirelessly with a radio access network that includes a plurality of base stations 12 and one or more base station controllers (BSCs) 14. Such a system also generally includes a mobile switching center (MSC) 16, coupled to the BSCs 14, that is configured to interface the radio access network with a conventional public switched telephone network (PSTN) 18. To support this interface, the MSC may include or otherwise communicate with a media gateway, which acts as a translation unit between the networks. A media gateway is configured to convert between different formats, such as different transmission and/or coding techniques (e.g., to convert between time-division-multiplexed (TDM) voice and VoIP), and may also be configured to perform media streaming functions such as echo cancellation, dual-time multifrequency (DTMF), and tone sending. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. The collection of base stations 12, BSCs 14, MSC 16, and media gateways if any, is also referred to as "infrastructure."

Each base station 12 advantageously includes at least one sector (not shown), each sector comprising an omnidirectional antenna or an antenna pointed in a particular direction radially away from the base station 12. Alternatively, each sector may comprise two or more antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The class of mobile subscriber units 10 typically includes communications devices as described herein, such as cellular and/or PCS (Personal Communications Service) telephones, personal digital assistants (PDAs), and/or other communications devices that have mobile telephonic capability. Such a unit 10 may include an internal speaker and an array of microphones, a tethered handset or headset that includes a speaker and an array of microphones (e.g., a USB handset), or a wireless headset that includes a speaker and an array of microphones (e.g., a headset that communicates audio information to the unit using a version of the Bluetooth protocol as promulgated by the Bluetooth Special Interest Group, Bellevue, Wash.). Such a system may be configured for use in accordance with one or more versions of the IS-95 standard (e.g., IS-95, IS-95A, IS-95B, cdma2000; as published by the Telecommunications Industry Alliance, Arlington, Va.).

A typical operation of the cellular telephone system is now described. The base stations 12 receive sets of reverse link signals from sets of mobile subscriber units 10. The mobile subscriber units 10 are conducting telephone calls or other communications. Each reverse link signal received by a given base station 12 is processed within that base station 12, and the resulting data is forwarded to a BSC 14. The BSC 14 provides call resource allocation and mobility management functionality, including the orchestration of soft handoffs between base stations 12. The BSC 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile subscriber units 10.

Figure 54:
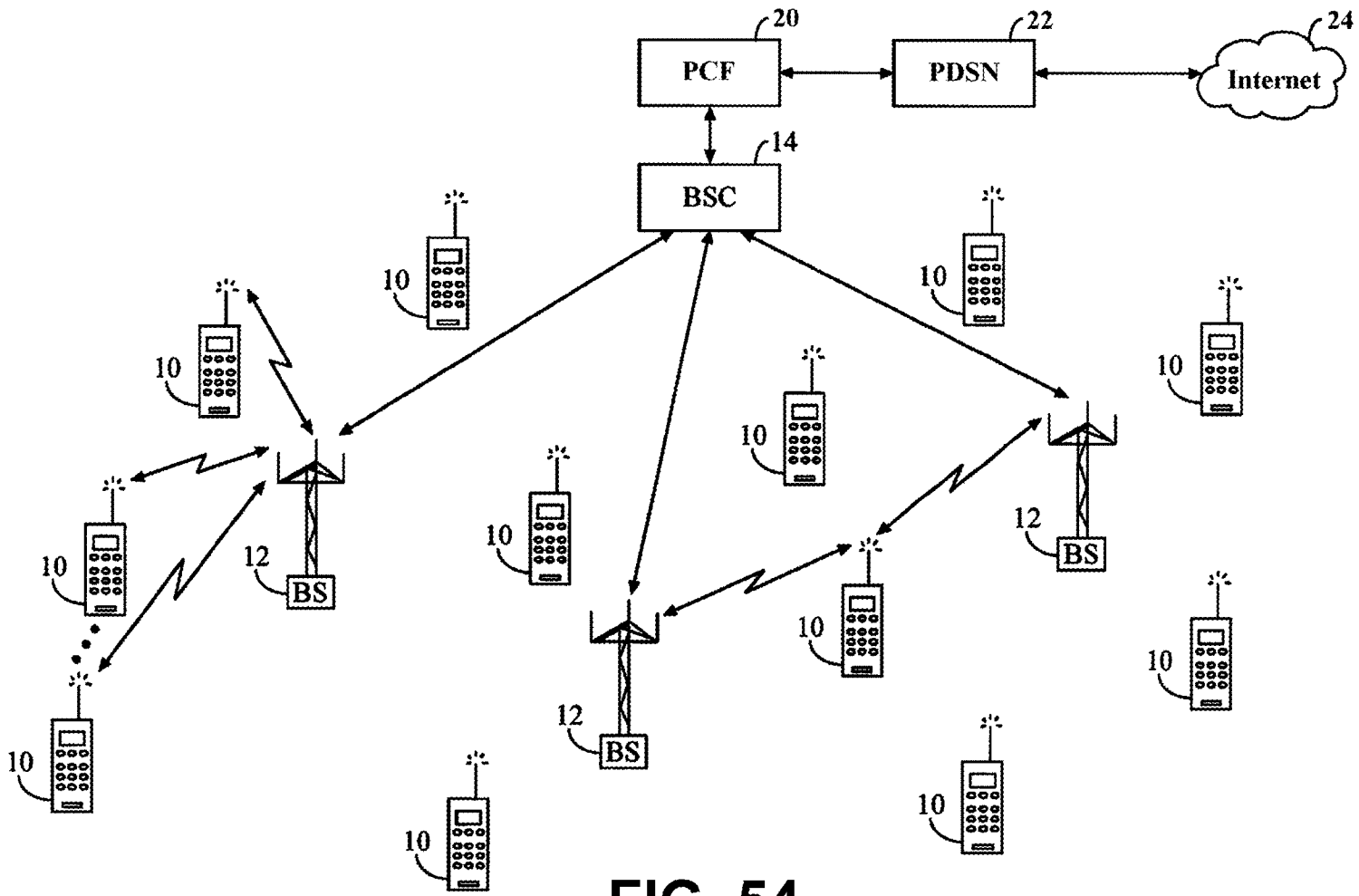
FIG. 54 illustrates a wireless telephone system configured to support packet-switched data communications.

Elements of a cellular telephony system as shown in FIG. 53 may also be configured to support packet-switched data communications. As shown in FIG. 54, packet data traffic is generally routed between mobile subscriber units 10 and an external packet data network 24 (e.g., a public network such as the Internet) using a packet data serving node (PDSN) 22 that is coupled to a gateway router connected to the packet data network. The PDSN 22 in turn routes data to one or more packet control functions (PCFs) 20, which each serve one or more BSCs 14 and act as a link between the packet data network and the radio access network. Packet data network 24 may also be implemented to include a local area network (LAN), a campus area network (CAN), a metropolitan area network (MAN), a wide area network (WAN), a ring network, a star network, a token ring network, etc. A user terminal connected to network 24 may be a device within the class of audio reproduction devices as described herein, such as a PDA, a laptop computer, a personal computer, a gaming device (examples of such a device include the XBOX and XBOX 360 (Microsoft Corp., Redmond, Wash.), the Playstation 3 and Playstation Portable (Sony Corp., Tokyo, JP), and the Wii and DS (Nintendo, Kyoto, JP)), and/or any device that has audio processing capability and may be configured to support a telephone call or other communication using one or more protocols such as VoIP. Such a terminal may include an internal speaker and an array of microphones, a tethered handset that includes a speaker and an array of microphones (e.g., a USB handset), or a wireless headset that includes a speaker and an array of microphones (e.g., a headset that communicates audio information to the terminal using a version of the Bluetooth protocol as promulgated by the Bluetooth Special Interest Group, Bellevue, Wash.). Such a system may be configured to carry a telephone call or other communication as packet data traffic between mobile subscriber units on different radio access networks (e.g., via one or more protocols such as VoIP), between a mobile subscriber unit and a non-mobile user terminal, or between two non-mobile user terminals, without ever entering the PSTN. A mobile subscriber unit 10 or other user terminal may also be referred to as an "access terminal."

Figure 55:
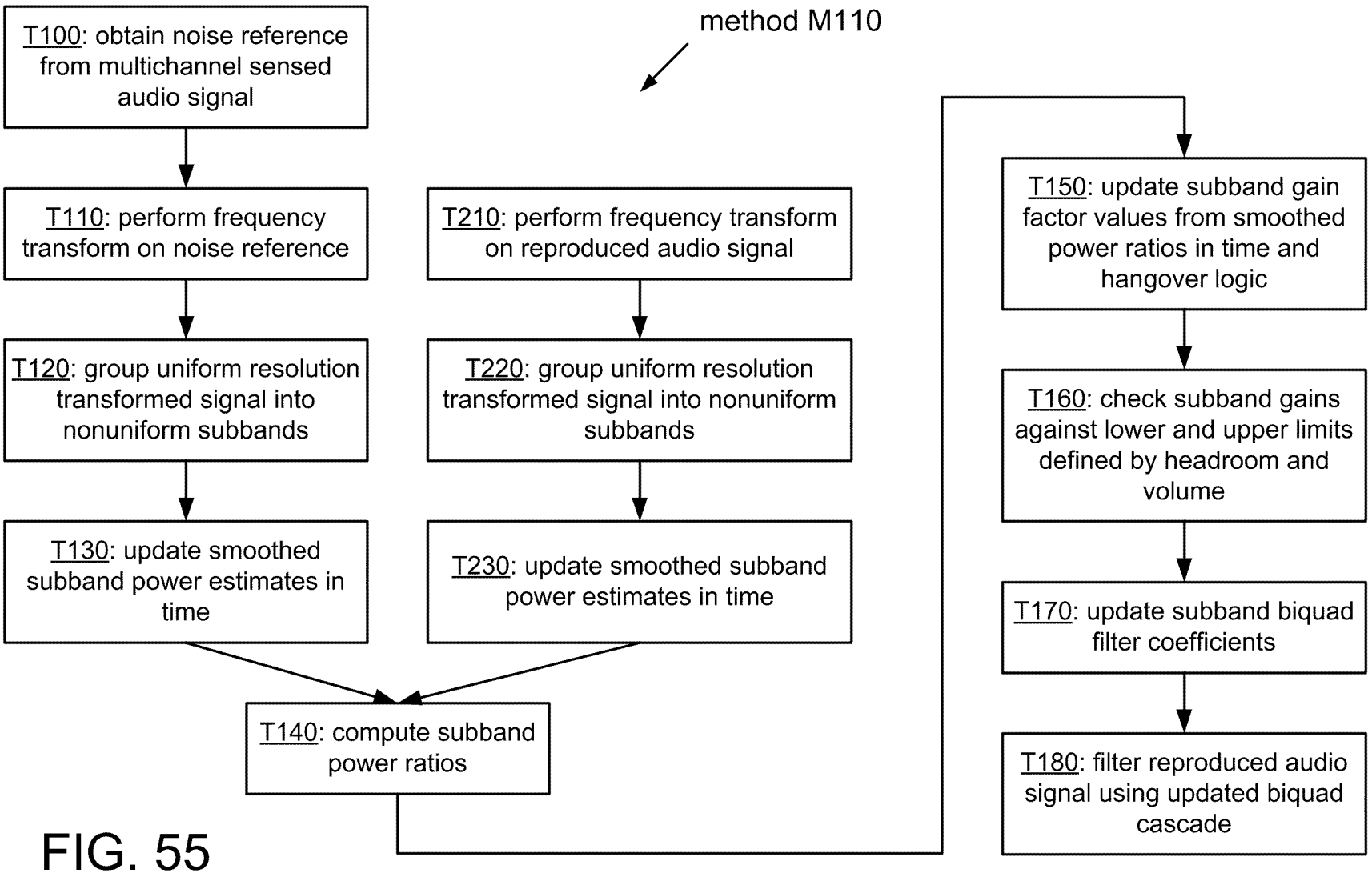
FIG. 55 shows a flowchart of a method M110 according to a configuration.

FIG. 55 shows a flowchart of a method M110 of processing a reproduced audio signal according to a configuration that includes tasks T100, T110, T120, T130, T140, T150, T160, T170, T180, T210, T220, and T230. Task T100 obtains a noise reference from a multichannel sensed audio signal (e.g., as described herein with reference to SSP filter SS10). Task T110 performs a frequency transform on the noise reference (e.g., as described herein with reference to transform module SG10). Task T120 groups values of the uniform resolution transformed signal produced by task T110 into nonuniform subbands (e.g., as described above with reference to binning module SG20). For each of the subbands of the noise reference, task T130 updates a smoothed power estimate in time (e.g., as described above with reference to subband power estimate calculator EC120).

Task T210 performs a frequency transform on reproduced audio signal S40 (e.g., as described herein with reference to transform module SG10). Task T220 groups values of the uniform resolution transformed signal produced by task T210 into nonuniform subbands (e.g., as described above with reference to binning module SG20). For each of the subbands of the reproduced audio signal, task T230 updates a smoothed power estimate in time (e.g., as described above with reference to subband power estimate calculator EC120).

For each of the subband of the reproduced audio signal, task T140 computes a subband power ratio (e.g., as described above with reference to ratio calculator GC10). Task T150 updates subband gain factor values from smoothed power ratios in time and hangover logic, and task T160 checks subband gains against lower and upper limits defined by headroom and volume (e.g., as described above with reference to smoother GC20). Task T170 updates subband biquad filter coefficients, and task T180 filters reproduced audio signal S40 using the updated biquad cascade (e.g., as described above with reference to subband filter array FA100). It may be desirable to perform method M110 in response to an indication that the reproduced audio signal currently contains voice activity.

Figure 56:
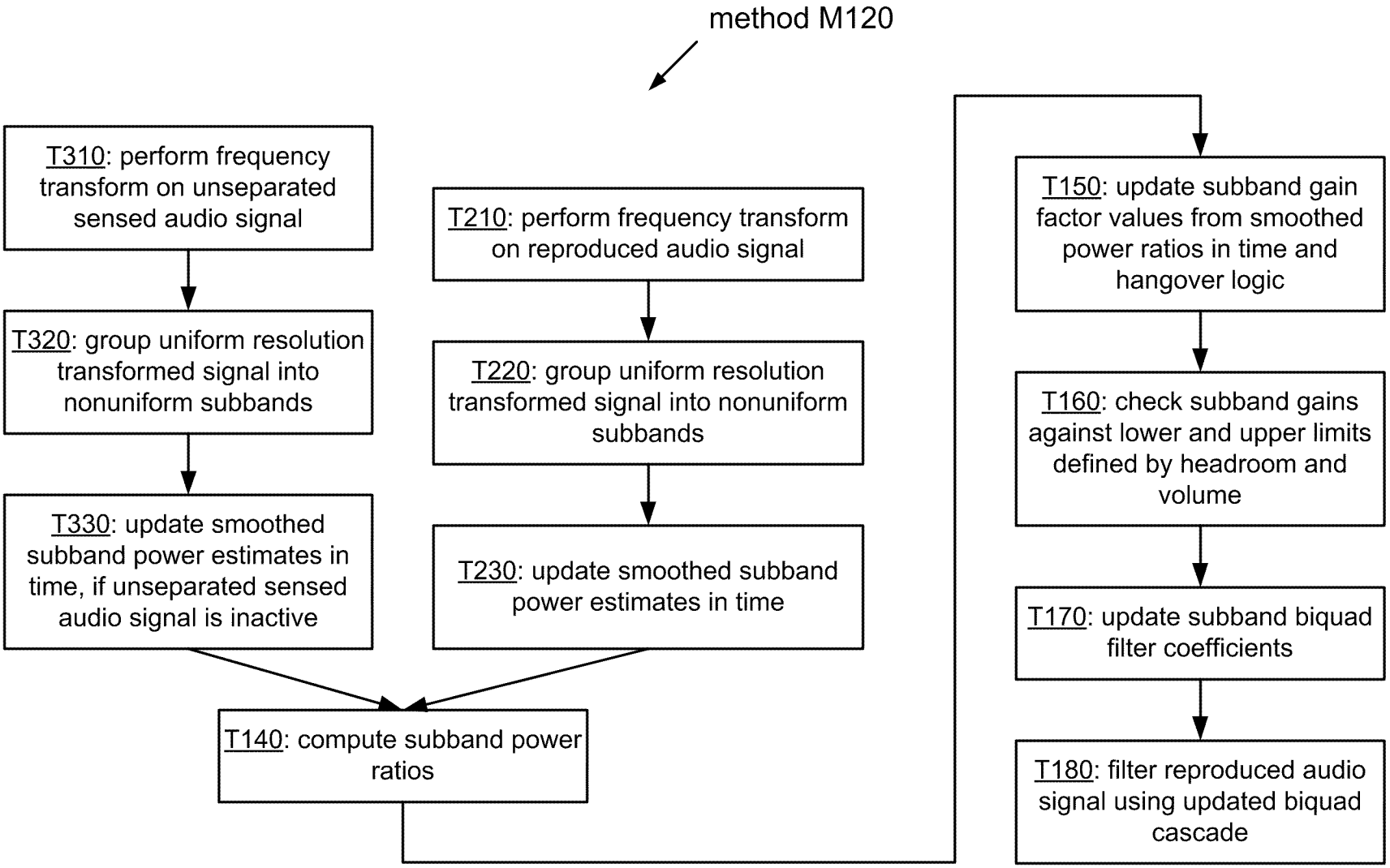
FIG. 56 shows a flowchart of a method M120 according to a configuration.

FIG. 56 shows a flowchart of a method M120 of processing a reproduced audio signal according to a configuration that includes tasks T140, T150, T160, T170, T180, T210, T220, T230, T310, T320, and T330. Task T310 performs a frequency transform on an unseparated sensed audio signal (e.g., as described herein with reference to transform module SG10, equalizer EQ100, and unseparated sensed audio signal S90). Task T320 groups values of the uniform resolution transformed signal produced by task T310 into nonuniform subbands (e.g., as described above with reference to binning module SG20). For each of the subbands of the unseparated sensed audio signal, task T330 updates a smoothed power estimate in time (e.g., as described above with reference to subband power estimate calculator EC120) if the unseparated sensed audio signal does not currently contain voice activity. It may be desirable to perform method M120 in response to an indication that the reproduced audio signal currently contains voice activity.

Figure 57:
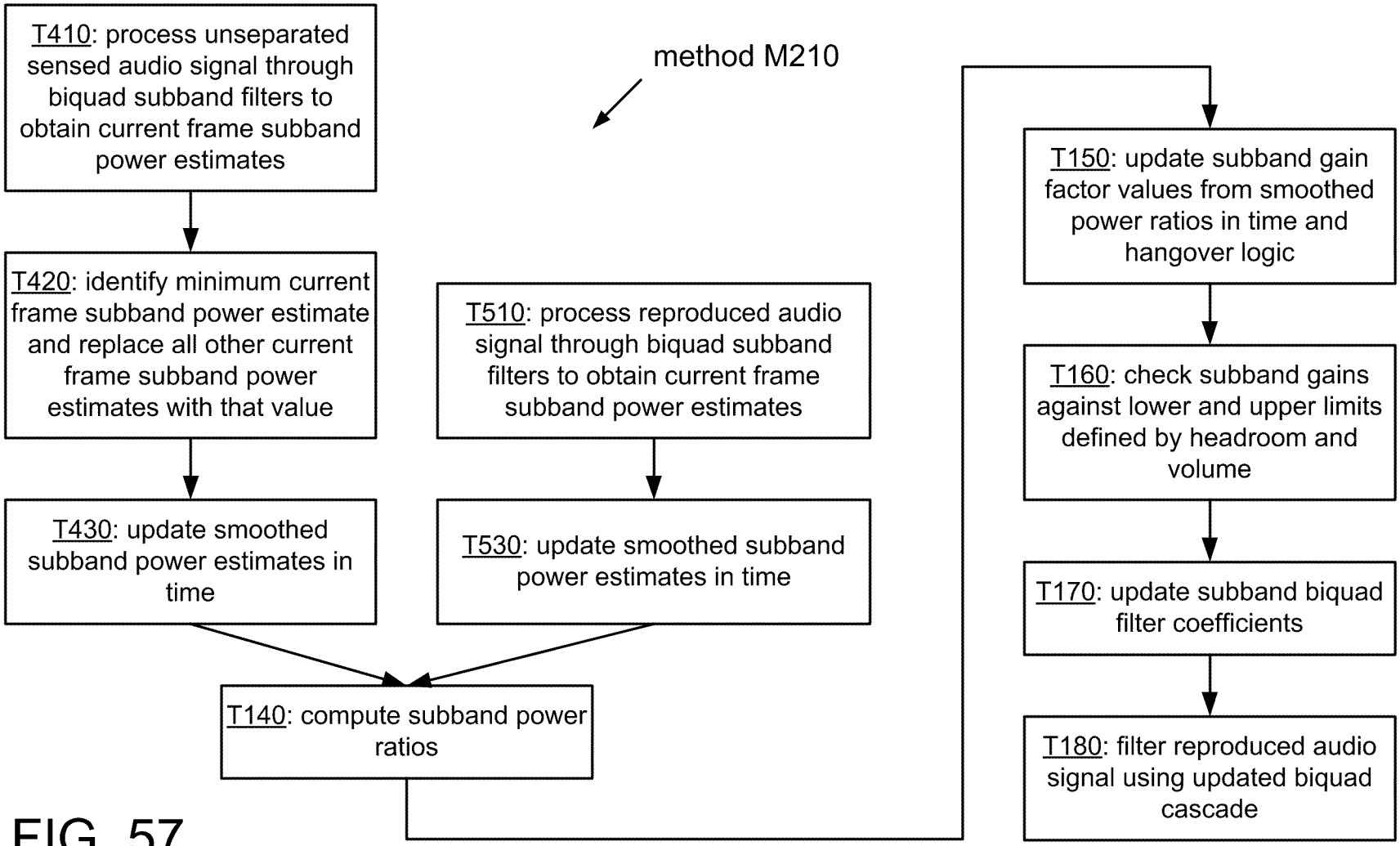
FIG. 57 shows a flowchart of a method M210 according to a configuration.

FIG. 57 shows a flowchart of a method M210 of processing a reproduced audio signal according to a configuration that includes tasks T140, T150, T160, T170, T180, T410, T420, T430, T510, and T530. Task T410 processes an unseparated sensed audio signal through biquad subband filters to obtain current frame subband power estimates (e.g., as described herein with reference to subband filter array SG30, equalizer EQ100, and unseparated sensed audio signal S90). Task T420 identifies the minimum current frame subband power estimate and replaces all other current frame subband power estimates with that value (e.g., as described herein with reference to minimizer MZ10). For each of the subbands of the unseparated sensed audio signal, task T430 updates a smoothed power estimate in time (e.g., as described above with reference to subband power estimate calculator EC120). Task T510 processes a reproduced audio signal through biquad subband filters to obtain current frame subband power estimates (e.g., as described herein with reference to subband filter array SG30 and equalizer EQ100). For each of the subbands of the reproduced audio signal, task T530 updates a smoothed power estimate in time (e.g., as described above with reference to subband power estimate calculator EC120). It may be desirable to perform method M210 in response to an indication that the reproduced audio signal currently contains voice activity.

Figure 58:
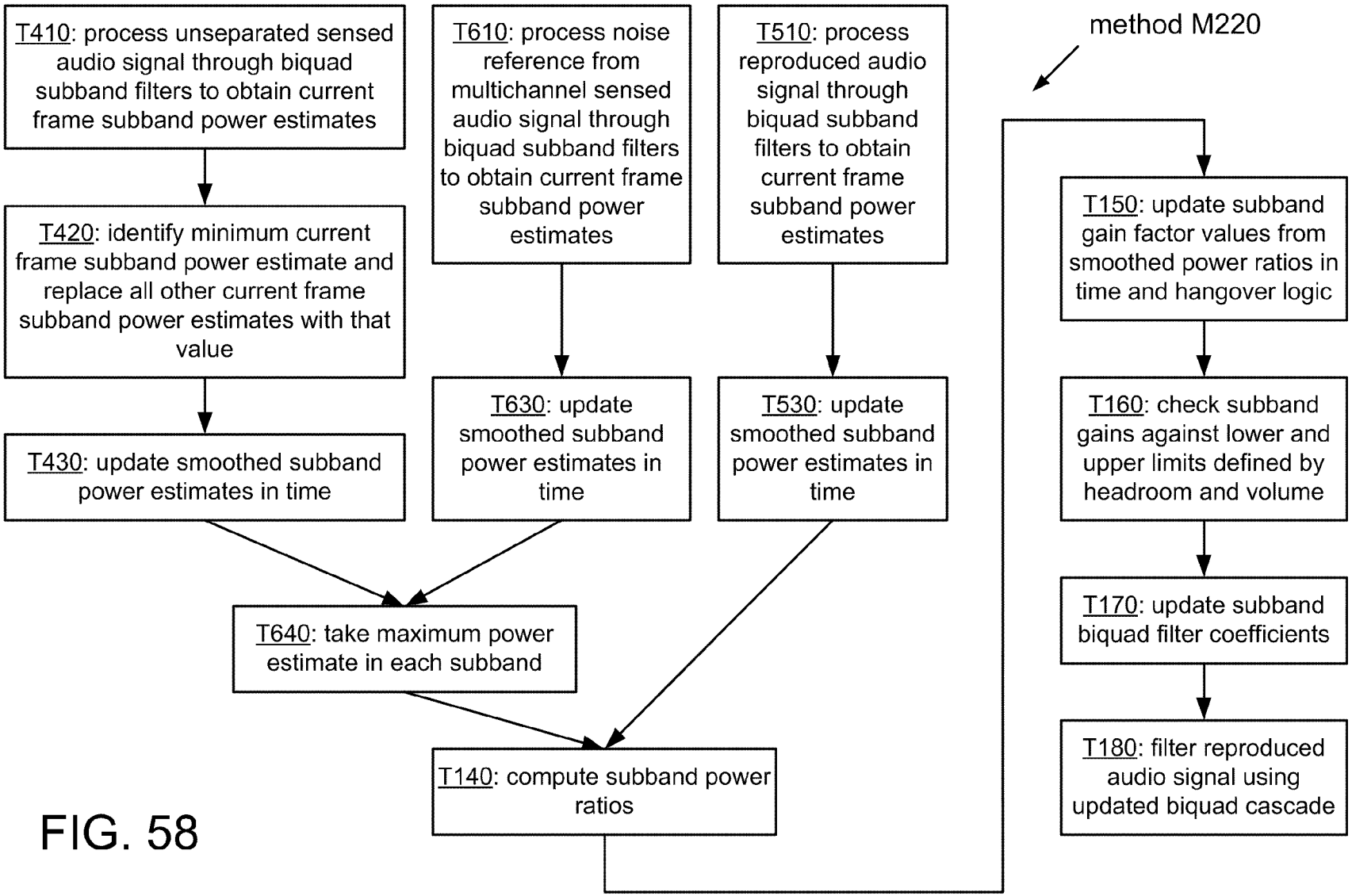
FIG. 58 shows a flowchart of a method M220 according to a configuration.

FIG. 58 shows a flowchart of a method M220 of processing a reproduced audio signal according to a configuration that includes tasks T140, T150, T160, T170, T180, T410, T420, T430, T510, T530, T610, T630, and T640. Task T610 processes a noise reference from a multichannel sensed audio signal through biquad subband filters to obtain current frame subband power estimates (e.g., as described herein with reference to noise reference S30, subband filter array SG30, and equalizer EQ100). For each of the subbands of the noise reference, task T630 updates a smoothed power estimate in time (e.g., as described above with reference to subband power estimate calculator EC120). From the subband power estimates produced by tasks T430 and T630, task T640 takes the maximum power estimate in each subband (e.g., as described above with reference to maximizer MAX10). It may be desirable to perform method M220 in response to an indication that the reproduced audio signal currently contains voice activity.

Figure 59B:
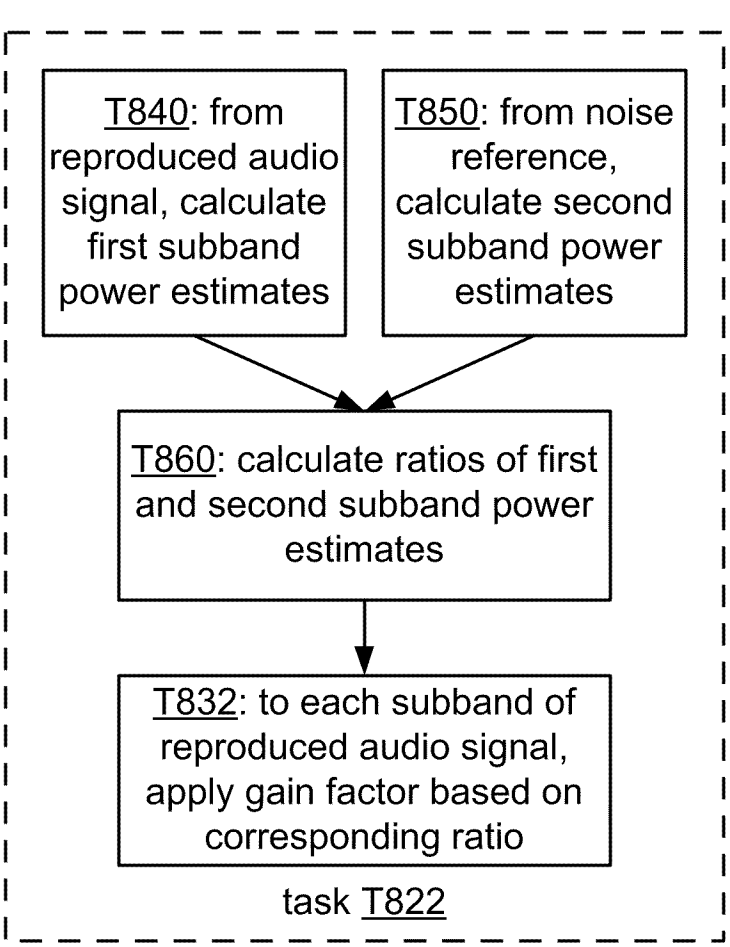
FIG. 59B shows a flowchart of an implementation T822 of task T820.
Figure 59A:
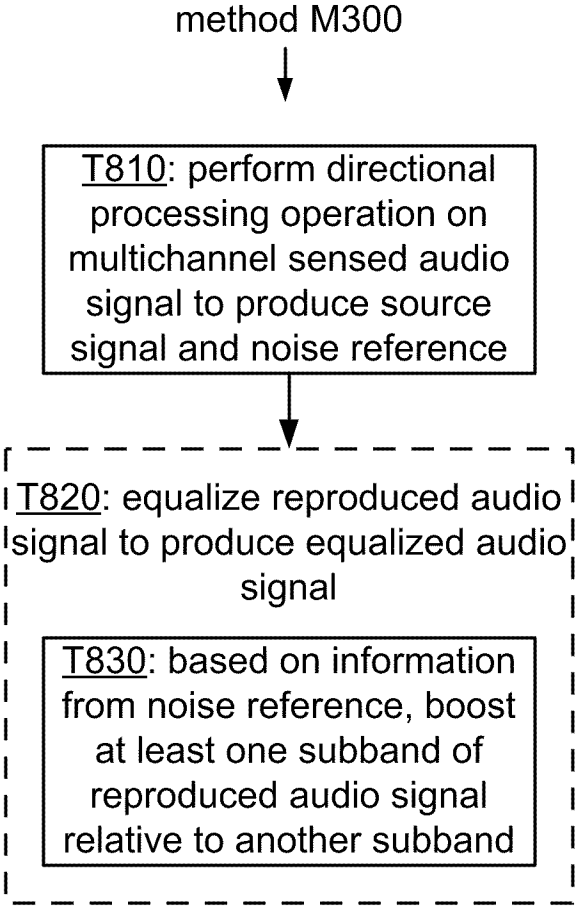
FIG. 59A shows a flowchart of a method M300 according to a general configuration.

FIG. 59A shows a flowchart of a method M300 of processing a reproduced audio signal according to a general configuration that includes tasks T810, T820, and T830 and may be performed by a device that is configured to process audio signals (e.g., one of the numerous examples of communications and/or audio reproduction devices disclosed herein). Task T810 performs a directional processing operation on a multichannel sensed audio signal to produce a source signal and a noise reference (e.g., as described above with reference to SSP filter SS10). Task T820 equalizes the reproduced audio signal to produce an equalized audio signal (e.g., as described above with reference to equalizer EQ10). Task T820 includes task T830, which boosts at least one frequency subband of the reproduced audio signal relative to at least one other frequency subband of the reproduced audio signal, based on information from the noise reference.

FIG. 59B shows a flowchart of an implementation T822 of task T820 that includes tasks T840, T850, T860, and an implementation T832 of task T830. For each of a plurality of subbands of the reproduced audio signal, task T840 calculates a first subband power estimate (e.g., as described above with reference to first subband power estimate generator EC100*a*). For each of a plurality of subbands of the noise reference, task T850 calculates a second subband power estimate (e.g., as described above with reference to second subband power estimate generator EC100*b*). For each of the plurality of subbands of the reproduced audio signal, task T860 calculates a ratio of the corresponding first and second power estimates (e.g., as described above with reference to subband gain factor calculator GC100). For each of the plurality of subbands of the reproduced audio signal, task T832 applies a gain factor based on the corresponding calculated ratio to the subband (e.g., as described above with reference to subband filter array FA100).

Figure 60D:
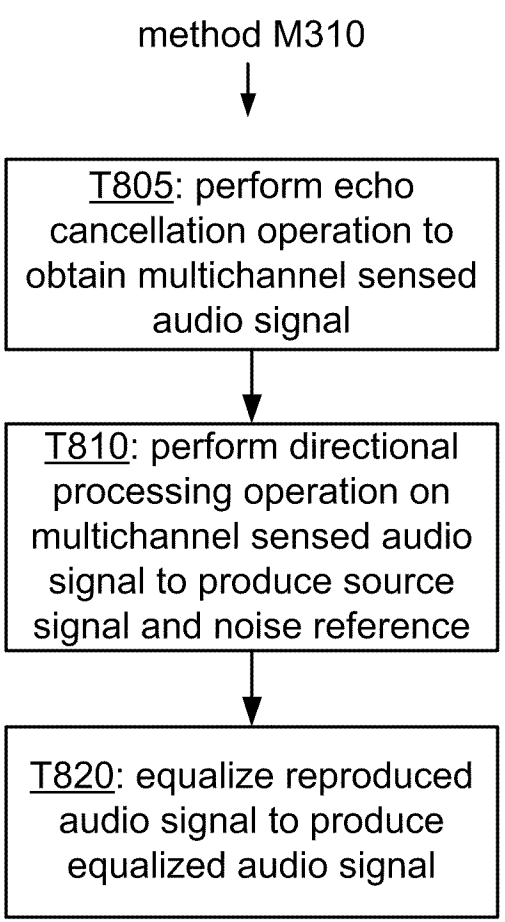
FIG. 60D shows a flowchart of an implementation M310 of method M300.
Figure 60B:
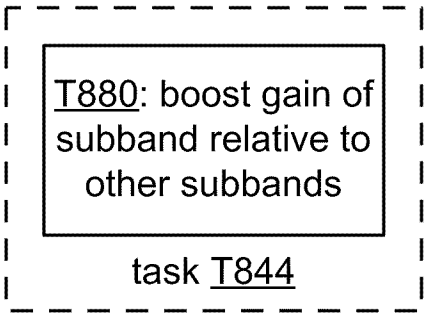
FIG. 60B shows a flowchart of an implementation T844 of task T840.
Figure 60C:
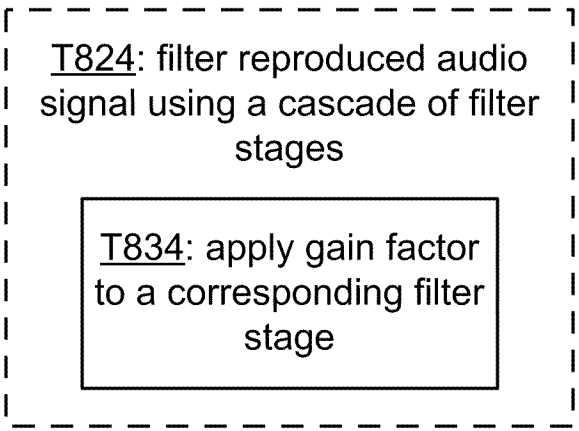
FIG. 60C shows a flowchart of an implementation T824 of task T820.
Figure 60A:
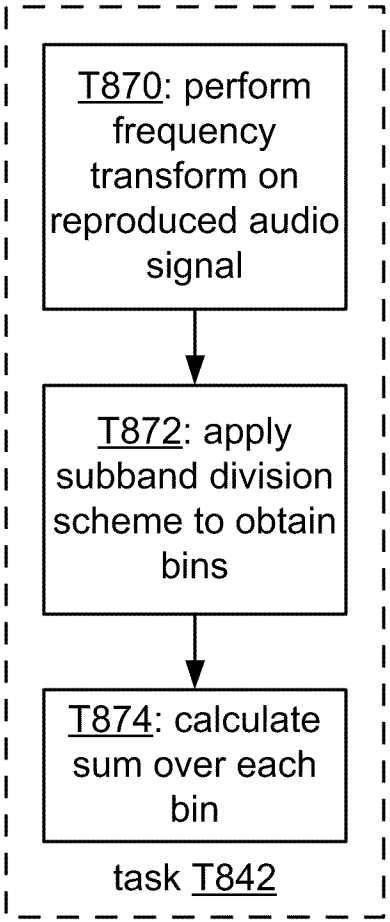
FIG. 60A shows a flowchart of an implementation T842 of task T840.

FIG. 60A shows a flowchart of an implementation T842 of task T840 that includes tasks T870, T872, and T874. Task T870 performs a frequency transform on the reproduced audio signal to obtain a transformed signal (e.g., as described above with reference to transform module SG10). Task T872 applies a subband division scheme to the transformed signal to obtain a plurality of bins (e.g., as described above with reference to binning module SG20). For each of the plurality of bins, task T874 calculates a sum over the bin (e.g., as described above with reference to summer EC10). Task T842 is configured such that each of the plurality of first subband power estimates is based on a corresponding one of the sums calculated by task T874.

FIG. 60B shows a flowchart of an implementation T844 of task T840 that includes a task T880. For each of the plurality of subbands of the reproduced audio signal, task T880 boosts a gain of the subband relative to other subbands of the reproduced audio signal to obtain a boosted subband signal (e.g., as described above with reference to subband filter array SG30). Task T844 is configured such that each of the plurality of first subband power estimates is based on information from a corresponding one of the boosted subband signals.

FIG. 60C shows a flowchart of an implementation T824 of task T820 that filters the reproduced audio signal using a cascade of filter stages. Task T824 includes an implementation T834 of task T830. For each of the plurality of subbands of the reproduced audio signal, task T834 applies a gain factor to the subband by applying the gain factor to a corresponding filter stage of the cascade.

FIG. 60D shows a flowchart of a method M310 of processing a reproduced audio signal according to a general configuration that includes tasks T805, T810, and T820. Task T805 performs an echo cancellation operation, based on information from the equalized audio signal, on a plurality of microphone signals to obtain the multichannel sensed audio signal (e.g., as described above with reference to echo canceller EC10).

Figure 61:
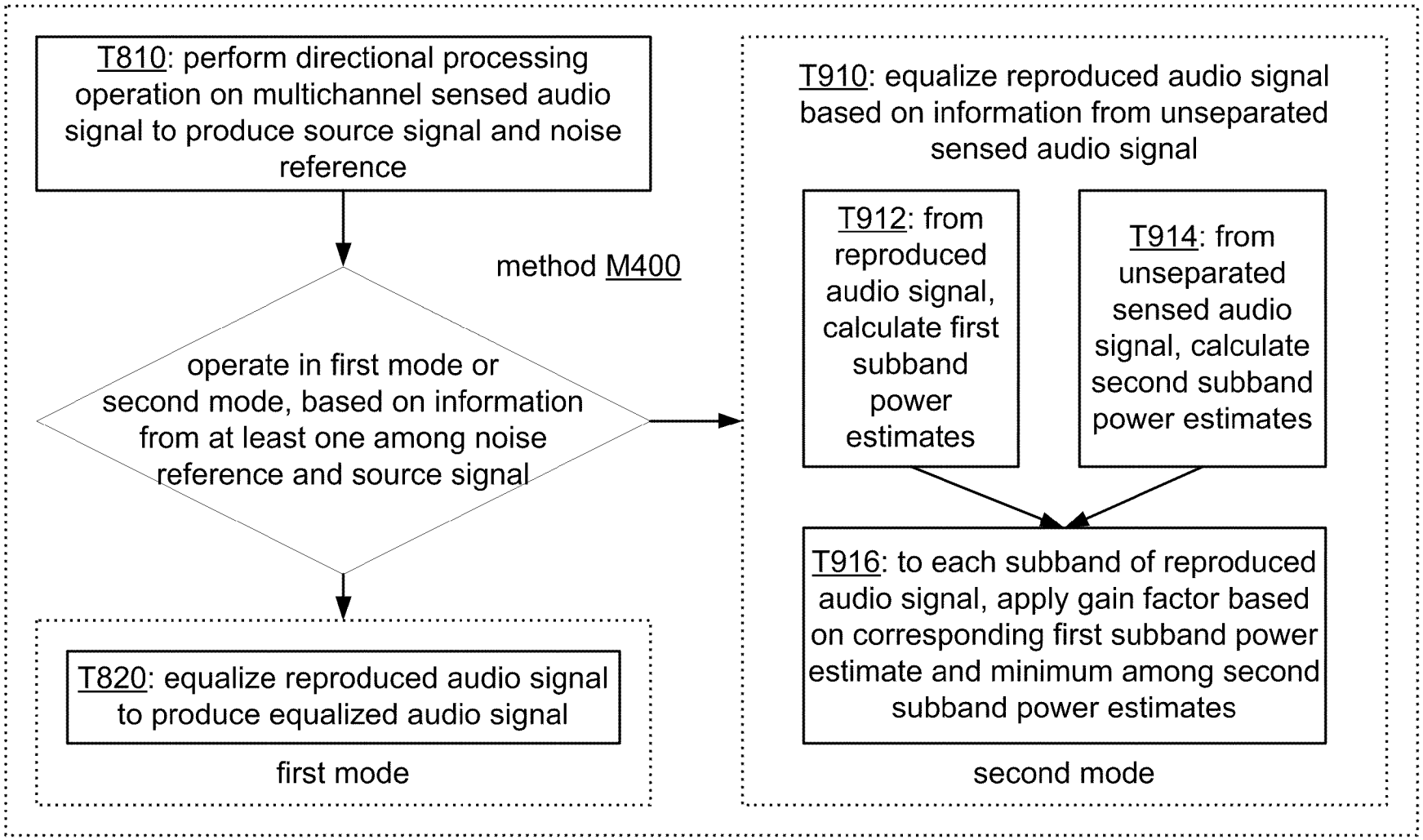
FIG. 61 shows a flowchart of a method M400 according to a configuration.

FIG. 61 shows a flowchart of a method M400 of processing a reproduced audio signal according to a configuration that includes tasks T810, T820, and T910. Based on information from at least one among the source signal and the noise reference, method M400 operates in a first mode or a second mode (e.g., as described above with reference to apparatus A200). Operation in the first mode occurs during a first time period, and operation in the second mode occurs during a second time period that is separate from the first time period. In the first mode, task T820 is performed. In the second mode, task T910 is performed. Task T910 equalizes the reproduced audio signal based on information from an unseparated sensed audio signal (e.g., as described above with reference to equalizer EQ100). Task T910 includes tasks T912, T914, and T916. For each of a plurality of subbands of the reproduced audio signal, task T912 calculates a first subband power estimate. For each of a plurality of subbands of the unseparated sensed audio signal, task T914 calculates a second subband power estimate. For each of the plurality of subbands of the reproduced audio signal, task T916 applies a corresponding gain factor to the subband, wherein the gain factor is based on (A) the corresponding first subband power estimate and (B) a minimum among the plurality of second subband power estimates.

Figure 62B:
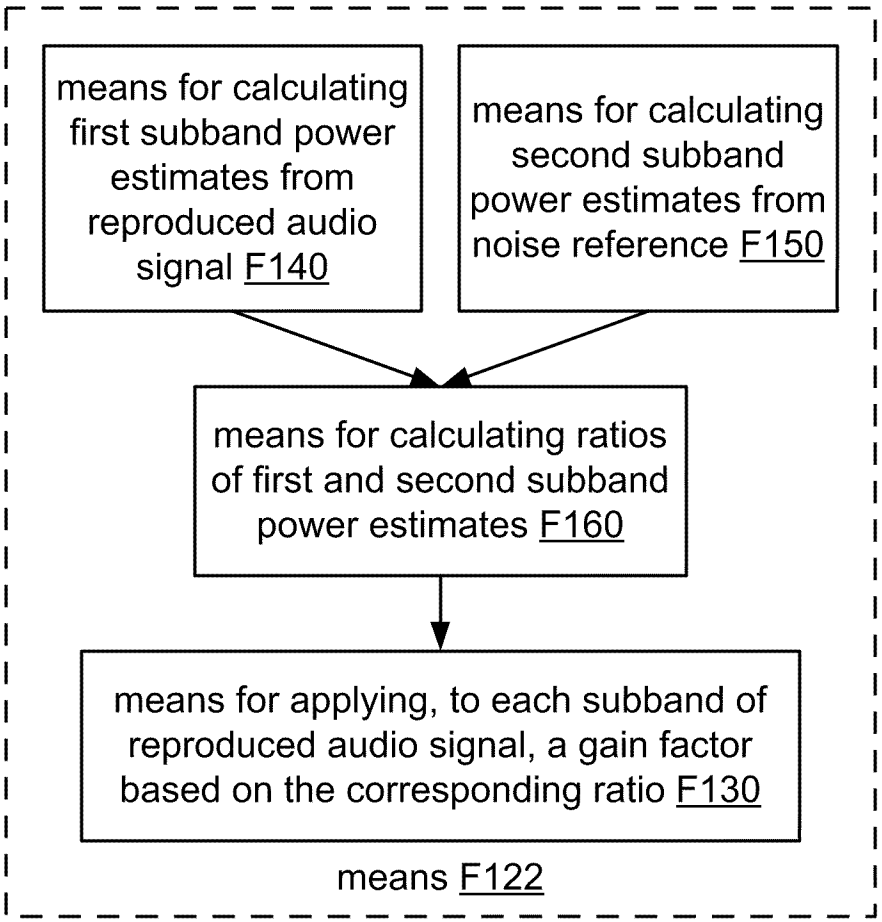
FIG. 62B shows a block diagram of an implementation F122 of means F120.
Figure 62A:
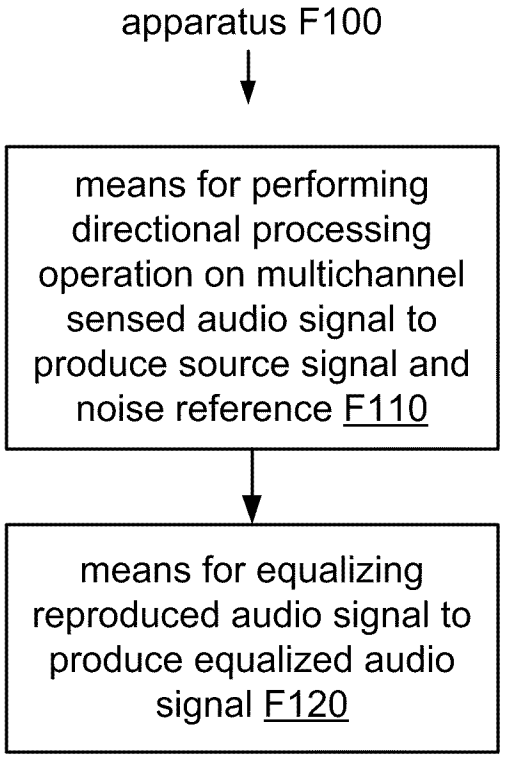
FIG. 62A shows a block diagram of an apparatus F100 according to a general configuration.

FIG. 62A shows a block diagram of an apparatus F100 for processing a reproduced audio signal according to a general configuration. Apparatus F100 includes means F110 for performing a directional processing operation on a multichannel sensed audio signal to produce a source signal and a noise reference (e.g., as described above with reference to SSP filter SS10). Apparatus F100 also includes means F120 for equalizing the reproduced audio signal to produce an equalized audio signal (e.g., as described above with reference to equalizer EQ10). Means F120 is configured to boost at least one frequency subband of the reproduced audio signal relative to at least one other frequency subband of the reproduced audio signal, based on information from the noise reference. Numerous implementations of apparatus F100, means F110, and means F120 are expressly disclosed herein (e.g., by virtue of the variety of elements and operations disclosed herein).

FIG. 62B shows a block diagram of an implementation F122 of means for equalizing F120. Means F122 includes means F140 for calculating a first subband power estimate for each of a plurality of subbands of the reproduced audio signal (e.g., as described above with reference to first subband power estimate generator EC100*a*), and means F150 for calculating a second subband power estimate for each of a plurality of subbands of the noise reference (e.g., as described above with reference to second subband power estimate generator EC100*b*). Means F122 also includes means F160 for calculating, for each of the plurality of subbands of the reproduced audio signal, a subband gain factor based on a ratio of the corresponding first and second power estimates (e.g., as described above with reference to subband gain factor calculator GC100), and means F130 for applying the corresponding gain factor to each of the plurality of subbands of the reproduced audio signal (e.g., as described above with reference to subband filter array FA100).

Figure 63A:
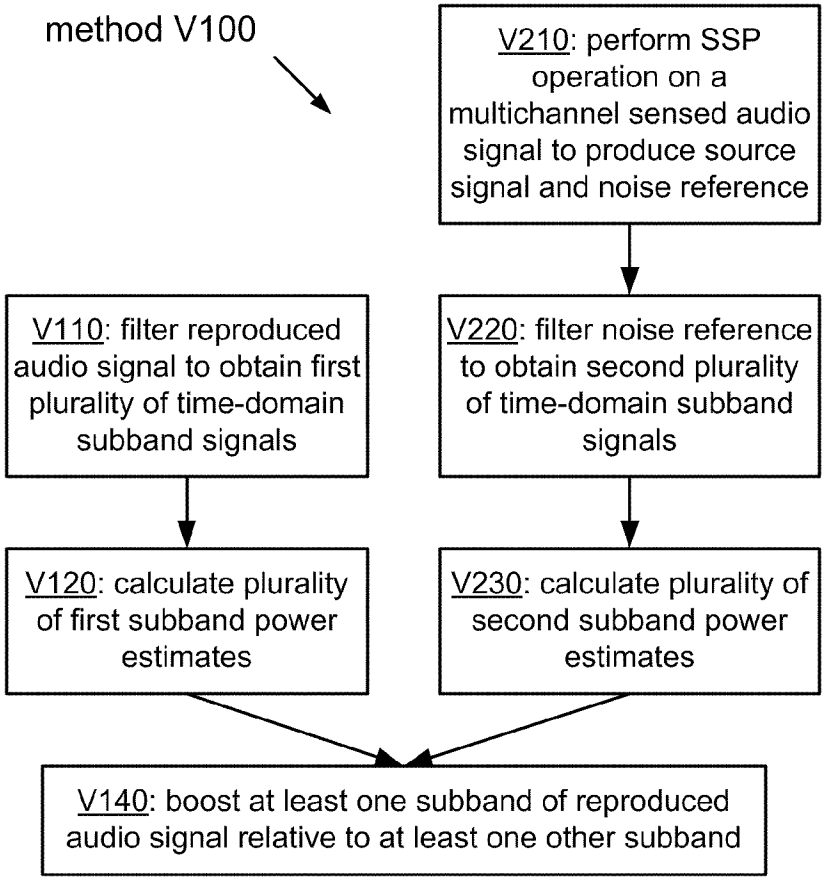
FIG. 63A shows a flowchart of a method V100 according to a general configuration.

FIG. 63A shows a flowchart of a method V100 of processing a reproduced audio signal according to a general configuration that includes tasks V110, V120, V140, V210, V220, and V230 and may be performed by a device that is configured to process audio signals (e.g., one of the numerous examples of communications and/or audio reproduction devices disclosed herein). Task V110 filters the reproduced audio signal to obtain a first plurality of time-domain subband signals, and task V120 calculates a plurality of first subband power estimates (e.g., as described above with reference to signal generator SG100*a* and power estimate calculator EC100*a*). Task V210 performs a spatially selective processing operation on a multichannel sensed audio signal to produce a source signal and a noise reference (e.g., as described above with reference to SSP filter SS10). Task V220 filters the noise reference to obtain a second plurality of time-domain subband signals, and task V230 calculates a plurality of second subband power estimates (e.g., as described above with reference to signal generator SG100*b* and power estimate calculator EC100*b* or NP100). Task V140 boosts at least one subband of reproduced audio signal relative to at least one other subband (e.g., as described above with reference to subband filter array FA100).

Figure 63B:
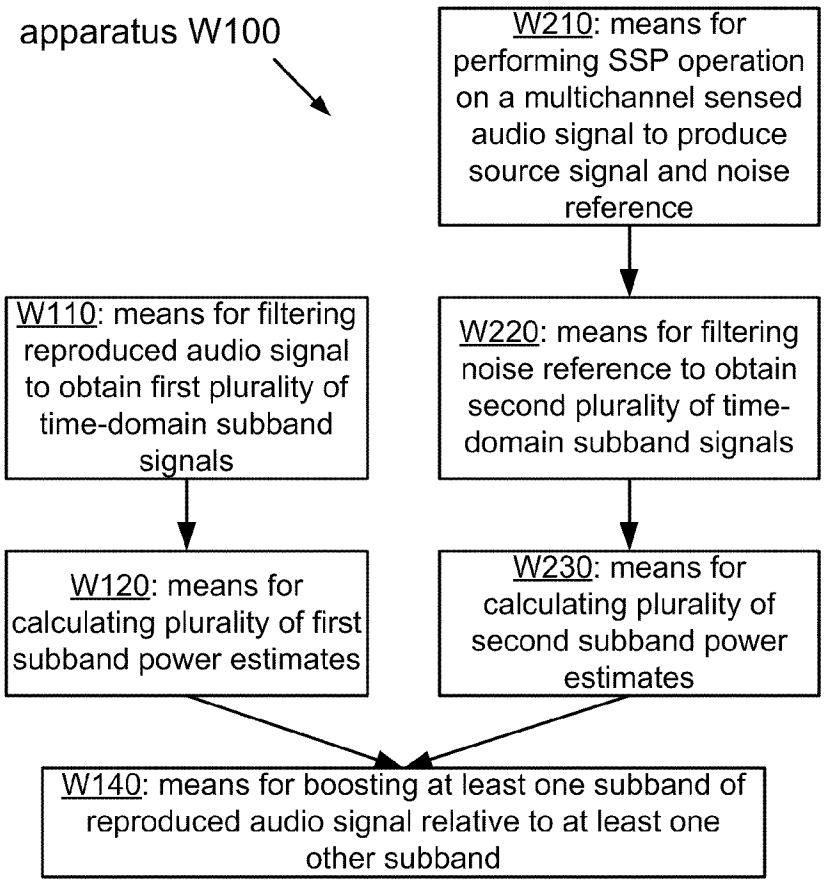
FIG. 63B shows a block diagram of an apparatus W100 according to a general configuration.

FIG. 63B shows a block diagram of an apparatus W100 for processing a reproduced audio signal according to a general configuration that may be included within a device that is configured to process audio signals (e.g., one of the numerous examples of communications and/or audio reproduction devices disclosed herein). Apparatus W100 includes means V110 for filtering the reproduced audio signal to obtain a first plurality of time-domain subband signals, and means V120 for calculating a plurality of first subband power estimates (e.g., as described above with reference to signal generator SG100*a* and power estimate calculator EC100*a*). Apparatus W100 includes means W210 for performing a spatially selective processing operation on a multichannel sensed audio signal to produce a source signal and a noise reference (e.g., as described above with reference to SSP filter SS10). Apparatus W100 includes means W220 for filtering the noise reference to obtain a second plurality of time-domain subband signals, and means W230 for calculating a plurality of second subband power estimates (e.g., as described above with reference to signal generator SG100*b* and power estimate calculator EC100*b* or NP100). Apparatus W100 includes means W140 for boosting at least one subband of reproduced audio signal relative to at least one other subband (e.g., as described above with reference to subband filter array FA100).

Figure 64A:
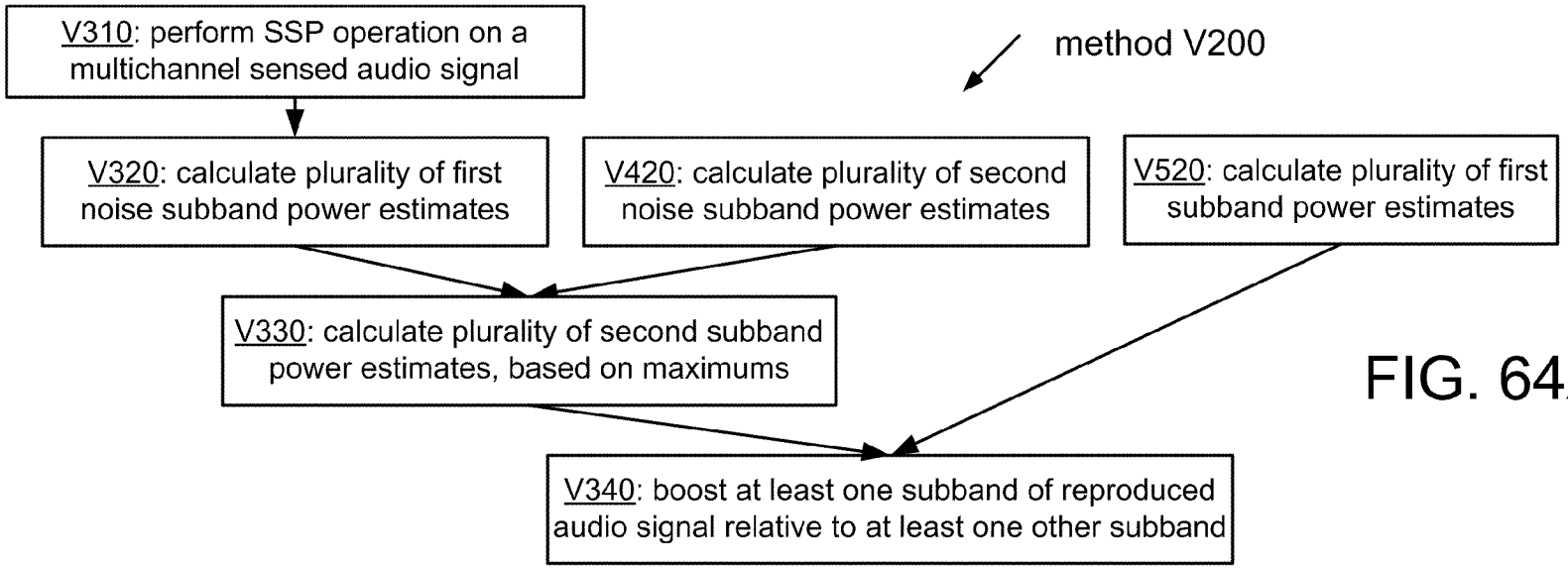
FIG. 64A shows a flowchart of a method V200 according to a general configuration.

FIG. 64A shows a flowchart of a method V200 of processing a reproduced audio signal according to a general configuration that includes tasks V310, V320, V330, V340, V420, and V520 and may be performed by a device that is configured to process audio signals (e.g., one of the numerous examples of communications and/or audio reproduction devices disclosed herein). Task V310 performs a spatially selective processing operation on a multichannel sensed audio signal to produce a source signal and a noise reference (e.g., as described above with reference to SSP filter SS10). Task V320 calculates a plurality of first noise subband power estimates (e.g., as described above with reference to power estimate calculator NC100*b*). For each of a plurality of subbands of a second noise reference that is based on information from multichannel sensed audio signal, task V320 calculates a corresponding second noise subband power estimate (e.g., as described above with reference to power estimate calculator NC100*c*). Task V520 calculates a plurality of first subband power estimates (e.g., as described above with reference to power estimate calculator EC100*a*). Task V330 calculates a plurality of second subband power estimates, based on maximums of the first and second noise subband power estimates (e.g., as described above with reference to power estimate calculator NP100). Task V340 boosts at least one subband of reproduced audio signal relative to at least one other subband (e.g., as described above with reference to subband filter array FA100).

Figure 64B:
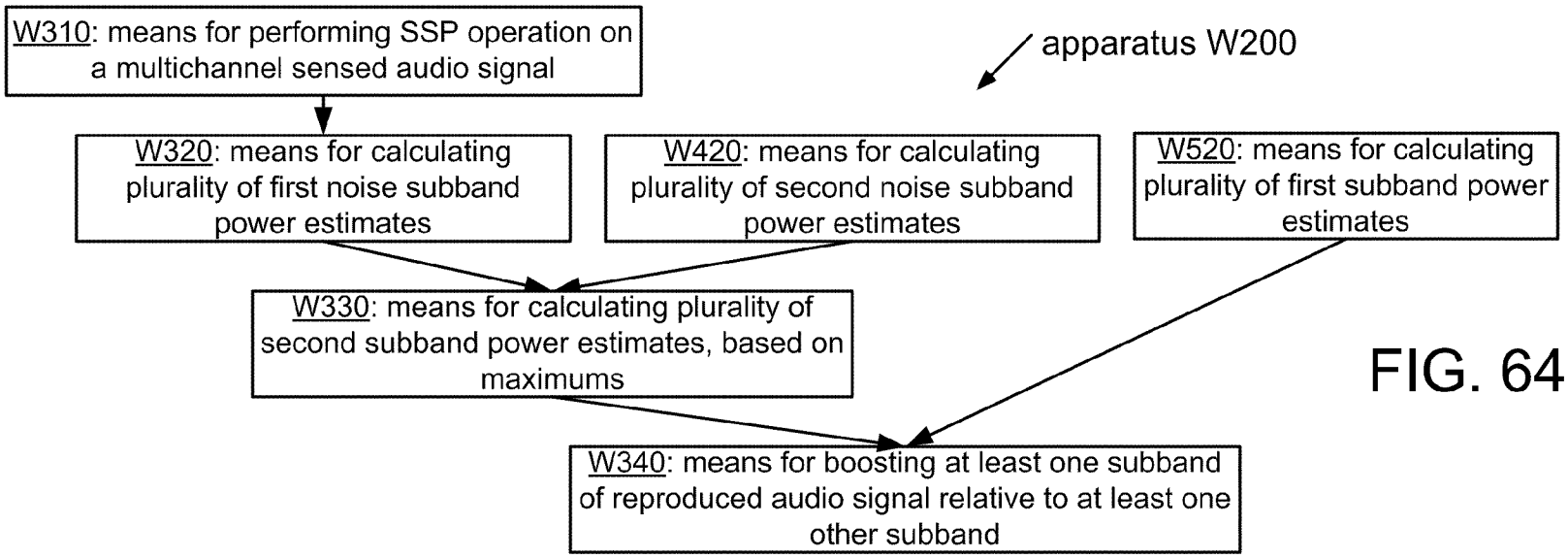
FIG. 64B shows a block diagram of an apparatus W200 according to a general configuration.

FIG. 64B shows a block diagram of an apparatus W100 for processing a reproduced audio signal according to a general configuration that may be included within a device that is configured to process audio signals (e.g., one of the numerous examples of communications and/or audio reproduction devices disclosed herein). Apparatus W100 includes means W310 for performing a spatially selective processing operation on a multichannel sensed audio signal to produce a source signal and a noise reference (e.g., as described above with reference to SSP filter SS10) and means W320 for calculating a plurality of first noise subband power estimates (e.g., as described above with reference to power estimate calculator NC100*b*). Apparatus W100 includes means W320 for calculating, for each of a plurality of subbands of a second noise reference that is based on information from multichannel sensed audio signal, a corresponding second noise subband power estimate (e.g., as described above with reference to power estimate calculator NC100*c*). Apparatus W100 includes means W520 for calculating a plurality of first subband power estimates (e.g., as described above with reference to power estimate calculator EC100*a*). Apparatus W100 includes means W330 for calculating a plurality of second subband power estimates, based on maximums of the first and second noise subband power estimates (e.g., as described above with reference to power estimate calculator NP100). Apparatus W100 includes means W340 for boosting at least one subband of reproduced audio signal relative to at least one other subband (e.g., as described above with reference to subband filter array FA100).

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Examples of codecs that may be used with, or adapted for use with, transmitters and/or receivers of communications devices as described herein include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004).

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for voice communications at higher sampling rates (e.g., for wideband communications).

The various elements of an implementation of an apparatus as disclosed herein may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

Those of skill will appreciate that the various illustrative modules, logical blocks, circuits, and operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M110, M120, M210, M220, M300, and M400, as well as the numerous implementations of such methods and additional methods that are expressly disclosed herein by virtue of the descriptions of the operation of the various implementations of apparatus as disclosed herein) may be performed by a array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included with such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times). For example, two of more of subband signal generators SG100*a*, SG100*b*, and SG100*c* may be implemented to include the same structure at different times. In another example, two of more of subband power estimate calculators EC100*a*, EC100*b*, and EC100*c* may be implemented to include the same structure at different times. In another example, subband filter array FA100 and one or more implementations of subband filter array SG30 may be implemented to include the same structure at different times (e.g., using different sets of filter coefficient values at different times).

It is also expressly contemplated and hereby disclosed that various elements that are described herein with reference to a particular implementation of apparatus A100 and/or equalizer EQ10 may also be used in the described manner with other disclosed implementations. For example, one or more of AGC module G10 (as described with reference to apparatus A140), audio preprocessor AP10 (as described with reference to apparatus A110), echo canceller EC10 (as described with reference to audio preprocessor AP20), noise reduction stage NR10 (as described with reference to apparatus A105), and voice activity detector V10 (as described with reference to apparatus A120) may be included in other disclosed implementations of apparatus A100. Likewise, peak limiter L10 (as described with reference to equalizer EQ40) may be included in other disclosed implementations of equalizer EQ10. Although applications to two-channel (e.g., stereo) instances of sensed audio signal S10 are primarily described above, extensions of the principles disclosed herein to instances of sensed audio signal S10 having three or more channels (e.g., from an array of three or more microphones) are also expressly contemplated and disclosed herein.

What is claimed is:

1. A method comprising:

performing a spatially selective processing operation on a first input, wherein the first input is a multichannel sensed audio signal input, to produce a source signal and a noise reference;

filtering a second input, wherein the second input is a reproduced audio signal input, to obtain a first plurality of time-domain subband signals;

filtering the noise reference to obtain a second plurality of time-domain subband signals;

based on information from the first plurality of time-domain subband signals, calculating a plurality of first subband power estimates;

based on information from the second plurality of time-domain subband signals, calculating a plurality of second subband power estimates; and based on information from the plurality of first subband power estimates and on information from the plurality of second subband power estimates, boosting at least one frequency subband of the reproduced audio signal input relative to at least one other frequency subband of the reproduced audio signal input.

2. The method of claim 1, further comprising filtering a second noise reference that is based on information from the multichannel sensed audio signal input to obtain a third plurality of time-domain subband signals, and wherein said calculating a plurality of second subband power estimates is based on information from the third plurality of time-domain subband signals.

3. The method of claim 2, wherein the second noise reference is an unseparated sensed audio signal.

4. The method of claim 3, wherein said calculating a plurality of second subband power estimates includes:

based on information from the second plurality of time-domain subband signals, calculating a plurality of first noise subband power estimates;

based on information from the third plurality of time-domain subband signals, calculating a plurality of second noise subband power estimates; and identifying the minimum among the calculated plurality of second noise subband power estimates, and wherein the values of at least two among the plurality of second subband power estimates are based on the identified minimum.

5. The method of claim 2, wherein the second noise reference is based on the source signal.

6. The method of claim 2, wherein said calculating a plurality of second subband power estimates includes:

based on information from the second plurality of time-domain subband signals, calculating a plurality of first noise subband power estimates; and based on information from the third plurality of time-domain subband signals, calculating a plurality of second noise subband power estimates, and wherein each of the plurality of second subband power estimates is based on the maximum of (A) a corresponding one of the plurality of first noise subband power estimates and (B) a corresponding one of the plurality of second noise subband power estimates.

7. The method of claim 1, wherein said performing a spatially selective processing operation includes concentrating energy of a directional component of the multichannel sensed audio signal input into the source signal.

8. The method of claim 1, wherein the multichannel sensed audio signal input includes a directional component and a noise component, and wherein said performing a spatially selective processing operation includes separating energy of the directional component from energy of the noise component such that the source signal contains more of the energy of the directional component than each channel of the multichannel sensed audio signal input does.

9. The method of claim 1, wherein said filtering the reproduced audio signal input to obtain a first plurality of time-domain subband signals includes obtaining each among the first plurality of time-domain subband signals by boosting a gain of a corresponding subband of the reproduced audio signal input relative to other subbands of the reproduced audio signal input.

10. The method of claim 1, wherein said method includes, for each of the plurality of first subband power estimates, calculating a ratio of the first subband power estimate and a corresponding one of the plurality of second subband power estimates; and wherein said boosting at least one frequency subband of the reproduced audio signal input relative to at least one other frequency subband of the reproduced audio signal input includes, for each of the plurality of first subband power estimates, applying a gain factor based on the corresponding calculated ratio to a corresponding frequency subband of the reproduced audio signal.

11. The method of claim 10, wherein said boosting at least one frequency subband of the reproduced audio signal input relative to at least one other frequency subband of the reproduced audio signal input includes filtering the reproduced audio signal input using a cascade of filter stages, and wherein, for each of the plurality of first subband power estimates, said applying a gain factor to a corresponding frequency subband of the reproduced audio signal input comprises applying the gain factor to a corresponding filter stage of the cascade.

12. The method of claim 10, wherein, for at least one of the plurality of first subband power estimates, a current value of the corresponding gain factor is constrained by at least one bound that is based on a current level of the reproduced audio signal.

13. The method of claim 10, wherein said method includes, for at least one of the plurality of first subband power estimates, smoothing a value of the corresponding gain factor over time according to a change in the value of the corresponding ratio over time.

14. The method of claim 1, wherein said method includes performing an echo cancellation operation on a plurality of microphone signals to obtain the multichannel sensed audio signal, wherein said performing an echo cancellation operation is based on information from an audio signal that results from said boosting at least one frequency subband of the reproduced audio signal input relative to at least one other frequency subband of the reproduced audio signal.

15. A method of processing a reproduced audio signal, said method comprising performing each of the following acts within a device that is configured to process audio signals:

performing a spatially selective processing operation on a multichannel sensed audio signal to produce a source signal and a noise reference;

for each of a plurality of subbands of the reproduced audio signal, calculating a first subband power estimate;

for each of a plurality of subbands of the noise reference, calculating a first noise subband power estimate;

for each of a plurality of subbands of a second noise reference that is based on information from the multichannel sensed audio signal, calculating a second noise subband power estimate;

for each of the plurality of subbands of the reproduced audio signal, calculating a second subband power estimate that is based on a maximum of the corresponding first and second noise subband power estimates; and based on information from the plurality of first subband power estimates and on information from the plurality of second subband power estimates, boosting at least one frequency subband of the reproduced audio signal relative to at least one other frequency subband of the reproduced audio signal.

16. The method according to claim 15, wherein the second noise reference is an unseparated sensed audio signal.

17. The method according to claim 15, wherein the second noise reference is based on the source signal.

18. An apparatus comprising:

a spatially selective processing filter configured to perform a spatially selective processing operation on a first input, wherein the first input is a multichannel sensed audio signal input, to produce a source signal and a noise reference;

a first subband signal generator configured to filter a second input, wherein the second input is a reproduced audio signal input, to obtain a first plurality of time-domain subband signals;

a second subband signal generator configured to filter the noise reference to obtain a second plurality of time-domain subband signal;

a first subband power estimate calculator configured to calculate a plurality of first subband power estimates based on information from the first plurality of time-domain subband signals;

a second subband power estimate calculator configured to calculate a plurality of second subband power estimates based on information from the second plurality of time-domain subband signals; and a subband filter array configured to boost at least one frequency subband of the reproduced audio signal input-relative to at least one other frequency subband of the reproduced audio signal input, based on information from the plurality of first subband power estimates and on information from the plurality of second subband power estimates.

19. The apparatus according to claim 18, wherein said method includes a third subband signal generator configured to filter a second noise reference that is based on information from the multichannel sensed audio signal input to obtain a third plurality of time-domain subband signals, and wherein said second subband power estimate calculator is configured to calculate the plurality of second subband power estimates based on information from the third plurality of time-domain subband signals.

20. The apparatus according to claim 19, wherein the second noise reference is an unseparated sensed audio signal.

21. The apparatus according to claim 19, wherein the second noise reference is based on the source signal.

22. The apparatus according to claim 19, wherein said second subband power estimate calculator is configured to calculate (A) a plurality of first noise subband power estimates based on information from the second plurality of time-domain subband signals and (B) a plurality of second noise subband power estimates based on information from the third plurality of time-domain subband signals, and wherein said second subband power estimate calculator is configured to calculate each of the plurality of second subband power estimates based on the maximum of (A) a corresponding one of the plurality of first noise subband power estimates and (B) a corresponding one of the plurality of second noise subband power estimates.

23. The apparatus according to claim 18, wherein the multichannel sensed audio signal input includes a directional component and a noise component, and wherein said spatially selective processing filter is configured to separate energy of the directional component from energy of the noise component such that the source signal contains more of the energy of the directional component than each channel of the multichannel sensed audio signal input does.

24. The apparatus according to claim 18, wherein said first subband signal generator is configured to obtain each among the first plurality of time-domain subband signals by boosting a gain of a corresponding subband of the reproduced audio signal input relative to other subbands of the reproduced audio signal.

25. The apparatus according to claim 18, wherein said apparatus includes a subband gain factor calculator configured to calculate, for each of the plurality of first subband power estimates, a ratio of the first subband power estimate and a corresponding one of the plurality of second subband power estimates; and wherein said subband filter array is configured to apply a gain factor based on the corresponding calculated ratio, for each of the plurality of first subband power estimates, to a corresponding frequency subband of the reproduced audio signal.

26. The apparatus according to claim 25, wherein said subband filter array includes a cascade of filter stages, and wherein said subband filter array is configured to apply each of the plurality of gain factors to a corresponding filter stage of the cascade.

27. The apparatus according to claim 25, wherein said subband gain factor calculator is configured to constrain a current value of the corresponding gain factor, for at least one of the plurality of first subband power estimates, by at least one bound that is based on a current level of the reproduced audio signal.

28. The apparatus according to claim 25, wherein said first subband gain factor calculator is configured to smooth a value of the corresponding gain factor over time, for at least one of the plurality of first subband power estimates, according to a change in the value of the corresponding ratio over time.

29. A non-transitory computer-readable medium comprising instructions which when executed by a processor cause the processor to:

perform a spatially selective processing operation on a first input, wherein the first input is a multichannel sensed audio signal input, to produce a source signal and a noise reference;

filter a second input, wherein the second input is a reproduced audio signal input, to obtain a first plurality of time-domain subband signals;

filter the noise reference to obtain a second plurality of time-domain subband signals;

based on information from the first plurality of time-domain subband signals, calculate a plurality of first subband power estimates;

based on information from the second plurality of time-domain subband signals, calculate a plurality of second subband power estimates; and based on information from the plurality of first subband power estimates and on information from the plurality of second subband power estimates, boost at least one frequency subband of the reproduced audio signal input relative to at least one other frequency subband of the reproduced audio signal.

30. The computer-readable medium according to claim 29, wherein said medium includes instructions which when executed by a processor cause the processor to filter a second noise reference that is based on information from the multichannel sensed audio signal input to obtain a third plurality of time-domain subband signals, and wherein said instructions which when executed by a processor cause the processor to calculate a plurality of second subband power estimates, when executed by the processor cause the processor to calculate the plurality of second subband power estimates based on information from the third plurality of time-domain subband signals.

31. The computer-readable medium according to claim 30, wherein the second noise reference is an unseparated sensed audio signal.

32. The computer-readable medium according to claim 30, wherein the second noise reference is based on the source signal.

33. The computer-readable medium according to claim 30, wherein said instructions which when executed by a processor cause the processor to calculate a plurality of second subband power estimates include instructions which when executed by a processor cause the processor to:

based on information from the second plurality of time-domain subband signals, calculate a plurality of first noise subband power estimates; and based on information from the third plurality of time-domain subband signals, calculate a plurality of second noise subband power estimates, and wherein said instructions which when executed by a processor cause the processor to calculate a plurality of second subband power estimates, when executed by the processor cause the processor to calculate each of the plurality of second subband power estimates based on the maximum of (A) a corresponding one of the plurality of first noise subband power estimates and (B) a corresponding one of the plurality of second noise subband power estimates.

34. The computer-readable medium according to claim 29, wherein the multichannel sensed audio signal input includes a directional component and a noise component, and wherein said instructions which when executed by a processor cause the processor to perform a spatially selective processing operation include instructions which when executed by a processor cause the processor to separate energy of the directional component from energy of the noise component such that the source signal contains more of the energy of the directional component than each channel of the multichannel sensed audio signal input does.

35. The computer-readable medium according to claim 29, wherein said instructions which when executed by a processor cause the processor to filter the reproduced audio signal input to obtain a first plurality of time-domain subband signals include instructions which when executed by a processor cause the processor to obtain each among the first plurality of time-domain subband signals by boosting a gain of a corresponding subband of the reproduced audio signal input relative to other subbands of the reproduced audio signal.

36. The computer-readable medium according to claim 29, wherein said medium includes instructions which when executed by a processor cause the processor to calculate, for each of the plurality of first subband power estimates, a gain factor based on a ratio of (A) the first subband power estimate and (B) a corresponding one of the plurality of second subband power estimates; and wherein said instructions which when executed by a processor cause the processor to boost at least one frequency subband of the reproduced audio signal input relative to at least one other frequency subband of the reproduced audio signal input include instructions which when executed by a processor cause the processor to apply, for each of the plurality of first subband power estimates, a gain factor based on the corresponding calculated ratio to a corresponding frequency subband of the reproduced audio signal input.

37. The computer-readable medium according to claim 36, wherein said instructions which when executed by a processor cause the processor to boost at least one frequency subband of the reproduced audio signal input relative to at least one other frequency subband of the reproduced audio signal input include instructions which when executed by a processor cause the processor to filter the reproduced audio signal input using a cascade of filter stages, and wherein said instructions which when executed by a processor cause the processor to apply, for each of the plurality of first subband power estimates, a gain factor to a corresponding frequency subband of the reproduced audio signal input include instructions which when executed by a processor cause the processor to apply the gain factor to a corresponding filter stage of the cascade.

38. The computer-readable medium according to claim 36, wherein said instructions which when executed by a processor cause the processor to calculate a gain factor include instructions which when executed by a processor cause the processor to constrain a current value of the corresponding gain factor, for at least one of the plurality of first subband power estimates, by at least one bound that is based on a current level of the reproduced audio signal.

39. The computer-readable medium according to claim 36, wherein said instructions which when executed by a processor cause the processor to calculate a gain factor include instructions which when executed by a processor cause the processor to smooth, for at least one of the plurality of first subband power estimates, a value of the corresponding gain factor over time according to a change in the value of the corresponding ratio over time.

40. An apparatus comprising:

means for performing a spatially selective processing operation on a first input, wherein the first input is a multichannel sensed audio signal input, to produce a source signal and a noise reference;

means for filtering a second input, wherein the second input is a reproduced audio signal input, to obtain a first plurality of time-domain subband signals;

means for filtering the noise reference to obtain a second plurality of time-domain subband signals;

means for calculating a plurality of first subband power estimates based on information from the first plurality of time-domain subband signals;

means for calculating a plurality of second subband power estimates based on information from the second plurality of time-domain subband signals; and means for boosting at least one frequency subband of the reproduced audio signal input relative to at least one other frequency subband of the reproduced audio signal input, based on information from the plurality of first subband power estimates and on information from the plurality of second subband power estimates.

41. The apparatus according to claim 40, wherein said apparatus includes means for filtering a second noise reference that is based on information from the multichannel sensed audio signal input to obtain a third plurality of time-domain subband signals, and wherein said means for calculating a plurality of second subband power estimates is configured to calculate the plurality of second subband power estimates based on information from the third plurality of time-domain subband signals.

42. The apparatus according to claim 41, wherein the second noise reference is an unseparated sensed audio signal.

43. The apparatus according to claim 41, wherein the second noise reference is based on the source signal.

44. The apparatus according to claim 41, wherein said means for calculating a plurality of second subband power estimates is configured to calculate (A) a plurality of first noise subband power estimates based on information from the second plurality of time-domain subband signals and (B) a plurality of second noise subband power estimates based on information from the third plurality of time-domain subband signals, and wherein said means for calculating a plurality of second subband power estimates is configured to calculate each of the plurality of second subband power estimates based on the maximum of (A) a corresponding one of the plurality of first noise subband power estimates and (B) a corresponding one of the plurality of second noise subband power estimates.

45. The apparatus according to claim 40, wherein the multichannel sensed audio signal input includes a directional component and a noise component, and wherein said means for performing a spatially selective processing operation is configured to separate energy of the directional component from energy of the noise component such that the source signal contains more of the energy of the directional component than each channel of the multichannel sensed audio signal input does.

46. The apparatus according to claim 40, wherein said means for filtering the reproduced audio signal input is configured to obtain each among the first plurality of time-domain subband signals by boosting a gain of a corresponding subband of the reproduced audio signal input relative to other subbands of the reproduced audio signal input.

47. The apparatus according to claim 40, wherein said apparatus includes means for calculating, for each of the plurality of first subband power estimates, a gain factor based on a ratio of (A) the first subband power estimate and (B) a corresponding one of the plurality of second subband power estimates; and wherein said means for boosting is configured to apply a gain factor based on the corresponding calculated ratio, for each of the plurality of first subband power estimates, to a corresponding frequency subband of the reproduced audio signal.

48. The apparatus according to claim 47, wherein said means for boosting includes a cascade of filter stages, and wherein said means for boosting is configured to apply each of the plurality of gain factors to a corresponding filter stage of the cascade.

49. The apparatus according to claim 47, wherein said means for calculating a gain factor is configured to constrain a current value of the corresponding gain factor, for at least one of the plurality of first subband power estimates, by at least one bound that is based on a current level of the reproduced audio signal.

50. The apparatus according to claim 47, wherein said means for calculating a gain factor is configured to smooth a value of the corresponding gain factor over time, for at least one of the plurality of first subband power estimates, according to a change in the value of the corresponding ratio over time.

* * * * *